US008006332B2

(12) United States Patent
Lemire et al.

(10) Patent No.: US 8,006,332 B2
(45) Date of Patent: Aug. 30, 2011

(54) HOSPITAL BED

(75) Inventors: Guy Lemire, Beaumont (CA); Jean-Paul Dionne, Lévis (CA); Nicolas Cantin, St-Nicolas (CA); Marco Morin, Lévis (CA); Richard Paré, Montréal (CA); Pascal Castonguay, Lévis (CA); Luc Petitpas, Québec (CA); David Kim Soui Wan Fong, St-Romuald (CA)

(73) Assignee: Stryker Corporation, Kalamazoo, MI (US)

( * ) Notice: Subject to any disclaimer, the term of this patent is extended or adjusted under 35 U.S.C. 154(b) by 749 days.

(21) Appl. No.: 11/612,781

(22) Filed: Dec. 19, 2006

(65) Prior Publication Data

US 2007/0174965 A1 Aug. 2, 2007

Related U.S. Application Data

(60) Provisional application No. 60/751,770, filed on Dec. 19, 2005.

(51) Int. Cl.
*A47B 71/00* (2006.01)

(52) U.S. Cl. ..... 5/600; 5/611; 5/613; 5/617; 5/618

(58) Field of Classification Search ..... 5/613, 619, 5/617, 618, 640, 661, 658, 600, 611, 630
See application file for complete search history.

(56) References Cited

U.S. PATENT DOCUMENTS

| | | | | |
|---|---|---|---|---|
| 3,962,615 A | | 6/1976 | Spangler | |
| 4,183,015 A | | 1/1980 | Drew et al. | |
| 4,231,124 A | | 11/1980 | Croxton | |
| 4,345,344 A | | 8/1982 | Gadoury et al. | |
| 4,435,862 A | | 3/1984 | King et al. | |
| 4,489,454 A | * | 12/1984 | Thompson | 5/503.1 |
| 4,559,655 A | | 12/1985 | Peck | |
| 4,680,790 A | | 7/1987 | Packard et al. | |
| 4,751,754 A | | 6/1988 | Bailey et al. | |
| 4,953,243 A | | 9/1990 | Birkmann | |
| 5,023,967 A | * | 6/1991 | Ferrand | 5/503.1 |
| 5,090,070 A | | 2/1992 | Heinz | |
| 5,094,418 A | * | 3/1992 | McBarnes et al. | 5/658 |
| 5,105,486 A | | 4/1992 | Peterson | |
| 5,135,191 A | * | 8/1992 | Schmuhl | 5/658 |

(Continued)

FOREIGN PATENT DOCUMENTS

GB 2146241 4/1985

(Continued)

OTHER PUBLICATIONS

International Search Report for International Application No. PCT/US06/48452 dated Jan. 9, 2008.

*Primary Examiner* — Robert G Santos
*Assistant Examiner* — Brittany M Wilson
(74) *Attorney, Agent, or Firm* — Warner Norcross & Judd LLP

(57) ABSTRACT

A patient support apparatus may include a base frame, lift arms, an intermediate frame, a deck support having three articulating sections, a brake system, various drive motors, actuators, and sensors, at least one power source, communication devices, and at least one controller, wherein the lift arms, articulating sections, drive motors, brake system, and actuators may be controlled from the at least one controller and in response to signals received by the various sensors, while storing data internally and/or sending data to a remote location.

12 Claims, 44 Drawing Sheets

U.S. PATENT DOCUMENTS 5,161,274 A 11/1992 Hayes et al.
5,205,004 A 4/1993 Hayes et al.
5,239,300 A 8/1993 Berger et al.
5,317,769 A 6/1994 Weismiller et al.
5,329,657 A 7/1994 Bartley et al.
5,337,428 A 8/1994 Krauska et al.
5,377,372 A 1/1995 Rudolf et al.
5,407,163 A * 4/1995 Kramer et al. ..... 5/503.1
5,444,880 A 8/1995 Weismiller et al.
5,499,721 A * 3/1996 Hansen et al. ..... 5/658
5,502,853 A 4/1996 Singleton
5,542,138 A 8/1996 Williams et al.
5,611,096 A 3/1997 Bartlett et al.
5,715,548 A 2/1998 Weismuller et al.
5,745,937 A 5/1998 Weismuller et al.
5,926,878 A 7/1999 Morton et al.
6,000,076 A 12/1999 Webster et al.
6,008,598 A 12/1999 Luff et al.
6,163,903 A 12/2000 Weismiller et al.
6,188,407 B1 2/2001 Smith et al.
6,226,816 B1 5/2001 Webster et al.
6,240,579 B1 6/2001 Hanson et al.
6,264,006 B1 7/2001 Hanson et al.
6,279,183 B1 8/2001 Kummer et al.
6,289,537 B1 9/2001 Hopper et al.
6,296,261 B1 10/2001 deGoma
6,314,597 B2 11/2001 Heimbrock
6,320,510 B2 11/2001 Menkedick et al.
6,336,235 B1 1/2002 Ruehl
6,351,678 B1 2/2002 Borders
6,363,556 B1 4/2002 Krauska et al.
6,396,224 B1 5/2002 Luff et al.
6,401,278 B1 6/2002 Hayes et al.
6,460,205 B1 10/2002 Lewandowski et al.
6,467,111 B1 10/2002 Vrzalik et al.
6,481,688 B1 11/2002 Welling et al.
6,493,568 B1 12/2002 Bell et al.
6,546,577 B1 * 4/2003 Chinn ..... 5/503.1
6,566,833 B2 5/2003 Bartlett et al.
RE38,419 E 2/2004 Auer et al.
6,691,346 B2 2/2004 Osborne et al.
6,704,956 B2 3/2004 Riley et al.
6,761,344 B2 7/2004 Welling et al.
6,781,517 B2 8/2004 Moster et al.
6,791,460 B2 9/2004 Dixon et al.
6,822,571 B2 11/2004 Conway
6,865,775 B2 3/2005 Ganance
6,892,405 B1 5/2005 Dimitriu et al.
6,897,780 B2 5/2005 Ulrich et al.
6,951,034 B2 10/2005 Shiery et al.
6,966,086 B2 * 11/2005 Metz et al. ..... 5/503.1
6,978,500 B2 12/2005 Osborne et al.
7,007,765 B2 3/2006 Waters et al.
7,010,369 B2 3/2006 Borders et al.
7,017,208 B2 3/2006 Weismiller et al.
7,038,588 B2 5/2006 Boone et al.
7,055,195 B2 6/2006 Roussy
7,062,805 B2 6/2006 Hopper et al.
7,100,222 B2 9/2006 Metz et al.
7,127,756 B2 10/2006 Brophy et al.
7,150,056 B2 12/2006 Lemire
7,154,397 B2 12/2006 Zerhusen et al.
7,171,708 B2 2/2007 Osborne et al.
7,200,882 B2 4/2007 Heimbrock
7,216,382 B2 5/2007 Newkirk et al.
7,314,200 B2 * 1/2008 Bally et al. ..... 248/276.1
7,395,564 B2 7/2008 McDaniel et al.
7,624,463 B2 * 12/2009 Graham et al. ..... 5/658
2002/0151990 A1 10/2002 Ulrich et al.
2004/0139545 A1 7/2004 Reinke et al.
2004/0227737 A1 11/2004 Novak et al.
2005/0035871 A1 2/2005 Dixon et al.
2005/0165325 A1 7/2005 Hornig
2005/0166324 A1 8/2005 Dixon et al.
2005/0172405 A1 8/2005 Menkedick et al.
2005/0188462 A1 9/2005 Heimbrock
2006/0031989 A1 * 2/2006 Graham et al. ..... 5/503.1
2006/0053555 A1 3/2006 Poulos et al.
2006/0059624 A1 * 3/2006 Poulos et al. ..... 5/618
2006/0117482 A1 6/2006 Branson
2006/0137092 A1 6/2006 Reinke et al.
2006/0179571 A1 8/2006 Newkirk
2006/0253983 A1 11/2006 Falabrino et al.
2006/0271207 A1 11/2006 Shaw
2006/0277683 A1 12/2006 Lamire et al.
2007/0018058 A1 * 1/2007 Graham et al. ..... 5/503.1
2007/0067912 A1 3/2007 Lemire
2007/0157385 A1 7/2007 Lemire et al.
2007/0163043 A1 7/2007 Lemire et al.
2007/0169268 A1 7/2007 Lemire et al.
2007/0174964 A1 8/2007 Lemire et al.
2008/0040857 A1 * 2/2008 Karmer et al. ..... 5/616
2008/0234555 A1 9/2008 Lafleche et al.
2009/0217460 A1 * 9/2009 Bobey et al. ..... 5/709
2009/0237264 A1 * 9/2009 Bobey et al. ..... 5/713

FOREIGN PATENT DOCUMENTS

JP 7107195 4/1995
JP 11290395 4/1999

* cited by examiner 345
350
370
375
355
360
380
320
385
405
315
325
400
311
310

350
345
370
375
355
360
380
320
385
400
405
310
315
325

296a

260

HOSPITAL BED

FIELD OF THE INVENTION

The present invention relates in general to the field of patient support apparatuses such as hospital beds. In particular, the invention relates to critical care patient support apparatuses with improved safety features, expanded configurability and accessible control and electronics for users.

BACKGROUND OF THE INVENTION

Hospital beds comprise complex mechanical and electronic components for movement, functionality and convenience.

Foot brakes of prior art hospital beds are typically located on the side under the bed. There are certain disadvantages associated with such foot brakes. For example, during activation, a user such as a nurse has to hold on to the bed, balance on one foot and stretch the other foot under the bed to engage or disengage the brake. As such, if the side rail is in the lower position, visibility may be reduced. In addition, if the patient is exiting the bed, the bed may move, which may be unsafe. Furthermore, the weights of present day beds and patients are relatively large, requiring sufficient braking force to hold a bed in a desired location in a hospital.

There is a need for a braking system which is convenient and safe to use. Such a system can be powered in any manner. There is a further need for a braking mechanism that can be manually overridden such as if there is a power failure.

Generally, a bed is moved by a series of internal motors and controlled by means of an interface that can be used by users such as hospital personnel or the patient to adjust the bed to suit the comfort and needs of the patient. For safety reasons, the movement of the bed is quite slow and there is a need for an override control, to quickly and efficiently bring the bed into a relatively flat position in case of emergency or for routine tasks such as cleaning, patient transfer or surgery. In past designs, this override function has been initiated through hand controls, foot controls, or a combination of hand and foot controls. In an emergency situation, it is desirable to reposition a bed quickly and easily into a CPR or Trendelenburg position, to facilitate administration of CPR or other resuscitation efforts. The manual- or motor-driven mechanism utilized to raise and lower the Fowler section typically moves too slowly to be acceptable in an emergency situation. Accordingly, emergency releases have been developed to quickly disengage the Fowler section from the drive mechanism to allow for rapid movement, however, these arrangements can be complex, bulky, expensive and difficult to engage and disengage.

Movement of the foot-end of a hospital bed to various positions that are not aligned with the remainder of the bed, such as a chair position, is difficult when it forms part of the main bed frame For a patient support apparatus in which movement of the Fowler section is effected by a motor-driven mechanism, it would be advantageous to be able to increase the speed at which the Fowler section could be lowered for CPR and Trendelenburg, beyond that speed which is currently obtainable with the motor-driven mechanism powered by a conventional electrical power source.

Early designs of adjustable beds often employed the concept of a hand crank and gearing to adjust the height of a bed. Such manual systems suffer from the need for considerable physical effort to adjust the bed height. Other designs include elevation systems incorporating mechanical jacks using hydraulic piston cylinders or screw drives to adjust the height of the hospital bed. Such hydraulic systems are known to be relatively expensive and prone to leakage. Additionally, prior mechanical systems suffer from excessive complexity, excessive size, a lack of load capacity, and manufacturing difficulties.

Hospital bed side rails of the prior art comprise support arms which form undesirable pinch points for users. The movement of such side rails from the deployed to the stowed positions is often hampered by side rail oscillations. The side rail falls due to gravity and the movement can jar the bed and disturb patients.

In addition, the patient support apparatus of the prior art relies on batteries to provide all power to the bed's electronic systems. When the battery power runs out, the battery itself must be recharged before power can be supplied to the electronics. This is problematic in circumstances where the life of the battery itself has run out or in settings where a suitable power supply to recharge the battery is not available.

In existing apparatuses, the control interface is located on the side or foot-end of a bed. Often, the operator directs movement of the bed from the head-end by pushing on the head-end or push handles located at the head-end. In the event the position of the patient needs to be adjusted while a prior art hospital bed is in motion, the operator has to stop the bed and move around the bed in order to access the bed control interface. If the bed is in a confined space, such as a narrow corridor or elevator, this action may be difficult to execute and result in an undesirable delay in effecting the change in position of the patient.

Currently, the angular position of the patient can be determined by measuring the patient's current position with respect to a plane of reference (e.g., the floor or the bed frame). This technique, however, suffers from the drawback that any misalignment in the frame of reference severely affects the integrity of the sensed angular position. Another method for inclinometry is by way of gravitational accelerometers. When the accelerometer is in a stationary position, the only force acting on it is the vertical gravitational force having a constant acceleration. Accordingly, the angular position of the patient can be calculated by measuring the deviation in the inclination angle between the inclination axis and the vertical gravitational force. Although the accelerometers can provide an effective way to measure the inclination in the patient's position, the resolution of the gravitational accelerometers is restricted to a limited range of inclination angles.

Currently, nurses and other hospital staff hang pumps (or other hospital equipment) on the top edge of the footboards of hospital beds. Since footboards were not designed to support the hanging of pumps (or other hospital equipment), this current practice reduces access to the controls on footboards, damages foot controls and footboards, generates bed motions and causes damage to pumps (and other equipment) that fall from their hangers.

Ordinarily, there is a tendency for detached headboards or footboards placed in an upright position against an object or structure to slip, thereby causing the headboard or footboard to fall and potentially suffer damage. This is a particularly acute concern in the situation of a medical emergency during which headboards and footboards may need to be removed and set aside in haste. In a busy hospital, a discarded headboard or footboard that has fallen to the floor creates a tripping hazard to both staff, who may be carrying equipment or medication and thus have an obstructed view of the floor, and patients, who may have compromised mobility owing to illness. Preventing slippage, therefore, reduces the likelihood of personal injury stemming from hastily removed headboards and footboards.

Existing motorized hospital beds utilize a single speed or multiple defined and preprogrammed speeds for bed movement resulting in the user having to manually switch speeds. Variable speeds in these beds are not automatic.

Therefore, there is a need to provide a patient support apparatus such as a hospital bed which overcomes the problems of the prior art.

SUMMARY OF THE INVENTION

According to an aspect of the invention, a patient support has a base frame, a support frame system supported by the base frame, the support frame system including a deck support, the deck support including a pivotal head section, and a control system, the control system including an actuator to pivot the head section, the control system adapted to control the speed of the actuators and, further, to selectively increase the speed of the actuator to pivot the head section at a greater speed.

According to another aspect, the deck support further includes a pivotal seat section and a pivotal foot section, the control system further includes an actuator to selectively pivot the seat section and an actuator to. selectively pivot the foot section, and the control system is adapted to control the speed of the actuators and, further, to selectively increase the speed of at least one of the actuators to pivot at least one chosen from the head section, the seat section, and the foot section at a greater speed. According to another aspect, the control system increases the voltage to the actuator to increase the speed of the actuator.

According to another aspect, the support frame system includes an intermediate frame and the deck support, the patient support further having an elevation system having a plurality of lift arms supported by the base frame, the support frame system supported by the lift arms, and a plurality of wheels for moving the base frame across a surface, the intermediate frame having a longitudinal extent shorter than the deck support so that the intermediate frame longitudinal extent terminates adjacent the foot section such that the foot section is pivotal relative to the seat section independent of the movement of the seat section. According to another aspect, the head section is pivotal relative to the seat section independent of the respective movements of the seat section and the foot section. According to another aspect, the control system includes a plurality of actuators for selectively pivoting the head section, the seat section, or the foot section independent of the other sections. According to another aspect, the foot section has a foot-end and a head-end and the support frame system includes an intermediate frame, the, intermediate frame having a foot-end that terminates proximate the head-end of the foot section, and the foot-end of the intermediate frame comprises longitudinal members. The foot section may be pivotable to be at least partially between the longitudinal members of the intermediate frame.

According to another aspect, the control system includes a user interface, the control system selectively increasing the speed of the actuator to pivot the head section at a greater speed. when the user interface is actuated. The user interface may be a button, a touch pad, a touch screen, a handle or pedal. Where the user interface comprises a touch screen, the touch screen may have an icon associated with the actuator, such that when the icon on the touch screen is touched the speed of the actuator is varied.

According to another aspect, the control system is adapted to couple to an external power supply, the external power supply having a voltage, and the control system converting the voltage supplied by the external power supply to deliver a first voltage to the actuator and converting the voltage of the external power supply to a second voltage to deliver a second voltage to the actuator wherein the second voltage is greater than the first voltage to increase the speed of the actuator and thereby increase the speed of the movement of the head section. The control system may deliver about 12 volts to the actuator and selectively increase the voltage to the actuator from about 12 volts to about 24 volts to increase the speed of the head section. According to another aspect, the control system may increase the voltage until the head section is moved to a substantially horizontal position. According to another aspect, the control system may increase the voltage to the actuators to thereby increase the speed of the actuators until the head section, the seat section, and the foot section have moved to a substantially horizontal position. According to another aspect, wherein the control system further comprises a sensor, the sensor detecting when the head section is moved to the substantially horizontal position.

According to another aspect, a patient bed includes a base frame, a support frame system for supporting a lying surface relative to the base frame, and an elevation mechanism comprising a first pair of lift arms and a second pair of lift arms, the pairs of arms mounted relative to the support frame system and the base frame, each of the arms having an upper arm portion and a lower arm portion, the upper arm portions pivotally mounted to the lower arm portions and to the frame system, the lower arm portions pivotally mounted to the base frame, the upper arm portions being selectively urged upwardly relative to the lower arm portions by pivoting the upper arm portions relative to the lower arm portions. The elevation system may further include a linear actuator cooperating with each pair of the arms, the linear actuators adapted to selectively pivot the lower arm portions relative to the base frame, the lower arm portions being connected to the upper arm portions by force transfer devices, the force transfer devices configured to pivot the upper arm portions relative to the lower arm portions when the lower arm portions pivot relative to the base frame such that the actuator pivots the lower arm portions causing the force transfer devices to pivot the upper arm portions to thereby raise or lower the support frame system relative to the base frame.

According to another aspect, the force transfer devices each include a stationary gear, a rotatable gear, a lower pivot of the lower arm portion, an upper pivot of the lower arm portion corresponding to a lower pivot of the upper arm portion, and a connecting member, wherein the stationary gear is mounted adjacent the lower pivot of the lower arm portion at the base frame, the rotatable gear is mounted adjacent the lower pivot of the upper arm portion corresponding to the upper pivot of the lower arm portion, and the connecting member engages the stationary gear and the rotatable gear, the rotatable gear being fixed relative to the upper arm portion and the rotatable gear being rotatable relative to the lower arm portion. The rotatable gear may be smaller than the stationary gear, such as about one half the size of the stationary gear. The connecting member may, for example, be a chain, a cable, a strap, a gear,: a rigid member, or the like. The first pair of lift arms and the second pair of lift arms may be separated by a distance less than the width of the patient bed.

According to another aspect, the force transfer devices each have upper and lower lift arms, each lift arm having upper and lower portions, each portion having upper and lower pivots, each transfer device having a lower rotatable gear, a lower stationary gear, an upper rotatable gear, a first connecting member engaging the lower rotatable gear and the upper rotatable gear, and a second connecting member adapted to engage the lower stationary gear and the upper rotatable gear. An actuator causes the lower rotatable gear to move the first connecting member, the first connecting member causes the upper rotatable gear to rotate, the upper rotatable gear, simultaneously causing the upper arm to pivot upwardly about the lower pivot of the upper arm portion and causing the second connecting member to transmit a pivoting force to the lower arm portion, thus pivotably raising the lower arm portion. According to another aspect, the upper rotatable gear comprises a first gear and a second gear, the first gear concentric with the second gear, and the first gear fixed to the second gear. The first gear engages the first connecting member and the second gear engages the second connecting member. To effect a gear reduction system, the lower rotatable gear may be smaller than the first gear of the upper rotatable gear, and the second gear of the upper rotatable gear may be smaller than the lower stationary gear.

According to another aspect, the force transfer devices each have upper and lower lift arms, each lift arm having upper and lower portions, each portion having upper and lower pivots, each transfer device having a lower rotatable gear, an upper rotatable gear, an upper stationary gear, a first connecting member engaging the lower rotatable gear and the .upper rotatable gear, and a second connecting member engaging the upper rotatable gear and the upper stationary gear. An actuator causes the lower rotatable gear to move the first connecting member, the first connecting member causes the upper rotatable gear to rotate, the upper rotatable gear simultaneously causing the upper arm to pivot upwardly about the lower pivot of the upper arm portion and causing the second connecting member to transmit a pivoting force to the upper arm portion, thus pivotably raising the upper arm portion. According to another aspect, the upper rotatable gear comprises a first gear and a second gear, the first gear engaging the first connecting member and the second gear engaging the second connecting member. To effect a gear reduction system, the lower rotatable gear may be smaller than the first gear of the upper rotatable gear and the second gear of the upper rotatable gear may be smaller than the upper stationary gear.

According to another aspect, the support frame system is located between two vertical generally parallel planes when the support frame system is lowered to the base frame, and wherein the elevation mechanism moves the support frame system relative to the base frame and is configured to generally maintain the support frame system between the two vertical planes when moving the support frame system.

According to another aspect, a patient bed includes a base frame, a support frame system for supporting a lying surface on the base frame, an elevation mechanism for raising or lowering the support frame system relative to the base frame, and a control system, the control system activating the linear actuators of the elevation mechanism to raise or lower the support frame system relative to the base frame, the control system being powered by (1) an external power supply or (2) at least one battery, when powered by the external power supply the control system operating the actuator independent of the battery. The control system may be powered by the battery during a power loss from the external power supply. The control system may recharge the battery with the external power supply.

According to another aspect, a patient bed includes a patient support, a base frame, the patient support mounted relative to the base frame, the base frame having a plurality of wheels for moving the base frame and the patient support across a surface, each of the wheels including a brake, and an electrical control system, the electrical control system having a user interface and being configured to actuate one or more of the brakes upon actuation of the user interface. The control system may include one or more actuators, the actuators capable of selectively actuating the brakes. The brake may include, for example, at least one cam adapted to push on at least one of the wheels upon actuation of the brake, or the brake may include a cam that pushes on, for example a disk, a drum, or a floor surface. According to another aspect, the wheels include forward wheels and rearward wheels, one of the actuators being operatively associated with the forward wheels and another of the actuators being operatively associated with the rearward wheels. According to another aspect, the user interface may include a button or a touch screen, and the patient support may include a support frame system, the user interface located at the support frame system.

According to another aspect, the patient bed further includes a central levering mechanism, a lateral shaft, and a brake shaft, where the actuator is operatively associated with the central levering mechanism to selectively rotate the central levering mechanism, the central levering mechanism being coupled to the lateral shaft to rotate the lateral shaft, and the lateral shaft operatively associated with the brake shaft, the brake shaft adapted to position the brakes in a braking, a steering, or a neutral position. The patient bed may further include a driven member and a lateral levering mechanism coupled to the lateral shaft opposite the central levering mechanism, the actuator adapted to rotatably drive the central levering mechanism via the driven member and the lateral levering mechanism adapted to rotate with the lateral shaft and urge the brake shaft in a longitudinal direction.

According to another aspect, the patient bed further includes a manual brake device. The manual brake device may include a pedal or handle, a lateral levering mechanism, and a brake shaft, wherein the pedal or handle is connected to the lateral levering mechanism, the pedal or handle being manually positionable to urge the brake shaft in a longitudinal direction, the brake shaft adapted to position the brakes in a braking, a steering, or a neutral position. According to another aspect, the manual brake device is adapted to provide a manual override function. To provide manual override, the manual brake device may include the lateral shaft and the central levering mechanism, the central levering mechanism comprising a release device adapted to selectively at least partially decouple the lateral shaft from the central levering mechanism, wherein the pedal or handle is manually moved to urge the lateral shaft away from the central levering mechanism to at least partially decouple the central levering mechanism from the lateral shaft so that the lateral shaft is freely rotatable relative to the central levering mechanism. The pedal or handle is positionable to urge the brake shaft in a longitudinal direction when the central levering mechanism is at least partially decoupled from the lateral shaft, and the brake shaft is adapted to position the brakes in a braking, a steering, or a neutral position. According to another aspect, a visual brake status indicator may be included on the patient bed to indicate manual brake device status as one chosen from braking, steering, or neutral.

According to another aspect, a patient bed has a base frame, a patient support, the patient support being movable relative to the base frame, and an elevation mechanism for raising or lowering the patient support relative to the base frame, the elevation mechanism being configured to move the patient support relative to the base frame in a manner to generally maintain the patient support between two vertical parallel planes when moving the patient support relative to the base frame, the parallel planes substantially aligned with a head-end and a foot-end of the patient bed, the elevation mechanism adapted to move the patient support relative to the base frame, and the elevation mechanism also adapted to independently move the head-end and the foot-end of the patient bed relative to one another.

According to another aspect, a patient bed has a base frame, a support frame system for supporting a lying surface relative to the base frame, and an angle sensor mounted to a component of the base frame or the support frame system, the angle sensor measuring an angle of the component based on a frame of reference such that the angle sensor may detect the angular orientation of the component relative to the frame of reference. Alternatively, the angle sensor measures an angle of the component based on gravity wherein the angle sensor may detect the angular orientation of the component independent of any frame of reference. The angle sensor may, for example, be a gravitation accelerometer. According to another aspect, the support frame system includes a deck support, the deck support including head section and a foot section, the sensor being located at the head section or the foot section. According to another aspect, the patient bed further includes a microcontroller, the microcontroller in communication with the sensor.

According to another aspect, an patient bed includes a base frame, a support frame system supported relative to the base frame, the support frame system including a deck support, the deck support including a head section, a seat section, and a foot section, the support frame system further including side rails, a footboard, and a headboard, and a display mounted to the headboard or the footboard or one of the side rails, the display comprising a touch screen. The touch screen may include a menu, the menu including a plurality of icons. According to another aspect, the patient bed further includes a control system with a graphical user interface for displaying icons on the touch screen. The touch screen may display a function selected from a group consisting of apparatus motion, mattress air pressure, patient motion, patient biometrics, scale, bed security, alerts, exit and event log/history, help screens, diagnostics, lights, doors, windows, and motion sensors. According to another aspect, the touch screen displays a summary of the patient's status supported upon the patient bed. The touch screen may be located, for example, in the footboard, or the touch screen may be mounted in a console, the console being mounted at the footboard. The console may be pivotally mounted in the footboard.

According to another aspect, a patient bed includes a base frame, a patient support mounted relative to the base frame, a bed communication network, and a control system, the control system including a control module located at the bed, the control module being in communication with the bed communication network, the control module being in communication with one or more devices at the bed through the bed network for monitoring or controlling the device. The device may include a sensor such that the control module monitors the status of the bed through the sensor. According to another aspect, the device comprises a patient monitoring device such that the control module monitors the status of the patient through the device. According to another aspect, the bed network comprises a serial communication network or a CAN-based network. Alternatively, the bed network may be a wireless network. According to another aspect, the control module is configured to communicate with a remote communication system.

According to another aspect, a patient bed includes a patient support, the patient support including a support system frame and a side rail, the side rail being movable between a raised position and a lowered position, a base frame, the patient support mounted relative to the base frame, the base frame having two or more wheels for moving the base frame and the patient support across a surface, each of the wheels including a brake, an elevation mechanism selectively raising or lower the patient support relative to the base frame, and a control system controlling the elevation mechanism. According to another aspect, the patient bed further includes a power supply and a detection system, the detection system in communication with the control system and being adapted to sense the status of the elevation system, the power supply, the position of the side rail, the brakes of the wheels, or the control system, the detection system being in communication with a display, and the display displaying the status detected by the detection system. The detection system may include at least one sensor sensing the status of the elevation system, the power supply, the position of the side rail, or the brakes of the wheels.

According to another aspect, a patient bed includes a support frame system, the support frame system including an intermediate frame and a deck support, the deck support including a head section, a seat section, and a foot section, at least one of the sections having at least one movable side pullout extension adapted to selectively widen or narrow the top surface area of the deck support. The head section may be pivotally connected to the seat section and the foot section may be pivotally connected to the seat section opposite the head section. According to another aspect, the foot section comprises a movable end pullout extension, the end pullout extension adapted to selectively lengthen or shorten the top surface area of the deck support. According to another aspect, at least one among the head section, the seat section, or the foot section includes one or two side pullout extensions, each of the side pullout extensions located at an opposite side of a respective section, the side pullout extensions adapted to extend a distance out from a respective side of a respective section and to retract at least partially into the respective section.

According to another aspect, a patient bed includes a support frame system, the support frame system adapted to receive a removable headboard or a removable footboard, wherein lower ends of the headboard and/or footboard are capped or plugged with a cap or plug made of high-friction material such that the headboard and/or footboard are unlikely to slip, as when placed on a floor and leaning against a wall.

According to another aspect, a patient bed having a base frame, a support frame system for supporting a lying surface on the base frame, wheels for moving the base frame across a surface, a motor to selectively move the base frame across a support surface, a handle mounted to the bed, and a control system for adjusting the speed of the motor as a function of an actuating input at the handle. According to another aspect, the control system adjusts the speed of the motor based on a force applied to the handle. Alternatively, the control system adjusts the speed of the motor by comparing a drive signal of the motor with the force applied on the handle.

According to another aspect, a patient bed has a base frame, a support frame system supported relative to the base frame and having a perimeter, and an articulating support arm, the support arm adapted to mount to the support frame system, the support arm being positionable at a plurality of locations around the perimeter of the support frame system.

According to another aspect, a patient bed has a base frame, a support frame system supported relative to the base frame, a headboard having at least one leg, a footboard having at least one leg, and covers. The support frame system is adapted to receive the legs of the footboard and/or the headboard, and the legs are adapted to receive the covers.

The legs may have a hollow tubular shape with open ends, the covers comprising plugs that are adapted to fit at least partially inside the legs and to cover the open ends of the legs. Alternatively, the covers may be caps adapted to fit over the ends of the legs. The covers may be made of a non-slip material, such as rubber.

These and other objects, advantages, purposes and features of the present invention will become apparent upon review of the following specification in conjunction with the drawings.

BRIEF DESCRIPTION OF DRAWINGS

The detailed description particularly refers to the accompanying figures in which:

FIG. 38A is an exploded perspective view; FIG. 38A is an exploded perspective view.

DETAILED DESCRIPTION OF THE INVENTION

The patient support apparatus of the present invention comprises structural elements, power and control systems; structural informatics systems; user-bed communication interfaces; and bed-network communications systems. Unless defined otherwise, all technical and scientific terms used herein have the same meaning as commonly understood by one of ordinary skill in the art to which this invention belongs.

Structural Elements

Figure 1:
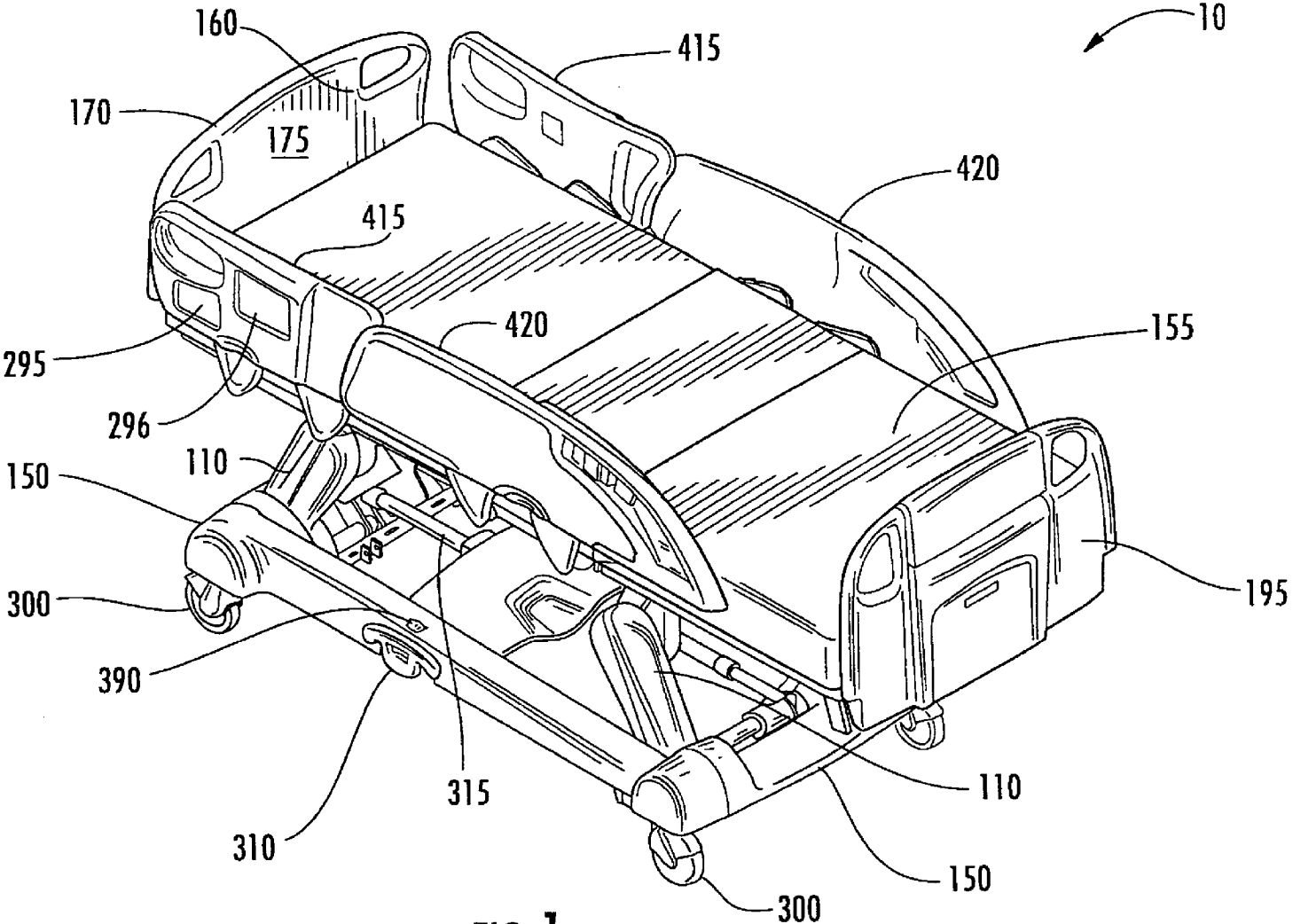
FIG. 1 is a right perspective view of an embodiment of the patient support apparatus 10.

A patient support apparatus 10 according to the present disclosure is shown in FIG. 1. Patient support apparatus 10 includes a mattress or lying surface 155 upon which the patient is positioned, a frame system that supports the lying surface or other mattress 155, a pair of head-end side rails 415, a pair of foot-end side rails 420, a headboard 160, and a footboard 195. The frame system includes a deck support 20 supported by an intermediate frame 90, which is supported by an elevation system comprising lift arms 110, 111 configured to raise and lower the intermediate frame 90. Lift arms 110, 111 are supported by a base frame 150 that is supported by a plurality of wheels such as caster wheels 300 or caster devices (FIG. 5) that are supported by a floor surface. The deck support 20 comprises a head or Fowler section 25 pivotably coupled to a seat/thigh or Knee Gatch section 60, and a foot section 75 pivotably coupled to the seat section 60, each configured to articulate between a plurality of positions.

Figure 24:
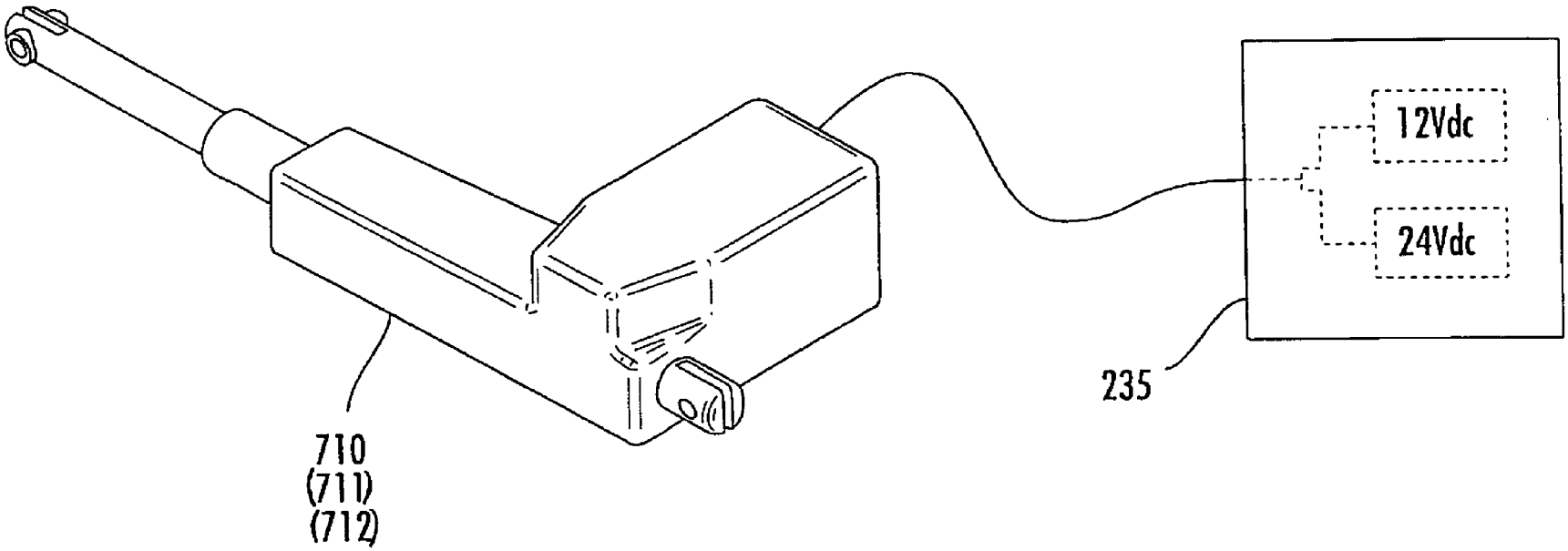
FIG. 24 is a perspective view of the emergency release actuator to facilitate administration of CPR and Trendelenburg positions, the actuator schematically depicted as being connected to an alternate energy source.
Figure 25:
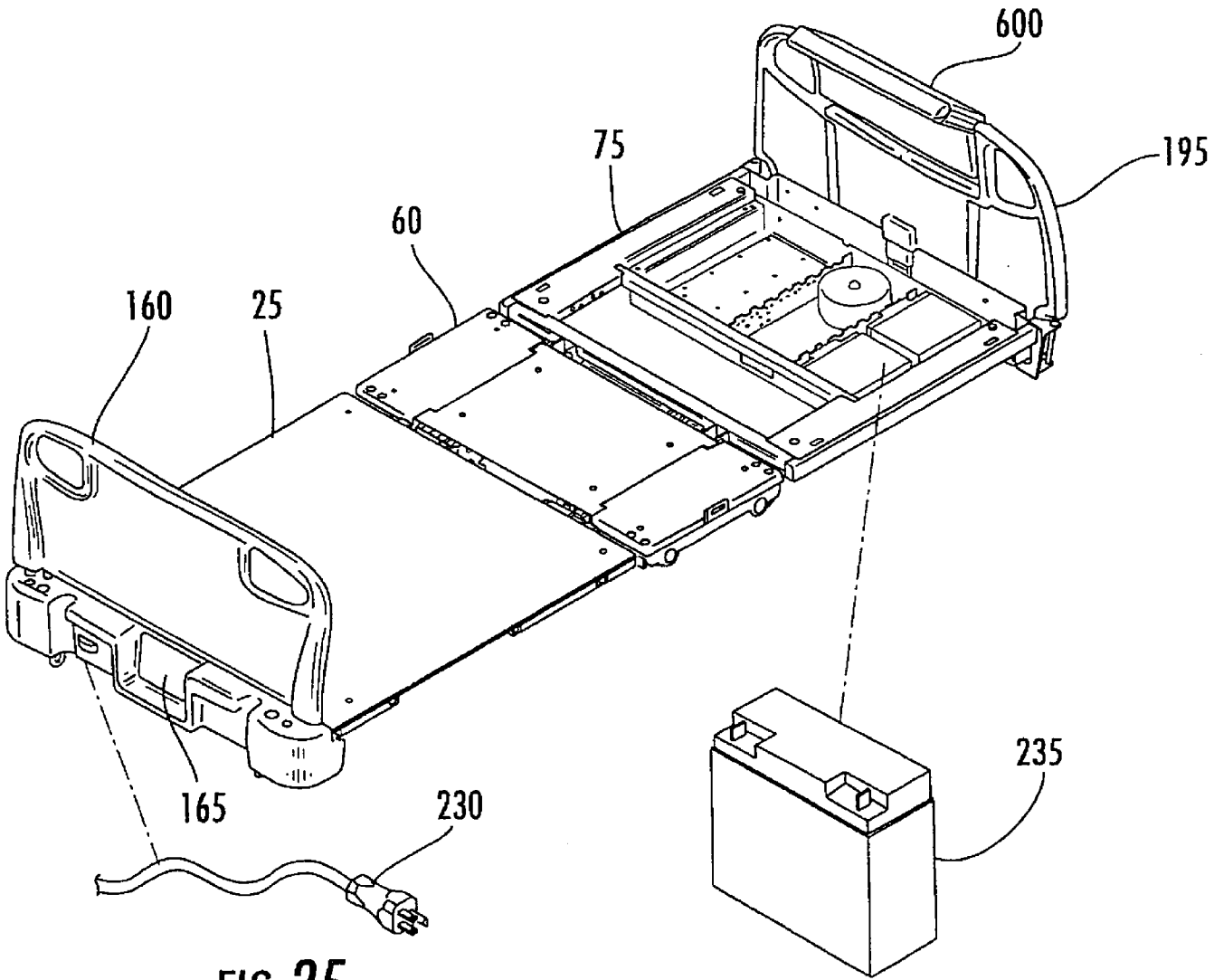
FIG. 25 depicts alternative means to provide power to the patient support apparatus' electronic components with an external source or internal battery.

A control system is provided to control various functions of patient support. The control system and the remainder of patient support apparatus 10 are powered by an AC plug 230 connected to a building outlet, or an on-board battery 235 (FIGS. 24 and 25).

The control system operates and monitors a plurality of actuators such as linear actuators provided to move the intermediate frame 90 relative to the base frame 150, to move the head section 25 relative to the intermediate frame 90, to move the seat section 60 relative to the intermediate frame 90, and to move the foot section 75 relative to the seat section 60 (FIG. 5).

A diagnostic and control system for a bed may also be provided, wherein the bed comprises a plurality of electronic elements including, for example, load sensors, tilt or angular sensors, linear sensors, temperature sensors, electronic controls and keyboards, wiring actuators for adjusting bed angles and the like, in addition to other electronic elements. The diagnostic and control system can enable the specific control of each of these electronic elements for desired operation thereof and further can enable the monitoring of the operating conditions of these electronic elements and additional bed conditions. The diagnostic and control system further enables the evaluation and determination of the existence of one or more faults relating to the operation of the bed.

The Lying Surface

A patient is supported on a lying surface, which can be referred to as a mattress, a support surface, a lying surface, a patient surface, etc. (FIGS. 1, 2, 4A, and 4C). For the purpose of this invention, these terms are used interchangeably to indicate the article upon which the patient lies, which is generally cushioned for patient comfort. The article may be cushioned with foam, air, springs, etc. In one embodiment of this invention, the lying surface is a mattress, such as found in a hospital setting. For ease of discussion, the term "mattress" is used throughout, although another type of article defining a lying surface may be used.

The Frame System

As previously mentioned and as shown in FIGS. 1-5, a mattress 155 is supported by the deck support 20, which is supported by the intermediate frame 90, which is supported by an elevation system comprising lift arms 110, 111 configured to raise and lower the intermediate frame 90, the lift arms being supported by a base frame 150 supported on the floor by a plurality of caster wheels 300 or caster devices. Linear actuators 575 provide power to actuate the lift arms 110, 111 and in turn to raise and lower the intermediate frame 90 relative to the base frame 150.

Figure 7A:
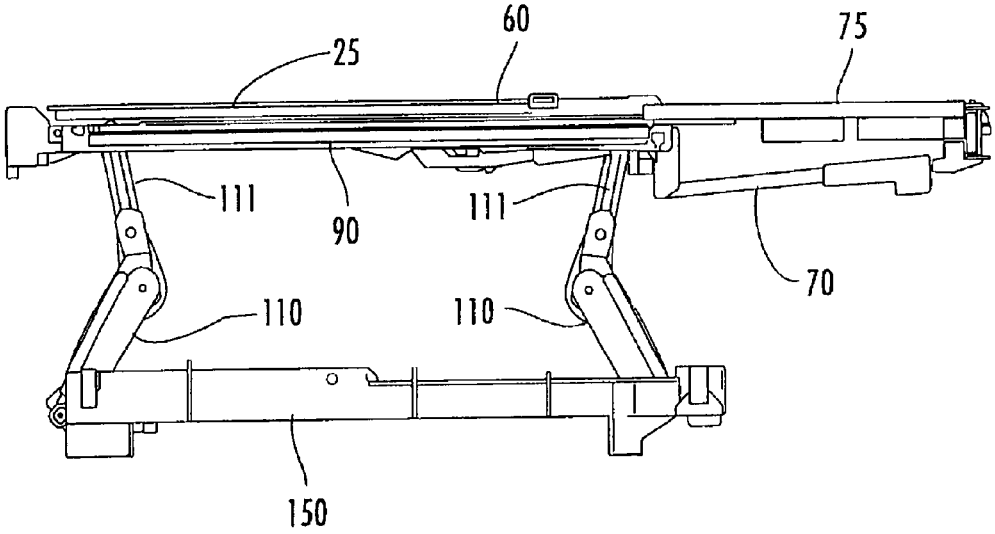
FIG. 7A depicts the apparatus in the flat position.
Figure 7B:
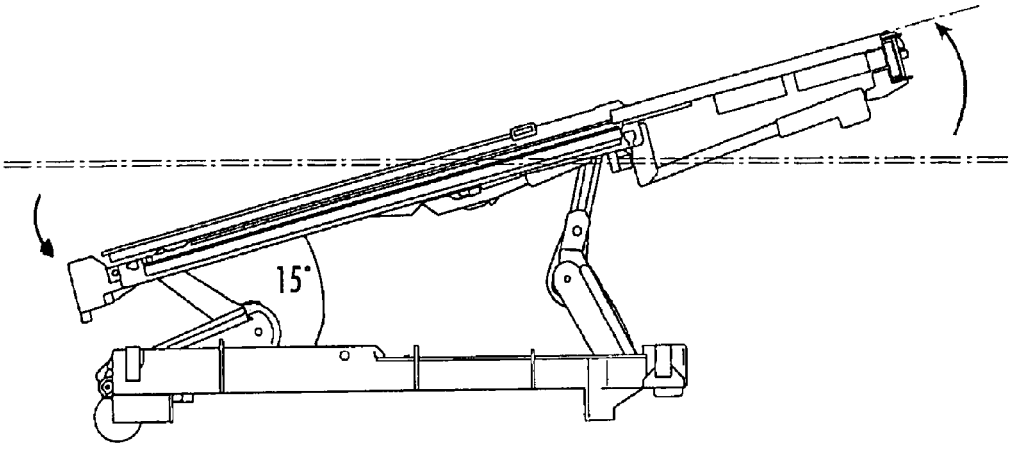
FIG. 7B depicts the apparatus in the Trendelenburg position.
Figure 7C:
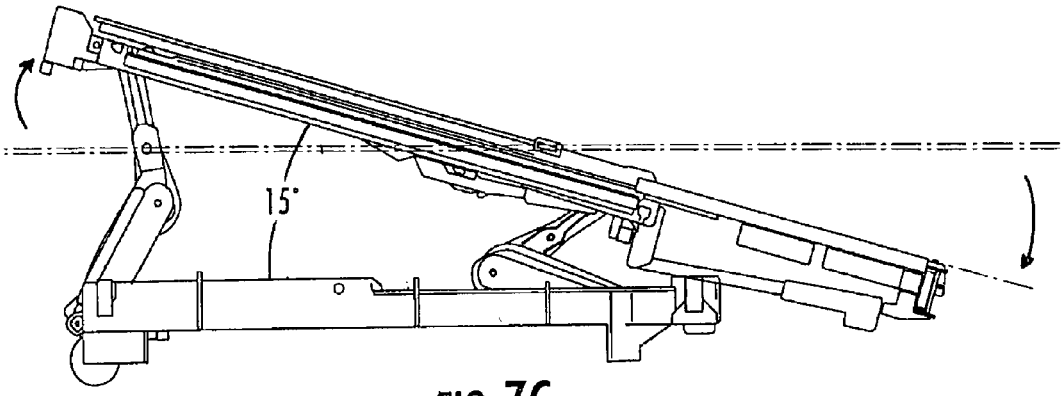
FIG. 7C depicts the apparatus in the Reverse Trendelenburg position.

As explained in more detail below, lift arms 110, 111 and linear actuators 575 are configured to position deck support 20 in at least the following positions: a raised or upper position wherein intermediate frame 90 is above base frame 150 (FIG. 7A); a Trendelenburg position wherein a head-end of intermediate frame 90 is lower than a foot-end of intermediate frame 90 (FIG. 7B); and a Reverse Trendelenburg position wherein foot-end of intermediate frame 90 is lower than head-end of intermediate frame 90 (FIGS. 7C). One skilled in the art will appreciate that the positions shown in FIGS. 7A-C are exemplary positions and that the intermediate frame 90 is positionable in a wide variety of positions relative to the base frame 150.

Often it may be required to configure the mattress 155 of the patient support apparatus 10 in a configuration that is tailored to assist a caregiver in providing CPR to the patient supported on a patient support apparatus 10. In one illustrative example, a CPR configuration is defined by placing the head section 25, seat section 60, and foot section 75 of the deck support 20 in a generally linear relationship (FIGS. 1-3, 5A, and 7A). The patient support apparatus 10 may be placed in the preferred CPR configuration by providing an indication to the control system which in turn controls the linear actuators.

As stated previously, the patient support apparatus 10 is positionable in a plurality of positions. Referring to FIGS. 1-3, 5A, and 7A, the head section 25, seat section 60 and foot section 75 are in a linear relationship relative to each other. In one illustrative embodiment, the head section 25, seat section 60, and foot section 75 are placed in the linear relationship by the control system in response to a single button being depressed on one of the controllers.

Figure 5B:
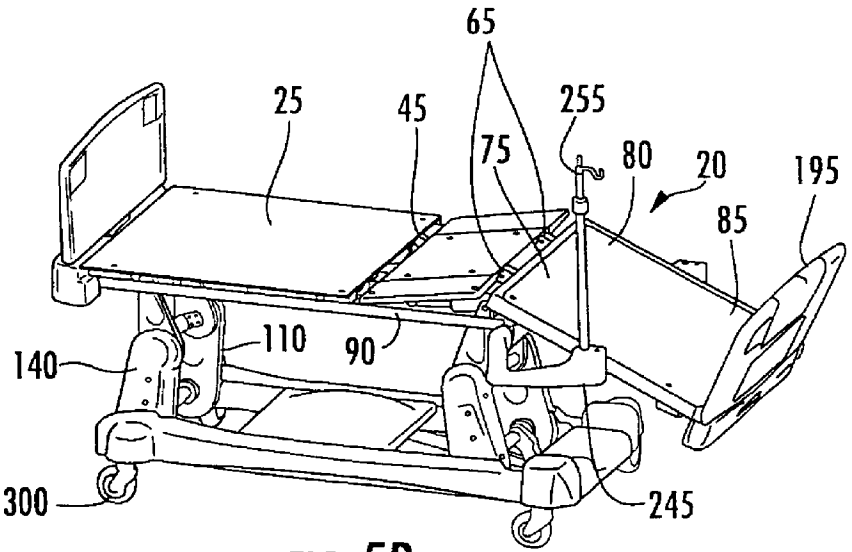
FIG. 5B is a side perspective views of the patient support apparatus 10 depicting the open foot section 75 in a partial chair position, wherein the Fowler, Knee Gatch and Foot sections 25, 60, 75 are positioned at 0, 10 and 25 degrees, respectively.
Figure 5A:
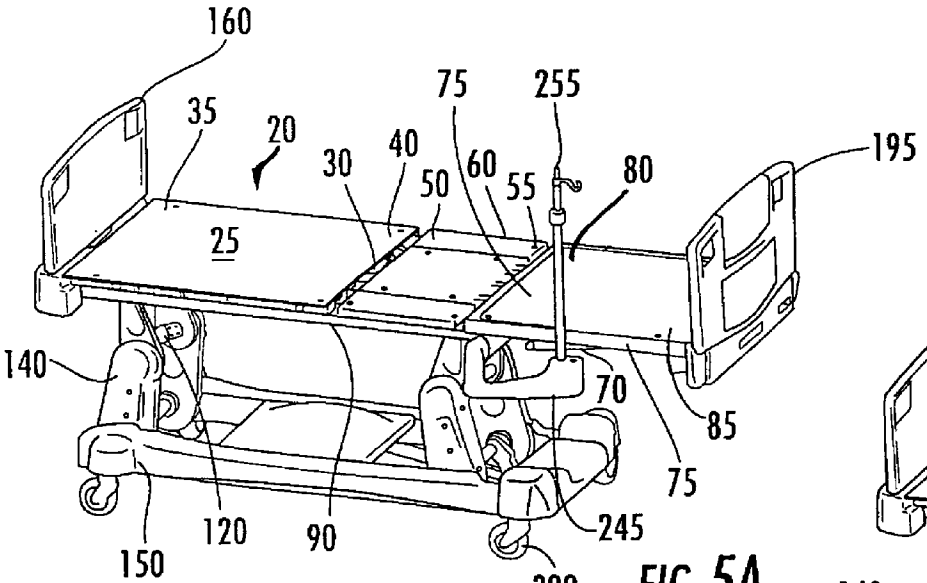
FIG. 5A is a side perspective views of the patient support apparatus 10 depicting the open foot section 75 in the flat position, wherein the Fowler, Knee Gatch and Foot sections 25, 60, 75 are each at 0 degrees.

The head section 25 can be rotated about pivot 30 such that first end 35 is raised relative to second end 40 (FIG. 5A). First end 35 is raised by the control system controlling an actuator (not shown) to extend the cylinder of the actuator. In one illustrative embodiment, the head section 25 is raised by the control system in response a first button being depressed on one of the controllers and lowered by the control system in response to a second button being depressed on the same controller.

Figure 5C:
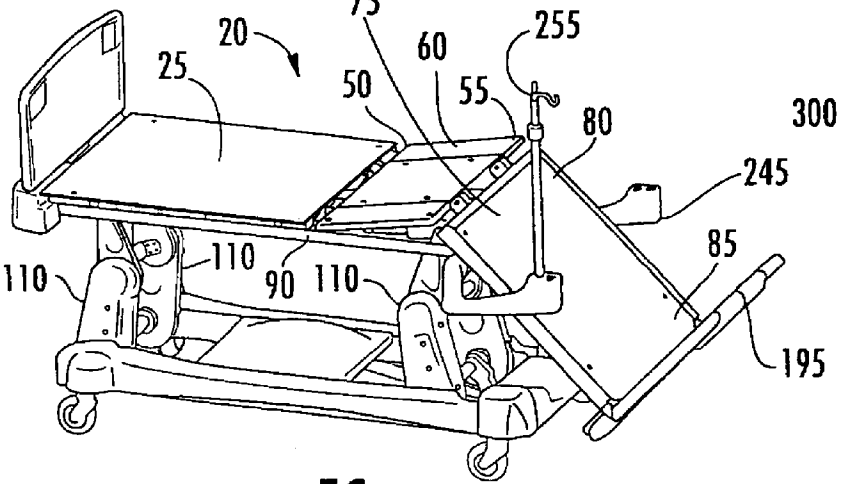
FIG. 5C is a side perspective views of the patient support apparatus 10 depicting the open foot section 75 in a partial chair position, wherein the Fowler, Knee Gatch and Foot sections 25, 60, 75 are positioned at 0, 10 and 45 degrees, respectively.

In addition, as shown in FIGS. 5B-C, the seat section 60 can be rotated about pivot 45 such that its second end 55 is raised relative to its first end 50. The seat section's second end 55 is raised by the control system controlling an actuator (not shown) to further extend the cylinder of the actuator. In one illustrative embodiment, the seat section 60 is raised by the control system in response to a first button being depressed and lowered by the control system in response to a second button being depressed on the same controller.

The Deck Support

The patient support apparatus 10 includes a base frame 150 to which the wheels 300 are connected, and an intermediate frame 90 located between the base frame 150 and the deck support 20. The intermediate frame 90 supports a deck support 20, which can be articulated to desired configurations of the mattress 155. In one embodiment, the base frame 150 and the intermediate frame 90 are configured to be shorter than prior art patient supports in order to provide the desired functionality for the foot frame or foot section 75.

The foot-end of the patient support apparatus 10 is designed to allow the foot section 75 to be lowered below the level of the intermediate frame 90 (FIGS. 5B and 5C). This is accomplished by means of a shortened intermediate frame 90 section, from which the foot section 75 is cantilevered or otherwise supported beyond the end of the intermediate frame 90. As depicted in FIGS. SA-C, the foot section 75 extends past the intermediate frame 90 so that it can be lowered without coming into contact with the base frame 150. Additionally, and to facilitate lowering the foot section 75 below the level of the intermediate frame 90, the intermediate frame 90 is preferably open-ended such that there is no lateral cross-member at the foot-end of the intermediate frame 90, thus allowing at least a portion of the foot section 75 to be lowered between longitudinal members of intermediate frame 90 proximate the frame's foot-end.

One or more accessory supports, such as articulated support arms 245, may extend from the intermediate frame 90 to support or mount IV poles 255, controller pendants 260 or other accessories, as depicted in FIGS. 4 and 5. In the illustrated embodiments, the accessory supports 245 extend laterally from and along the length of the intermediate frame 90 towards the foot-end. Such accessory supports 245 may be isolated from movement of the support deck and from the weight measurement system, described herein.

As shown in FIG. 5A, the first end 80 of the foot section 75 is adjacent the second end of the intermediate frame 90. The foot section 75 may extend beyond the base frame 150. The deck support 20 has three sections, head or Fowler 25, seat or Knee Gatch 60, and foot 75. The head and seat sections 25, 60 are located above the intermediate frame 90. In the flat position, the intermediate frame 90 and the foot section 75 provide a flat support surface. The foot section 75 is coupled to the intermediate frame 90 with a coupling device 70, which allows the foot frame to articulate along pivot 65.

In FIG. 5B, the second end 55 of the seat section 60 is raised by about 10 degrees from the intermediate frame 90 about pivot 45 and the second end 85 of the foot section is lowered by about 25 degrees about pivot 65. As depicted, there are no barriers blocking the foot section 75. Its second end 85 can lower past the level of the intermediate frame 90, while the intermediate frame 90 remains substantially horizontal.

In FIG. 5C, the seat section 60 remains at 10 degrees from horizontal and the foot section is lowered to about 45 degrees. While the seat and foot sections 60, 75 are articulated as shown in FIGS. 5B-C, the illustrated accessory supports 245 remain substantially stationary.

As will be appreciated, the elevation system functions in conjunction with the foot section 75 so that the controller will only lower the foot section 75 if there is adequate height from the floor surface. The controller function is discussed in detail below.

The foot section 75 and deck support 20 configuration may provide the ability to adjust the bed into a chair configuration, or otherwise position the patient's legs lower than the rest of the body. It also allows the foot section 75 to be lengthened or shortened, without the need to adjust or replace the intermediate frame 90, as will be discussed in more detail below. The support can thus be customized for various patient heights by adjusting the length of the foot section 75. This may allow greater flexibility and adjustability of support positions than previously achievable.

Such an open foot section 75 may be useful in situations such as hospital environments, where it can alleviate the need to transfer patients from a bed to a chair and back for procedures which require upright positioning, or for allowing patients to sit up more comfortably for social or other personal purposes without requiring a chair transfer. In addition, certain medical positions may require the patient to have his or her legs placed lower than the rest of the body. The foot section 75 allows the patient to alternate positions from a chair-type configuration to the flat position offered by conventional adjustable beds or any intermediary position. For use in residential applications, those who prefer to use adjustable beds benefit from the additional adjustability and greater range of positions of a support comprising the foot section 75 as compared to conventional adjustable beds.

To accommodate various patients of differing heights and weights, the head section 25, the seat section 60, and the foot section 75 may optionally be extendable and retractable to change the width and/or length of the deck support 20, and therefore changing the surface area of the deck support 20 (FIGS. 34-37). Each section 25, 60, 75 may have a side pullout extension (25*a*, 25*b*, 60*a*, 60*b*, 75*a*, 75*b*) at one or both sides of each respective section 25, 60, 75 to change the deck support width, and as noted above, foot section 75 may further have an end pullout extension 75*c* to change the overall length deck support 20.

Figure 35:
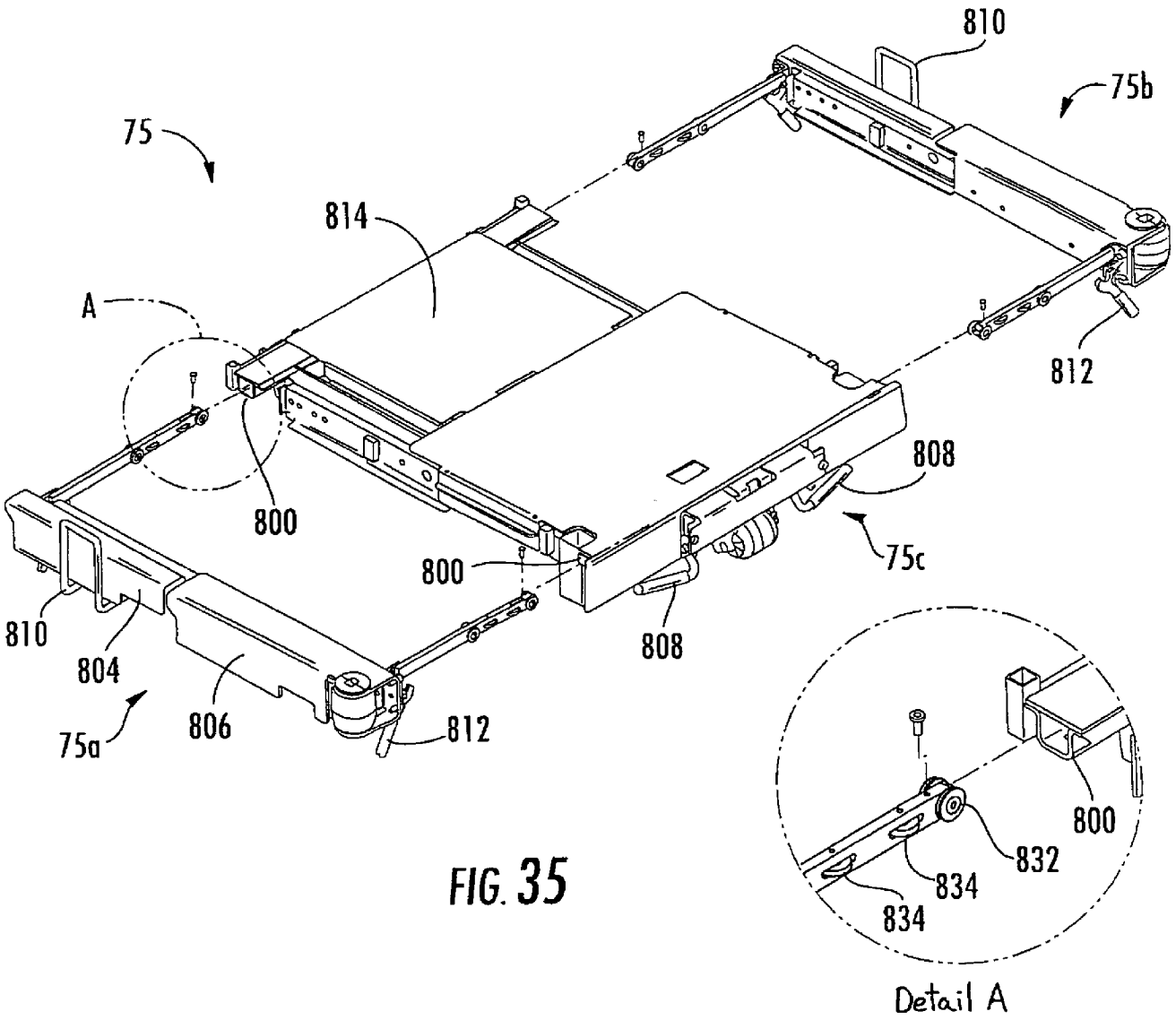
FIG. 35 is an exploded perspective view of the foot section of the expandable deck support of FIG. 34.

As illustrated in FIG. 35, foot section 75 may have width-extension tracks 800, width-extension arms 802, length-extension tracks 804, length extension arms 806, end pull handles 808, side pull handles 810, latches 812, at least one length-extension platform 814, and width-extension platforms (not shown). Tracks 800, 804 receive respective arms 802, 806, the arms being movable relative to the tracks such as by grasping handles 808, 810 and pulling or pushing to move side pullout extensions 75*a*, 75*b* and end pullout extension 75*c* to desired positions. Latches 812 may be provided to retain side pullout extensions 75*a*, 75*b* in their respective retracted positions until a user releases latches 812 prior to extending side pullout extensions 75*a*, 75*b*. Similarly, latches (not shown) may be provided to retain end pullout extension in its retracted position. Extension platforms, such as the length-extension platform 814 may be connected to top surfaces of tracks 800, 804 to provide patient support between the various extension components.

Figure 36:
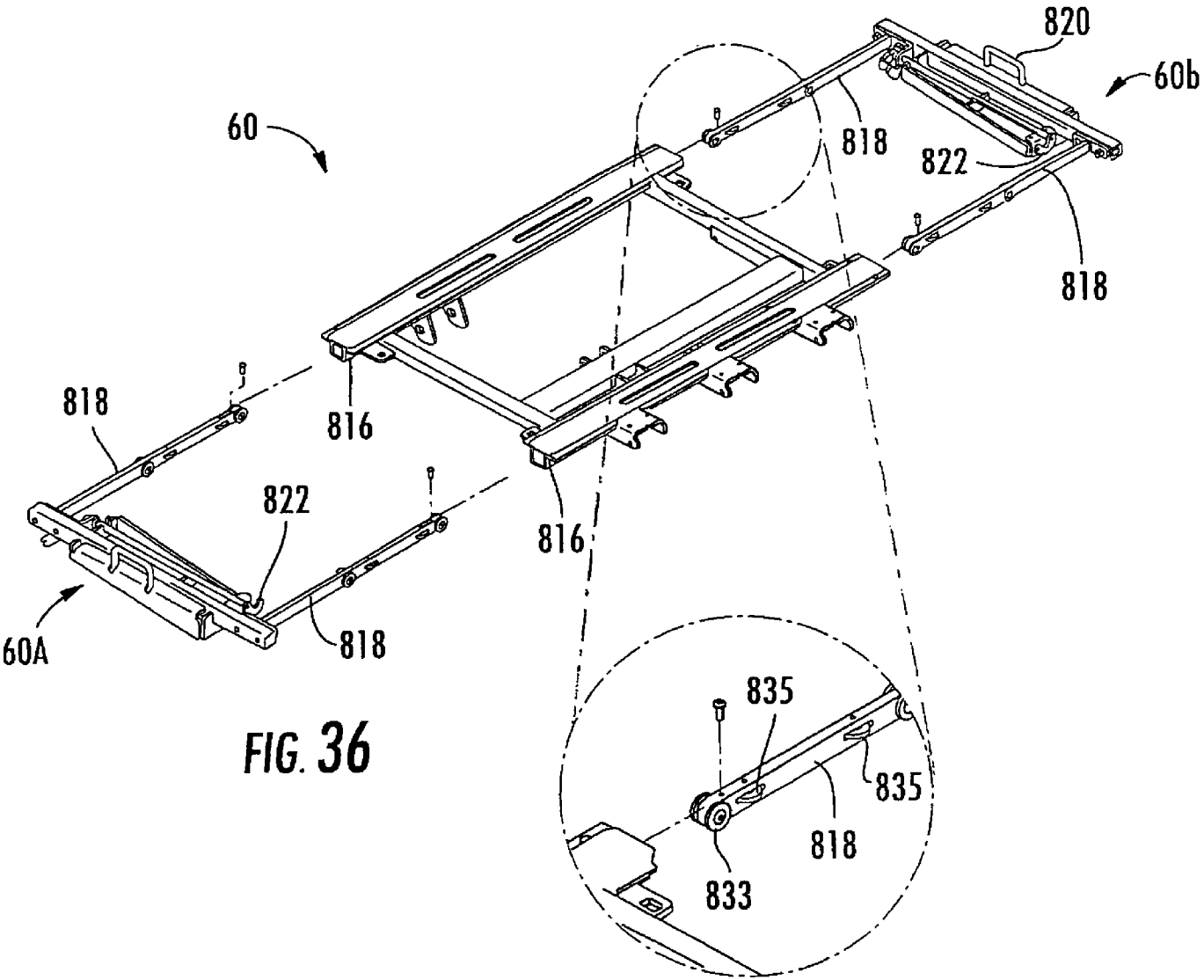
FIG. 36 is an exploded perspective view of the seat section of the expandable deck support of FIG. 34.
Figure 37:
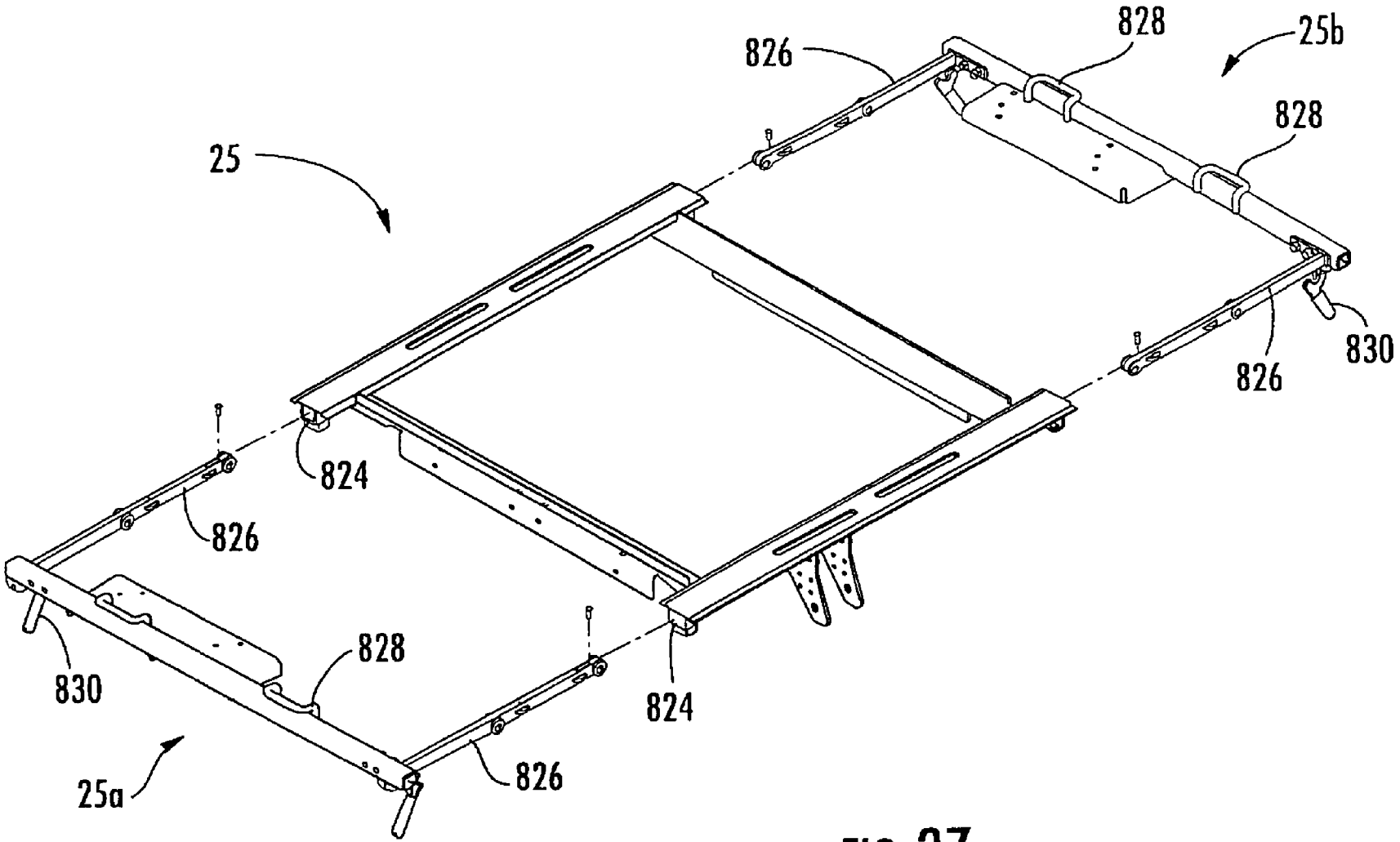
FIG. 37 is an exploded perspective view of the head section of the expandable deck support of FIG. 34.

Similarly, as in FIG. 36, seat section 60 may have width-extension tracks 816, width-extension arms 818, side pull handles 820, latches 822, and width-extension platforms (not shown) that function in substantially the same manner as corresponding components described for the foot section 75 above. Likewise in FIG. 37, head section 25 may have width-extension tracks 824, width-extension arms 826, side pull handles 828, latches 830, and width-extension platforms (not shown) that function in substantially the same manner as corresponding components described for the foot section 75 above. Though not depicted in the illustrations, head section 25 may incorporate an end pullout extension to change the length of deck support 20 that operates in a similar manner to the end pullout extension 75*c* described for the foot section 75.

Alternative or additional means for adjustably extending or retracting side and end pullouts on the various sections are also envisioned without limiting the scope of the invention to the enumerated examples. For example, sections marked 'Detail A' in FIGS. 35 and 36 illustrate vertically oriented wheels 832, 833 and horizontally oriented wheels 834, 835 that may be installed on width extension arms and length extension arms to facilitate the extending and retracting motions of the arms relative to the tracks. Optionally, actuators may be operative to extend or retract any of the pullout extensions, the actuators selectively or simultaneously controllable by a user such as with a touch screen or button controller.

For additional variations that may be incorporated into the head section, reference is made to copending U.S. application entitled INDEPENDENT FOWLER AND SIDERAIL FRAMES, Ser. No. 11/001,522, filed Dec. 1, 2004, which is hereby incorporated herein by reference. For additional variations that may be incorporated into the foot section, reference is made to U.S. Pat. No. 6,968,584 to Lafleche, issued Nov. 29, 2005, which is hereby incorporated herein by reference in its entirety.

The Elevation System

Figure 6A:
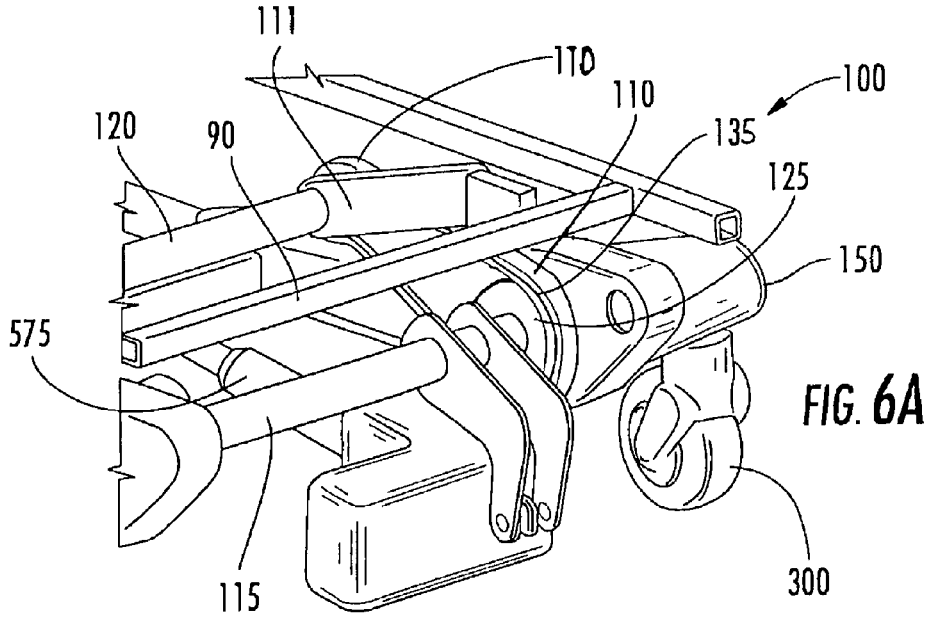
FIGS. 6A-B depict the lift mechanism.
Figure 6B:
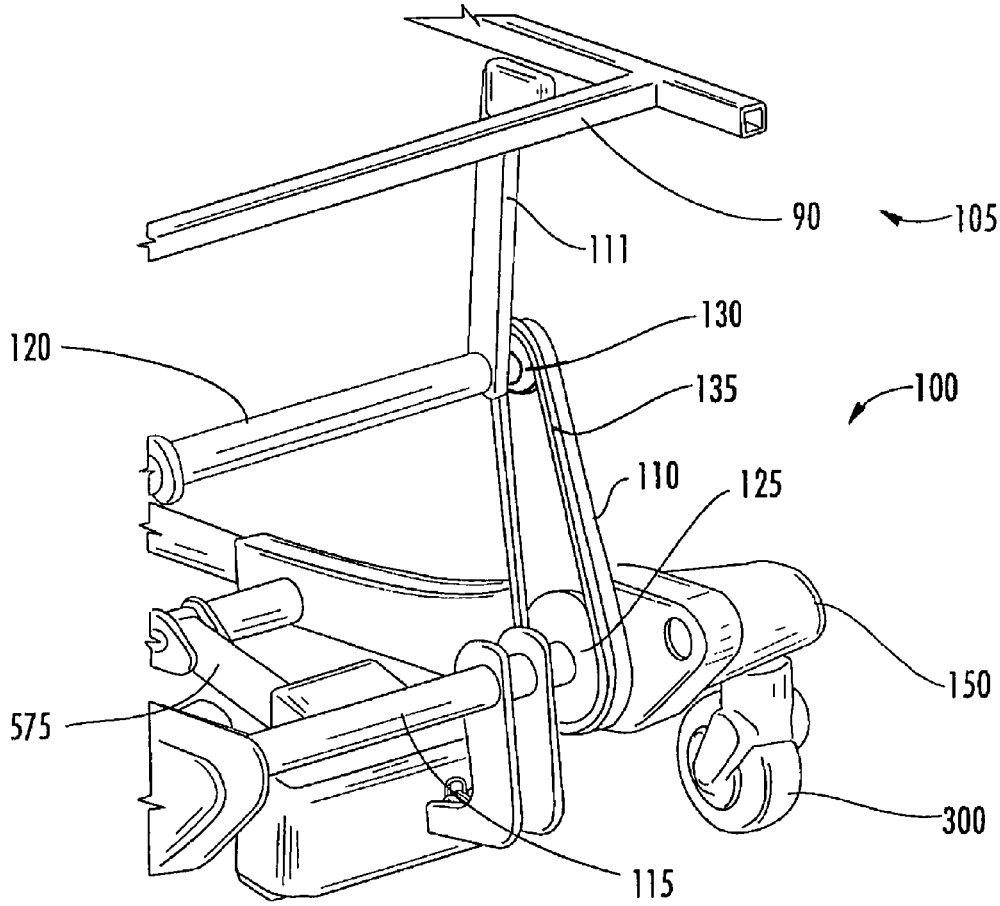
Figure 6C:
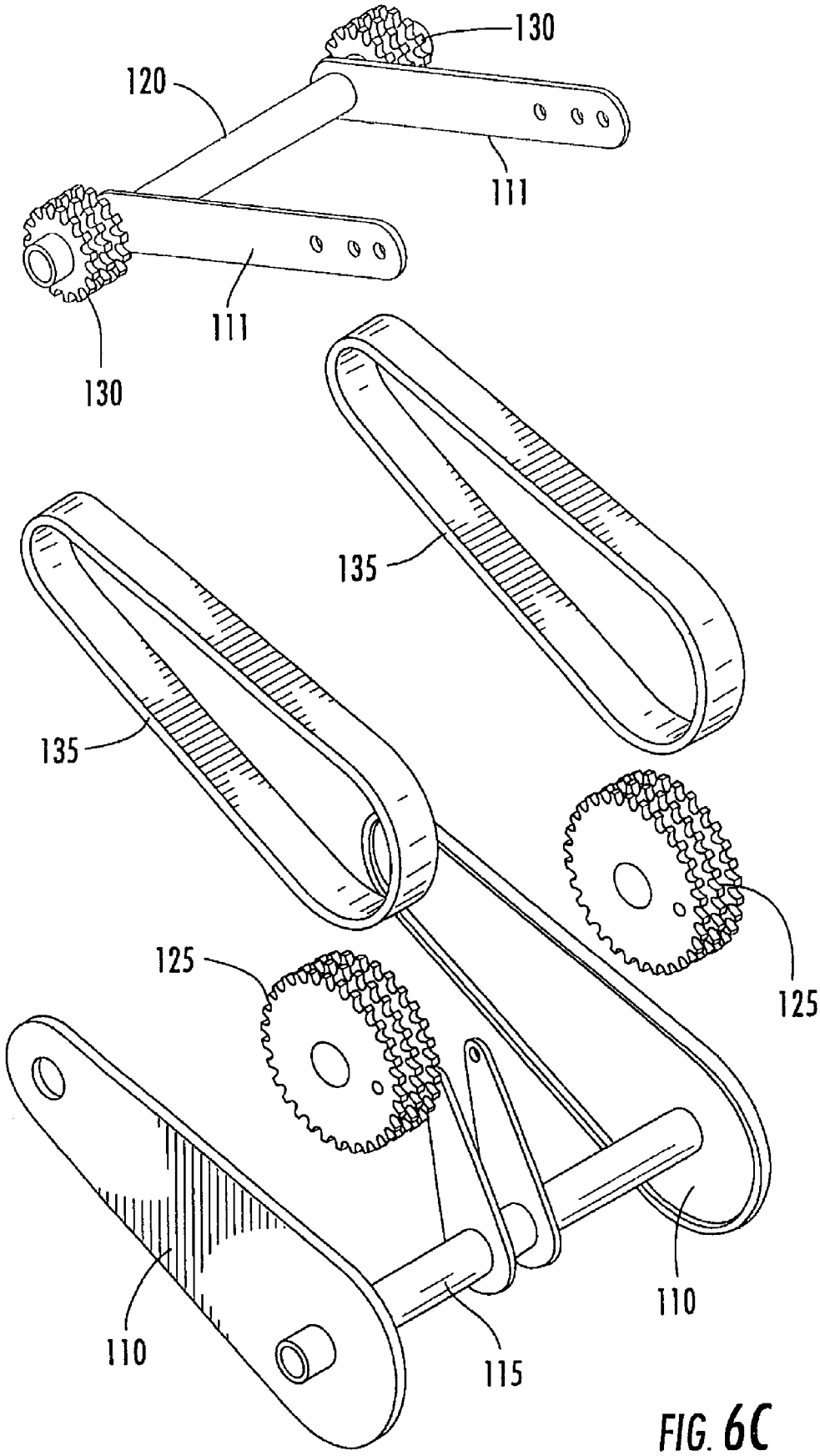
FIG. 6C depicts an exploded perspective view of the lift mechanism.

An elevation system comprising a base component 100 interconnected with a frame component 105 is provided, wherein each base component 100 includes a horizontal base shaft 115 and two or more lower lift arms 110 and each frame component 105 includes a horizontal frame shaft 120 and two or more upper lift arms 111, wherein each lift arm 110, 111 is perpendicular to its respective shaft 115, 120 and fixedly connected thereto at a first end of each of said lift arms 110, 111 (FIG. 6). Each of the lower lift arms 110 of the base component 100 is further pivotally connected at its second/other end to the shaft 120 of the frame component 105. The two or more arms 111 of the frame component 105, in turn, are pivotally connected to the intermediate frame 90 of the patient support apparatus 10 and the base shaft 115 is pivotally connected to the base frame 150. Furthermore, the base shaft 115 is connected to a linear actuator 575, which selectively rotates the base shaft 115. The base component 100 and frame component 105 are further connected to each other by a force transfer device comprising two gears interconnected such as by a chain 135, cable, strap, gear, or rigid member. Alternatively, the force transfer device may include pulleys or rigid levers, for example, rather than gears. During normal operation, the system may be protected by a cover 140 (FIG. 5).

In one embodiment, a suitable chain is about 1.5 inch wide and 1 inch thick, which is interconnected to the gears. FIG. 6 depicts the parts of the elevation system with the chain embodiment. Alternatively, a less expensive and smaller three-link chain design can be used. FIG. 7 depicts side profiles of the elevation system with a cable embodiment.

The first gear 125 is located adjacent a lift arm 110 on the base shaft 115, and the first gear 125 does not rotate with the shaft 115, but rather remains stationary relative to the base frame 150. The frame shaft 120, its lift arms 111, and the second gear 130 are all fixedly attached to each other (i.e., they do not rotate relative to each other), and this second gear 130 is configured to be smaller than the first gear 125, for example half the size.

The elevation system operates such that rotation of the base shaft 115 by an actuator 575 induces rotation of the arms 110 of the base component 100, which then, through the chain 135 induces upward lifting and rotation of the frame shaft 120. The rotation and lift of the lower lift arms 110 together with the rotation and lift of the upper lift arms 111 results in the vertical movement of the intermediate frame 90 thereabove.

Alternative elevation systems that are similar in construction to the system discussed above are also contemplated, without limiting the scope of the invention. For example, additional gears and connecting members may be added in various configurations to achieve a force-multiplying effect, such as to reduce the actuating force needed to raise the lift arms.

Figure 38A:
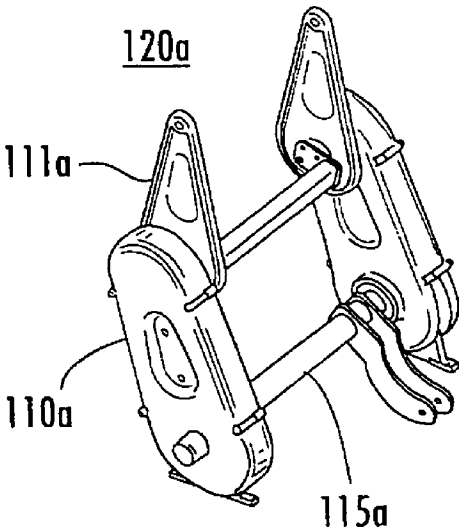
FIGS. 38A-B are perspective views of an alternate lift mechanism, where
Figure 38B:
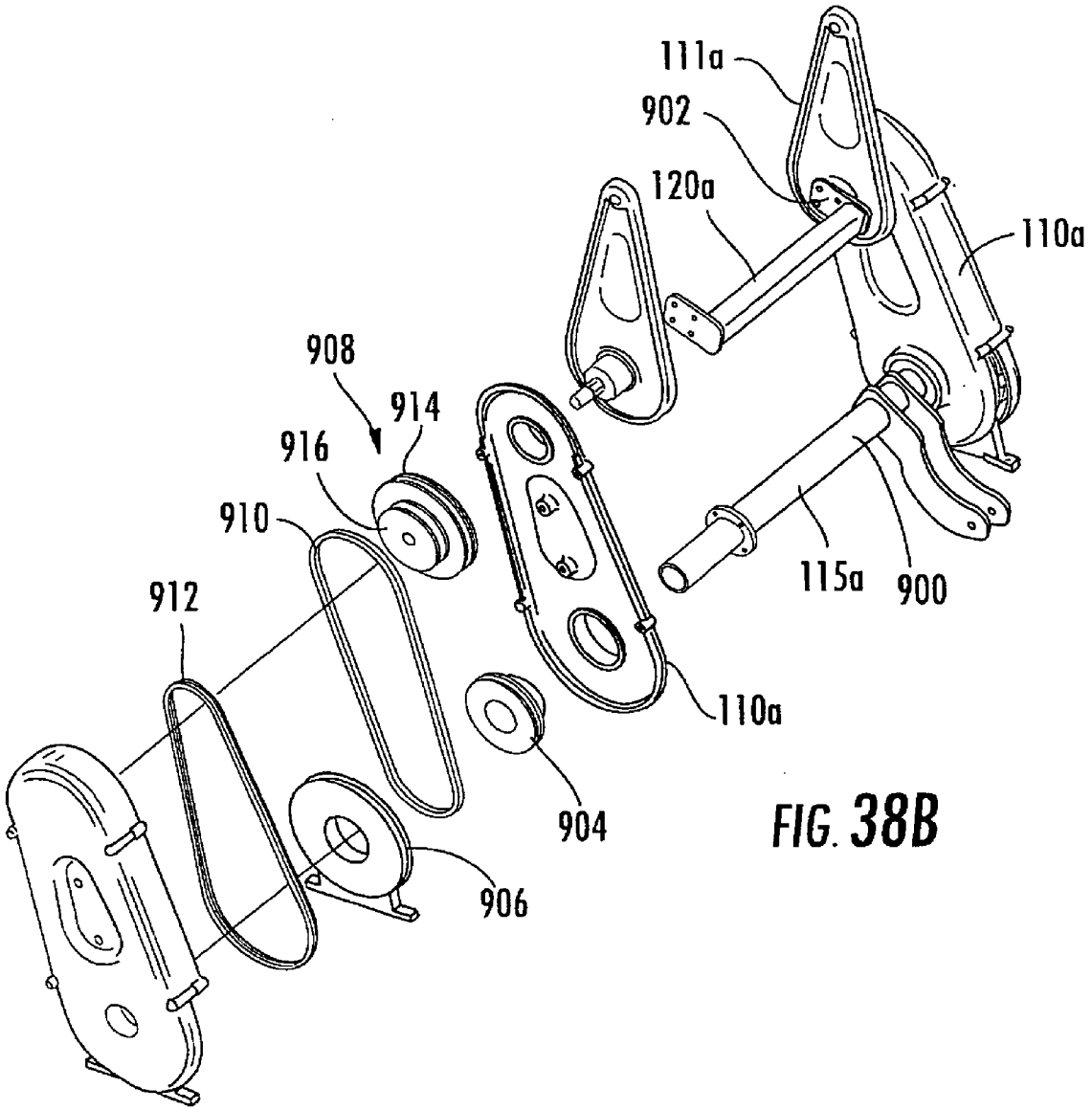

FIG. 38 illustrates the lift arms and force transfer devices of one such alternative system. The elevation system depicted therein includes a lower pivot 900 of the lower arm portion 110*a*, a lower pivot 902 of the upper arm portion 11a, an upper pivot 902 of the lower arm portion 110*a* that is congruous with the lower pivot 902 of the upper arm portion 111*a*, a lower rotatable gear 904 adjacent the lower pivot 900 of the lower arm portion 110*a*, a lower stationary gear 906 substantially concentric with the lower rotatable gear 904, an upper rotatable gear 908 adjacent the upper pivot 902 of the lower arm portion 110*a*, a base shaft 1I5*a*, a frame shaft 120*a*, a first connecting member 910 engaging the lower rotatable gear 904 and the upper rotatable gear 908, and a second connecting member 912 engaging the lower stationary gear 906 and the upper rotatable gear 908.

An actuator (not shown) selectively moves the base shaft 115*a*, which rotates the lower rotatable gear 904 with shaft 115*a*, lower rotatable gear 904 moving the first connecting member 910. The first connecting member 910 causes the upper rotatable gear 908 to rotate, the upper rotatable gear 908 simultaneously causing the upper arm portion 111*a* to pivot upwardly about the lower pivot 902 of the upper arm portion 111*a* and causing the second connecting member 912 to transmit a pivoting force to the lower arm portion l10*a*, thus pivotably raising the lower arm portion ll0*a*. The upper rotatable gear 908 includes a first gear 914 and a substantially concentric second gear 916, the first gear 914 being fixed to the second gear 916. The first gear 914 engages the first connecting member 910 and the second gear 916 engages the second connecting member 912. The lower rotatable gear 904 may be smaller than the first gear 914 of the upper rotatable gear 908 and the second gear 916 of the upper rotatable gear 908 may be smaller than the lower stationary gear 906. This arrangement and sizing of gears and connecting members may have a gear-reduction effect such that the actuator may lift the lift arms 110*a*, 111*a* with less force than other gear and connecting member arrangements.

The actuator causes the lower rotatable gear 904 to move the first connecting member 910, the first connecting member 910 causes the upper rotatable gear 908 to rotate, the upper rotatable gear 908 simultaneously causing the upper arm portion 111*a* to pivot upwardly about the lower pivot 902 of the upper arm portion 11*a* and causing the second connecting member 912 to transmit a pivoting force to the lower arm portion 110*a*, thus pivotably raising the lower arm portion 110*a*.

Figure 39A:
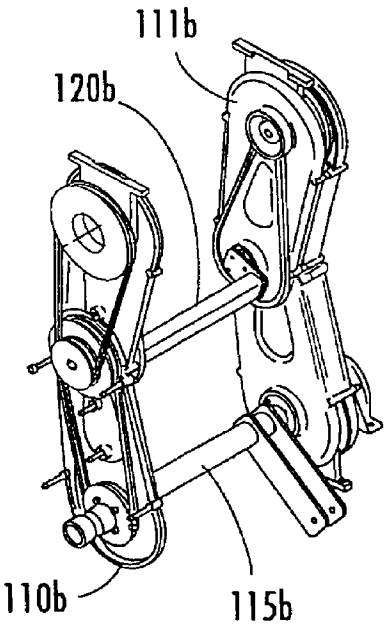
FIGS. 39A-B are perspective views of another alternate lift mechanism, where
Figure 39B:
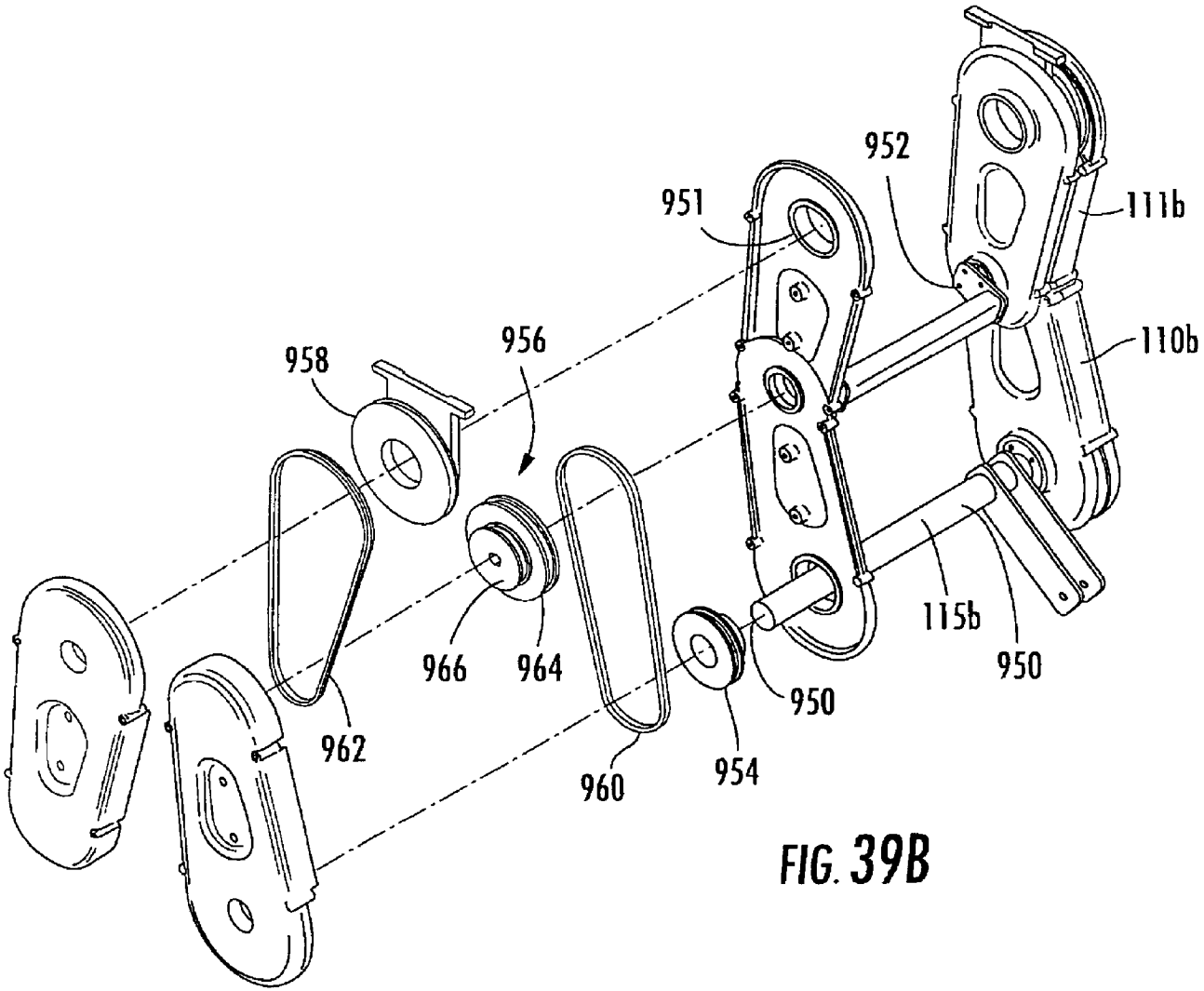

FIG. 39 illustrates the lift arms and force transfer devices of another such alternative system. The elevation system depicted therein includes a lower pivot 950 of the lower arm portion 110*b*, an upper pivot 951 of the upper arm portion 111*b*, a lower pivot 952 of the upper arm portion 111*b*, an upper pivot 952 of the lower arm portion 110*b* that is congruous with the lower pivot 952 of the upper arm portion 111*b*, a lower rotatable gear 954 adjacent the lower pivot 950 of the lower arm portion 110*b*, an upper rotatable gear 956 adjacent the upper pivot 952 of the lower arm portion 110*b*, an upper stationary gear 958 substantially concentric with the upper pivot 951 of the upper arm portion 11 b, a base shaft 115*b*, a frame shaft 120*b*, a first connecting member 960 engaging the lower rotatable gear 954 and the upper rotatable gear 956, and a second connecting member 962 engaging the upper rotatable gear 956 and the upper stationary gear 958.

An actuator (not shown) rotates the base shaft 115*b*, which rotates the lower rotatable gear 954 to move the first connecting member 960. The first connecting member 960 causes the upper rotatable gear 956 to rotate, the upper rotatable gear 956 simultaneously causing the upper arm 111*b* to pivot upwardly about the lower pivot 952 of the upper arm portion 111*b* and causing the second connecting member 962 to transmit a pivoting force to the upper arm portion 111*b*, thus pivotably raising the upper arm portion 111*b*. In the embodiment shown, the upper rotatable gear 956 comprises a first gear 964 fixed to and concentric with a second gear 966. The first gear 964 engages the first connecting member 960 and the second gear 966 engages the second connecting member 962. The lower rotatable gear 954 may be smaller than the first gear 964 of the upper rotatable gear 956 and the second gear 966 of the upper rotatable gear 956 may be smaller than the upper stationary gear 958. This arrangement and sizing of gears and connecting members may have a gear-reduction effect such that the actuator may lift the lift arms 110*b*, 111*b* with less force than other gear and connecting member arrangements.

One advantage of the elevation system is that the patient support apparatus 10 can be raised or lowered without substantial longitudinal or lateral movement of the deck support 20. Furthermore, the elevation system can be driven by a motor, or be otherwise power-assisted, thereby minimizing the physical effort required to raise and lower the height of the patient support apparatus 10. Another advantage of this system is the simplicity of the design, which requires few moving parts. This design is therefore easily manufactured and repaired.

In one embodiment, the patient support apparatus 10 has two elevation systems, one located proximate the first end of the intermediate frame 90 and the other located proximate the second end of the intermediate frame 90. Each system has a dedicated actuator and motor. In order to vertically raise or lower the apparatus, both elevation systems operate concurrently in the same direction (up or down) and at the same rate. As detailed herein and depicted in FIGS. 7A-C, the two systems can work together to move the bed to the Trendelenburg and Reverse Trendelenburg positions or to any intermediate position. Movement of the elevation system is governed by the controller as described herein. Other designs of elevation systems which may accomplish the same function are contemplated.

Caster Braking System

The frame system of the patient support apparatus 10 further includes a caster braking system. The caster braking system interconnects each caster device to provide simultaneous braking of caster devices. Alternatively, each caster device can be associated with a specific foot brake pedal or more than one device can be associated with one brake pedal. To simultaneously brake all caster devices, the caregiver steps on a foot brake pedal 310, causing the caster braking system to lock all caster devices against rolling. In alternative embodiments the caster devices are brake/steer caster devices capable of braking and steering.

Structural Barriers—Side Rails

The patient support apparatus 10 comprises a headboard 160, a footboard 195, a pair of head-end side rails 415, and a pair of foot-end side rails 420. Head and foot-end side rails 415, 420 are configured to move between raised or deployed positions, as shown in FIGS. 1-4, 8, and 9, and lowered or stowed positions, as shown in FIGS. 10 and 11 to permit entry and egress of patients into and out of the patient support apparatus 10. Head-end side rails 415 may be coupled to the head section 25 of the deck support 20 and may be moved between raised and lowered positions. Foot-end side rails 420 may be coupled to the intermediate frame 90 and may also be moved between raised and lowered positions. As the head section 25 of the deck support 20 rotates relative to the intermediate frame 90, head-end side rail also rotates relative to the intermediate frame 90.

Side rails 415, 420 include rail members and linkage assemblies coupled between 1) rail members and the head section 25 of the deck support 20 and 2) respective rail members and the intermediate frame 90 that permit the rail members to be moved between upper and lower positions.

The term "side rail body" is used to define the part of a side rail apparatus intended to ensure the patient does not fall from or exit the patient support apparatus when the side rail is in its fully or partially deployed positions. The term "locking mechanism" is used to define any mechanism configured to allow the side rail to be locked or unlocked in any predetermined position. The term "support arms" is used to define the physical components connecting the side rail body to the mechanism casing through pivots situated in proximity of each end of each of the support arms. The term "guiding mechanism" is used to define a means for guiding the side rail body through a lateral movement of the side rail body towards and away from the patient support apparatus during rotational movement of the side rail body. The term "inside view" is used to define a view in relation to the side rail means the view from the side in relative proximity of the patient support apparatus and the term "outside view" is used to define a view from the side opposite to that shown in the inside view. The term "upper pivot" is used to define a pivot used to connect a support arm and a side rail body 425 or side rail body support (not shown). The pivot connected to the other end of the support arm is defined to as a "lower pivot". The terms "upper pivot" and "lower pivot" appear elsewhere as references to pivots located at upper and lower ends of lift arm portions 110, 111. The previous definition is not affected by the spatial position of the lower and upper pivot relatively to each other, as this position can change during operation of the side rail mechanism.

The present invention may provide a movable side rail for use with a patient support apparatus 10 comprising a side rail body 425 and two or more support arms 450 (FIGS. 8-14). A first end of each support arm 450 is pivotally connected to the side rail body 425 in a longitudinally spaced apart relationship using an upper pivot. A second end of each support arm 450 is pivotally connected to a cross-member 470 in a longitudinally spaced apart relationship through a lower pivot, the cross-member 470 being coupled to the patient support apparatus 10, to either the deck support 20 or the intermediate frame 90. In one embodiment, the head-end side rail is attached proximate the first end of the deck support 20 and the foot-end side rail is attached to the seat section 60 of the deck support 20.

The movable side rail for use with the patient support apparatus 10 according to the present invention comprises a side rail body 425 and two or more support arms 450 (FIGS. 8-14). A first end of each support arm 450 is pivotally connected to the side rail body 425 in a longitudinally spaced apart relationship using an upper pivot, a second end of each support arm 450 is pivotally connected to a cross-member 470 in a longitudinally spaced apart relationship through a lower pivot, the cross-member 470 being coupled to either the deck support 20 or the intermediate frame 90. Each support arm 450 is configured to have a shape with a width greater at the first end than at the second end thereof. The side rail body 425 is movable between a deployed position and a stowed position through clock-type rotational movement in a plane substantially vertical and substantially parallel to the longitudinal length of the patient support apparatus 10. As a result of the shape of the support arms 450, the side rail angle 514 (FIG. 8B) defined between each support arm 450 and the bottom edge of the side rail body 425 remains substantially obtuse at all times during the rotational movement of the side rail body 425. This configuration eliminates pinch points created between each support arm 450 and the bottom edge of the side rail body 425, which may typically occur when traditional support arms 450 are used.

The movable side rail 415, 420 for use with the patient support apparatus 10 according to the present invention comprises a side rail body 425 with two or more support arms 450. A first end of each support arm 450 is pivotally connected to the side rail body 425 in a longitudinally spaced apart relationship using an upper pivot, a second end of each support arm 450 is pivotally connected to a guiding mechanism 455 through a lower pivot operatively engaged thereto in a longitudinally spaced apart relationship. The guiding mechanism 455 is coupled to a cross-member 470 connected to either the deck support 20 or the intermediate frame 90 (FIGS. 8, 10, and 11). Each of the lower pivots includes a radial protrusion 475 configured to engage with a groove 480 in the guiding mechanism 455. When the lower pivots are rotationally moved, the radial protrusions 475 are guided by the grooves 480 thereby causing a transverse or lateral translational movement of the pivots along pivot slots of the guiding mechanism 455 resulting in the transverse or lateral translational movement of the side rail body 425 towards or away from the patient support apparatus 10, during the raising or lowering movement of the side rail.

Side Rail Body and Support Arms

Figure 8B:
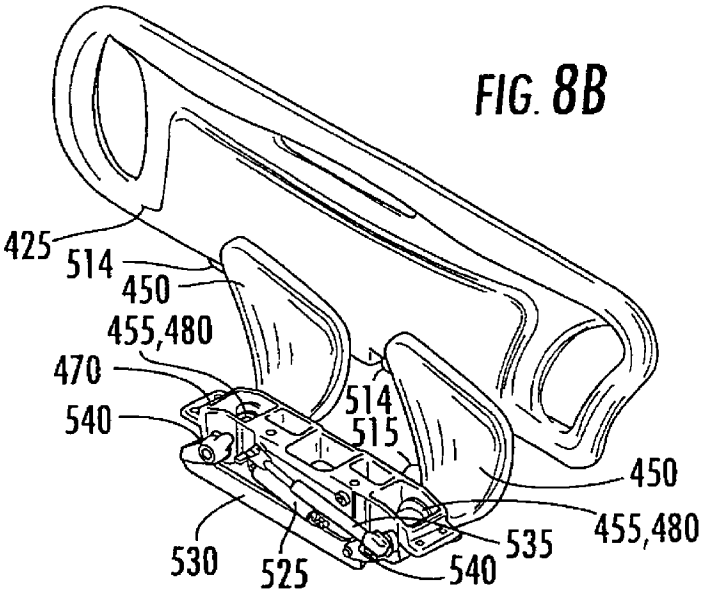
FIGS. 8A-C depict perspective external and internal views and a front internal view of the spring and damper in the raised side rail wherein the angle 515 between the arm and the mechanism is about 70 degrees.
Figure 8A:
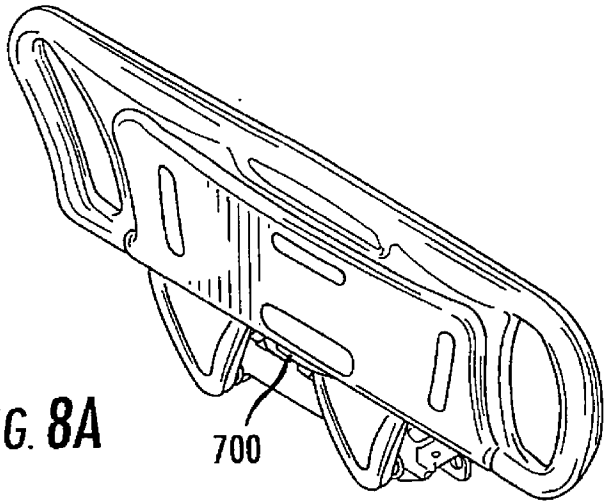

FIG. 8B illustrates a three dimensional inside view of one embodiment of the side rail. A single patient support apparatus 10 may have side rails 415, 420 of different shapes and sizes. The side rail body 425 is connected to two support arms 450 through two respective upper pivots. Two respective lower pivots are used to connect the other ends of the two support arms 450 to a cross-member 470. The shape of the support arms 450 is one example of the configuration designed to avoid the creation of pinch points between the support arms 450 and the lower side of the side rail body 425 during movement of the side rail. FIG. 8A illustrates an outside view of the embodiment of FIG. 8B with the side rail body 425 attached to the side rail mechanism. The side rail body 425 is coupled to a side rail body support, and can be replaced or changed if damaged or to suit different needs, without having to change the complete side rail. A release system for a locking mechanism is shown. The release mechanism 700 (FIGS. 8A and 12-14) may be located where its access is substantially limited the caregiver or someone other than the person on the patient support apparatus 10. For example, the release mechanism 700 may be configured and located on the side rail body support where it is not easily operated by the person on the patient support apparatus 10. This configuration may be useful such as for security and safety reasons.

Figure 9A:
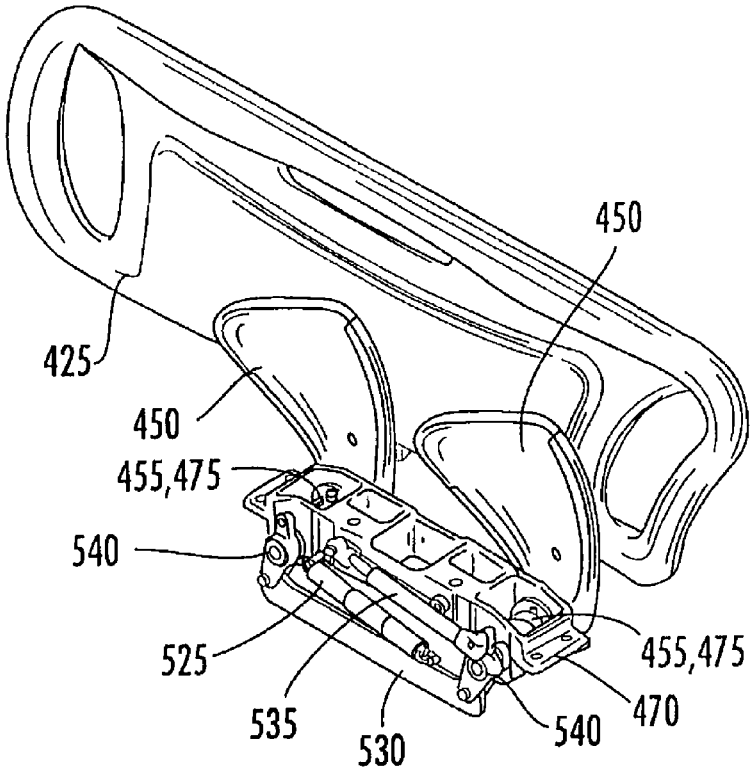
FIGS. 9A-B depict perspective internal and front internal views of the spring and damper in the partially raised side rail wherein the angle between the arm and the mechanism is about 30 degrees.
Figure 9B:
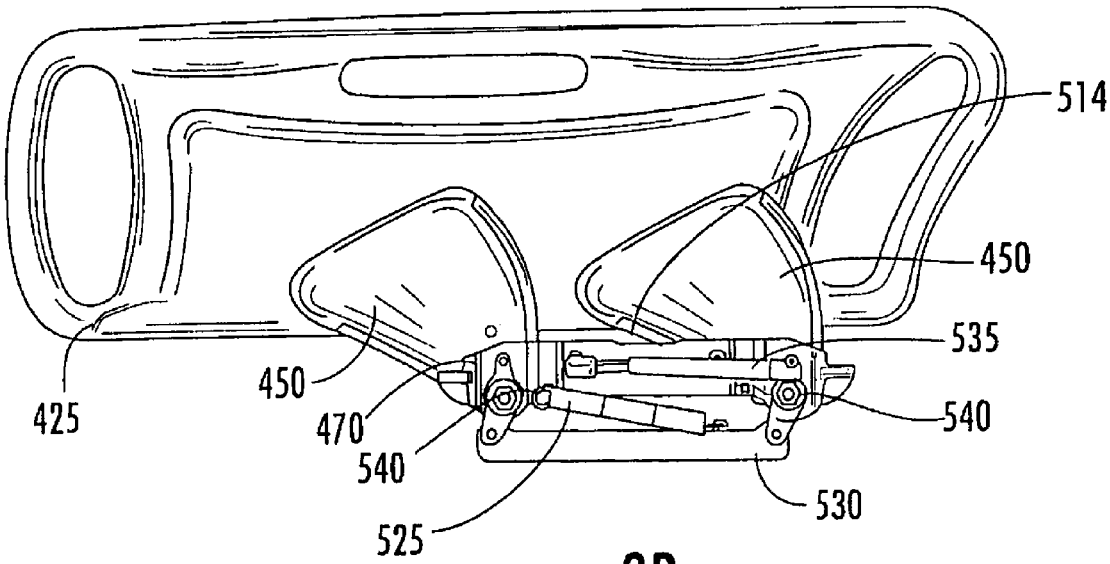
Figure 10A:
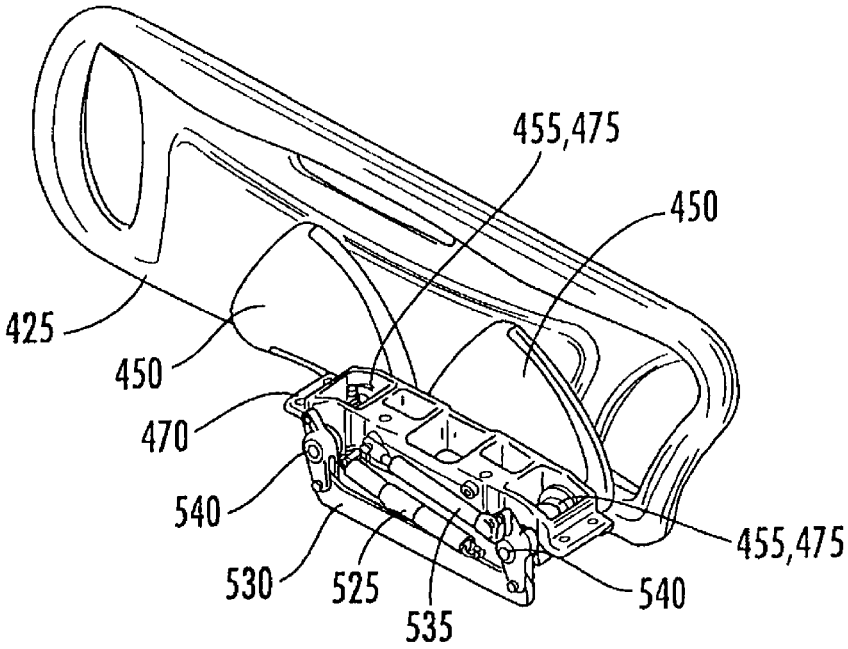
FIGS. 10A-B depict perspective internal and front internal views of the spring and damper 535 in the partially lowered side rail wherein the angle between the arm and the mechanism is about 0 degree.
Figure 10B:
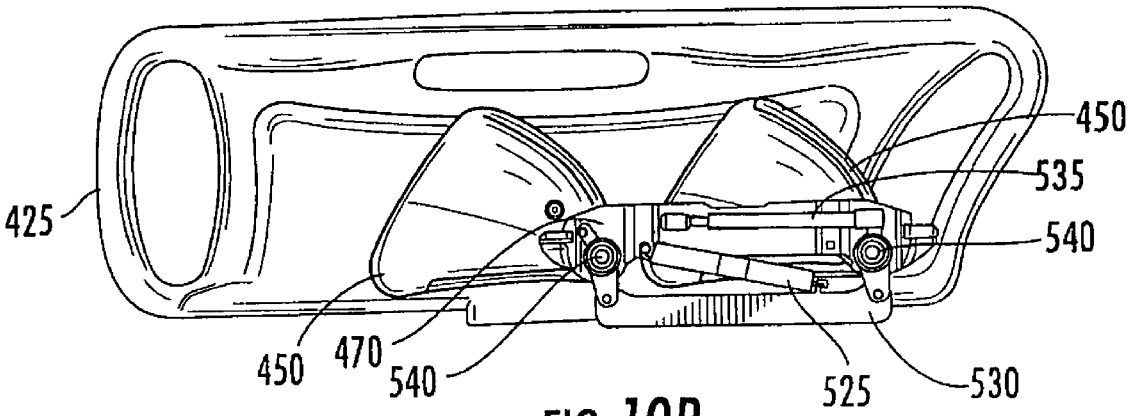
Figure 11A:
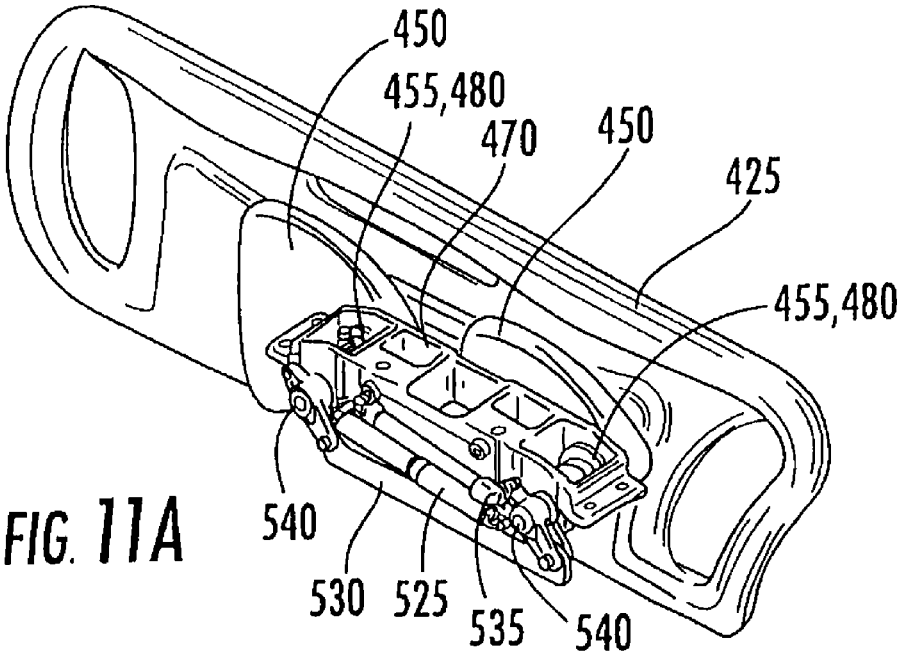
FIGS. 11A-B depict perspective internal and front internal views of the spring and damper in the lowered side rail wherein the angle between the arm and the mechanism is about −35 degrees.
Figure 11B:
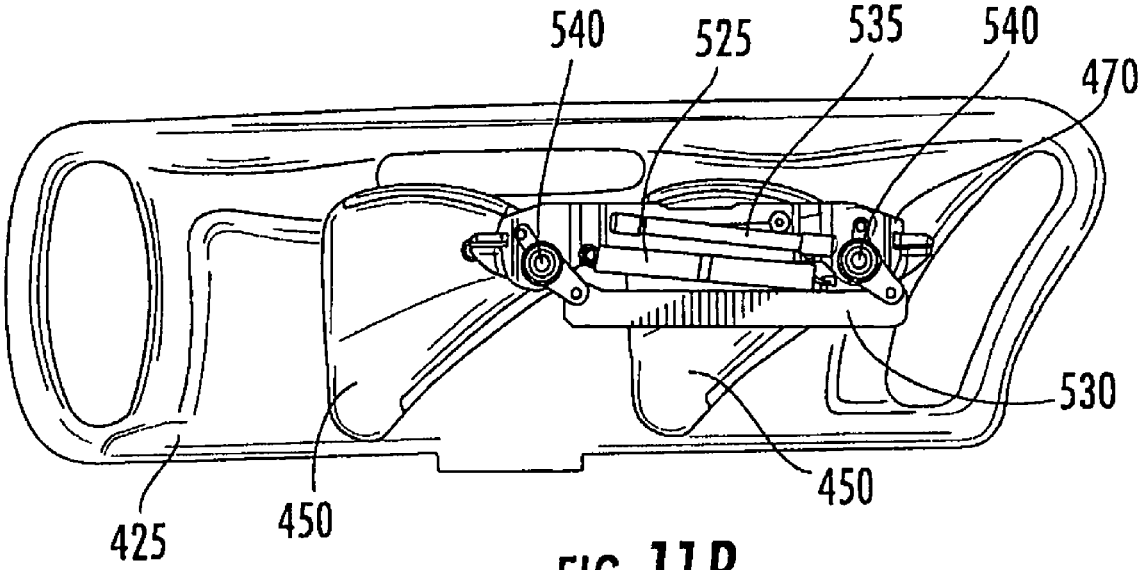
Figure 12:
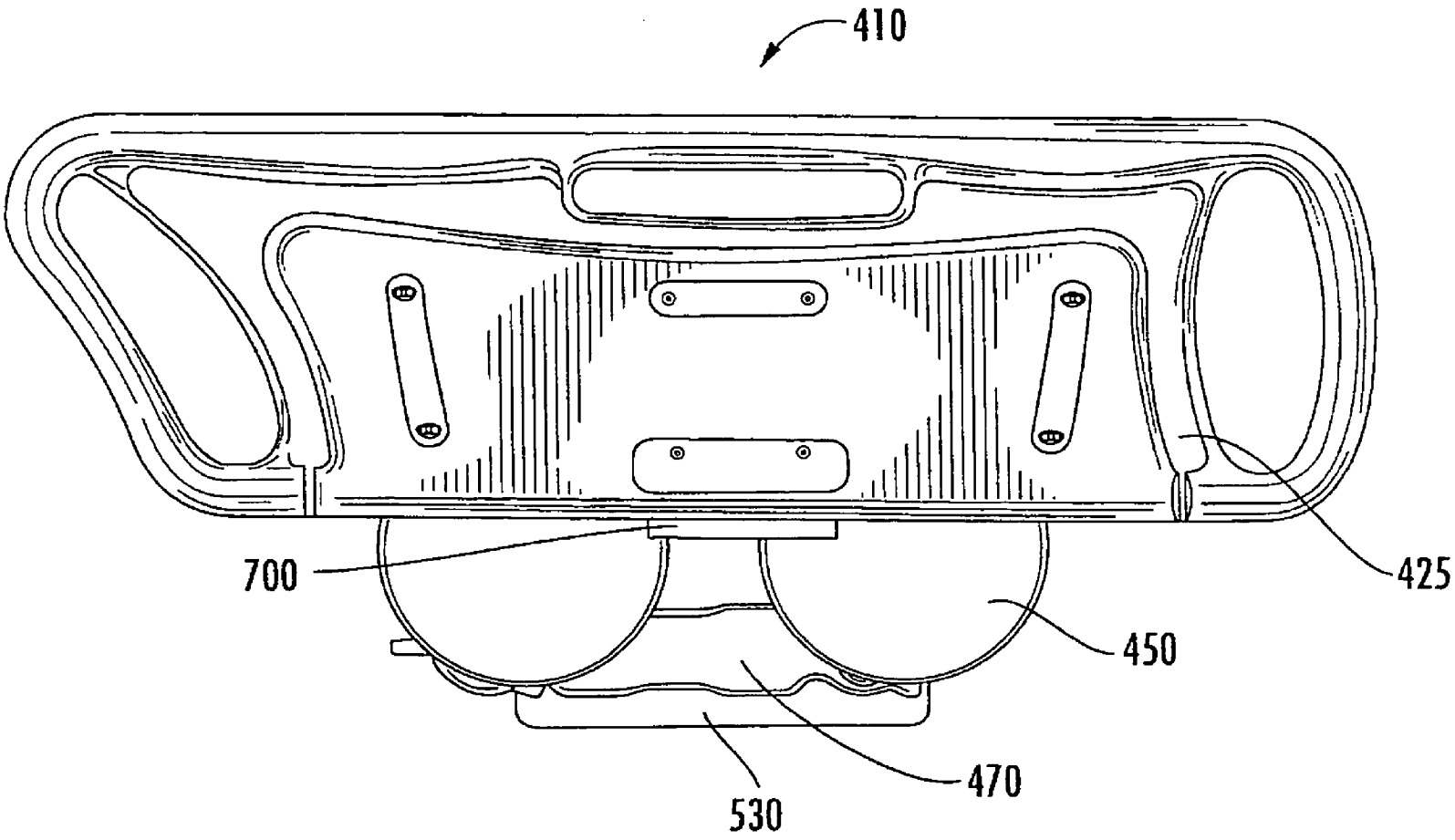
FIGS. 12-14 are side exterior views of a side rail in various positions of deployment wherein the shape of the support arms is round.
Figure 13:
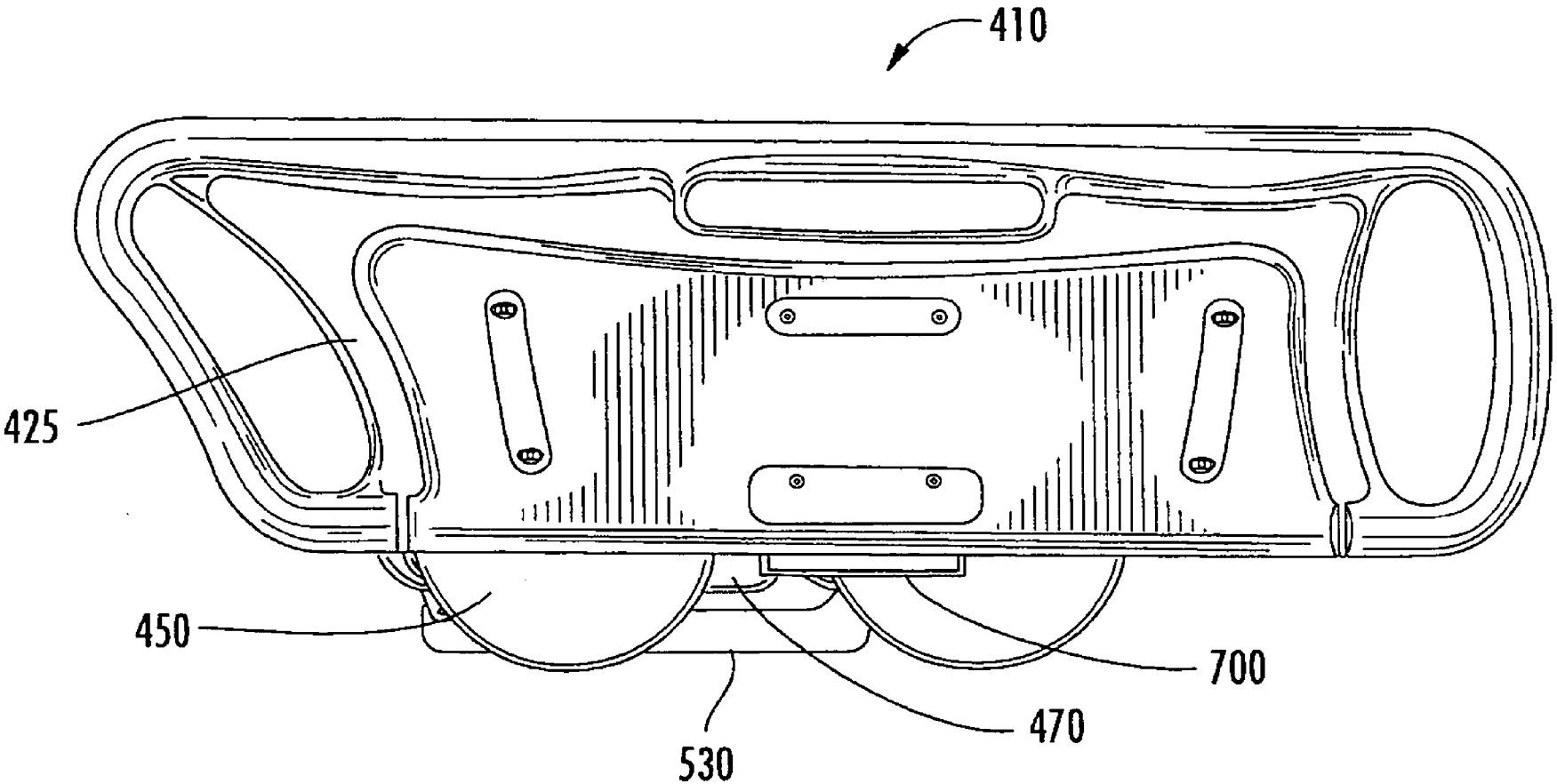
Figure 14:
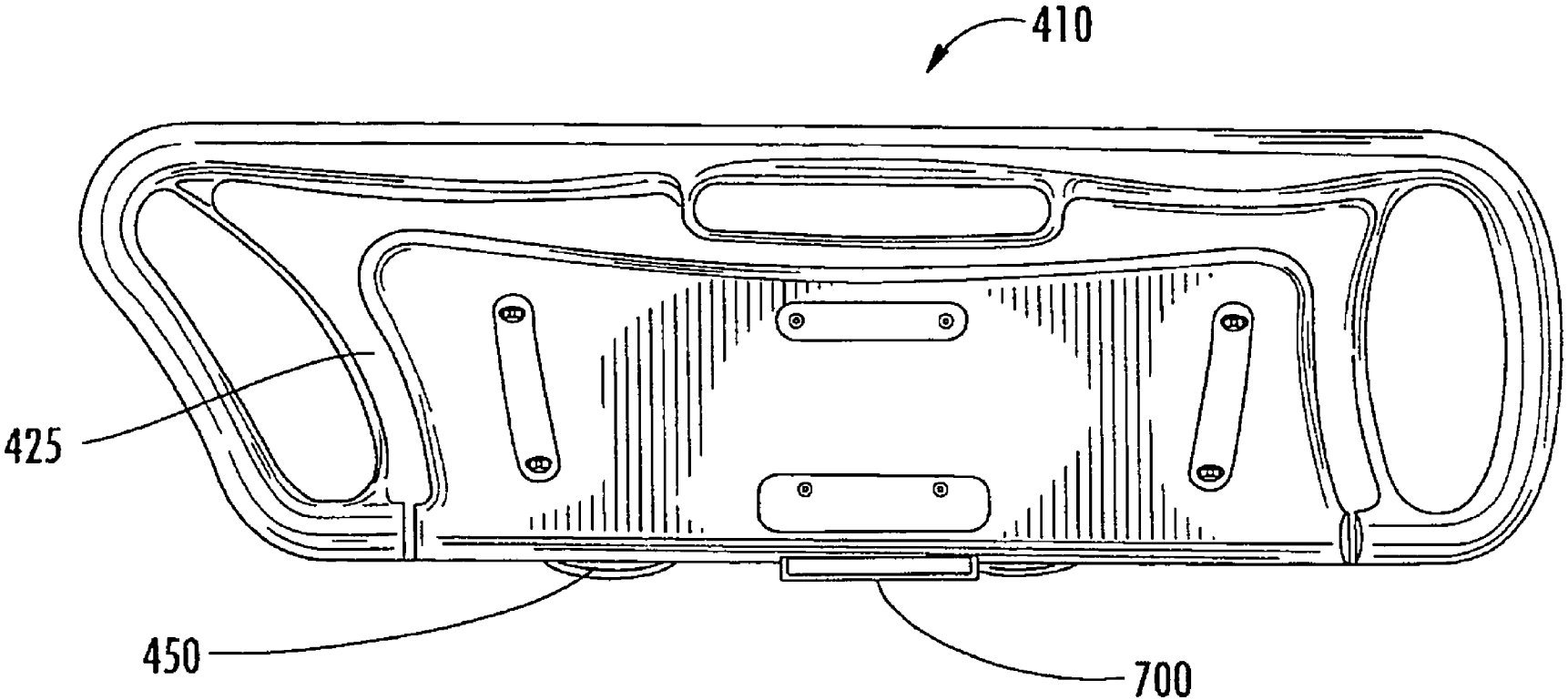

With reference to FIGS. 8C, 9B, 10B and 11B, inside views of the side rail in accordance with one embodiment are illustrated for different positions from a deployed position (FIG. 8C) to a stowed position (FIG. 11B). It can be clearly identified that the angle 514 formed between each support arm 450 and the bottom edge of the side rail body 425 remains substantially obtuse at all times during the rotational movement of the side rail body 425. The side rail body 425 of the side rail mechanism can be made, for example, from plastic or other synthetic materials that can be molded while the side rail body support can be made, for example, of aluminum, aluminum alloys, or any other material with a sufficient level of strength. These materials are provided solely as examples and the choice of materials used for these parts can vary according to various considerations such as weight, strength, appearance, durability, and sturdiness, for example.

Several shapes for the support arms 450 can be used, with the common characteristic that the width of the support arms 450 is greater at the upper ends (operatively connected to the upper pivots) than the lower ends (operatively connected to the lower pivots) so that the angle 514 defined by the lower side of the side rail body 425 (or side rail body support) and the support arms 450 remain substantially obtuse at all times during the operation of the side rail, eliminating pinch points during operation of the side rail. For example, and without limiting the scope of the invention, possible shapes for the support arms 450 are triangular, trapezoidal, round (see, for example, FIGS. 12-14), having sides curved in a convex or concave manner, etc. By locating the upper pivots as described, the pinch points may be eliminated. The connection points between the upper ends of the support arms 450 and the upper pivots are preferably proximal to the rotational side of the support arms 450 which face the rotational movement when the side rail is moved from the deployed position to the stowed position as illustrated in FIGS. 8C, 9B, 10B, and 11B.

FIGS. 9B and 10B are detailed inside views of the side rail at intermediate positions. The angle 514 formed by the bottom edge of the side rail body 425 and the support arms 450 remains substantially obtuse until it is eliminated when the side rail body 425 (shown in FIGS. 10A-B) is lowered to a point where the upper pivots are substantially aligned horizontally to the lower pivots. This illustrates how the side rail body 425 can be moved laterally towards and away from the center of the patient support apparatus 10 in order to reduce the width of the patient support apparatus 10 when not in use and conversely increase the width of the patient support apparatus 10 when in use. Also, the vertical and lateral movement of the side rail body 425 (not shown in these figures) may take place through a single movement during operation of the side rail, which may decrease the effort and separate actions required for operation of the side rail.

For additional variations that may be incorporated into the side rails, reference is made to copending PCT Pat. Application PCT/CA06/01341, filed Aug. 16, 2006, which claims priority to U.S. provisional Application Ser. No. 60/760,564, filed Oct. 27, 2005 and to U.S. Pat. No. 6,721,975 to Lemire, issued Apr. 20, 2004, which are incorporated by reference herein in their entireties.

Guiding Mechanism and Cross-Member

Figure 8C:
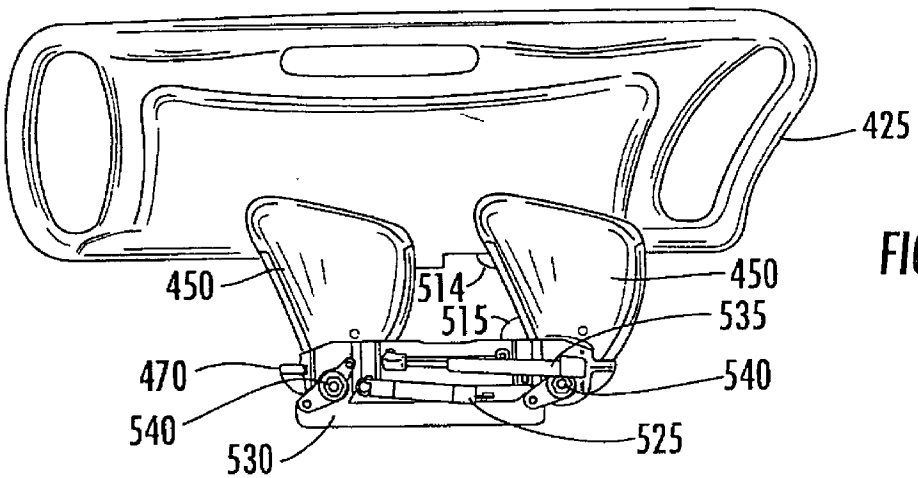

FIGS. 8A-C are detailed views of the side rail in the fully deployed position according to one embodiment. The side rail body support is pivotally connected to two support arms 450 through a pair of upper pivots. The two support arms 450 are pivotally connected to guiding mechanisms 455 through a pair of lower pivots, the guiding mechanisms 455 operatively connected to a cross-member 470. A radial protrusion 475 located on each lower pivot is operatively coupled to a bearing assembly which is operatively engaged with a groove 480 of the guiding mechanism 455. The bearing assembly operatively coupled to the radial protrusion 475 reduces the frictional coefficient during the operation of the side rail, considerably diminishing the wear of the radial protrusion 475 and the edges of the groove 480. Any kind of conventional bearing assembly can be used for this purpose. The shape and size of groove 490 can vary depending on the desired lateral transitional movement of the lower pivots along the pivot slots of the guiding mechanism 455. The rotational movement around the lower pivots which occurs during operation of the side rail results in the transverse movement of the lower pivots and translates into a transverse movement of the side rail body support towards or away from the longitudinal centerline of the patient support apparatus 10. The distance between the side rail body support and the deck support 20 or the intermediate frame 90 is at its maximum in this deployed position. FIG. 8C illustrates an inside view of FIG. 8A and illustrates the angle 515 formed between the support arms 450 and the side rail body 425 being substantially obtuse.

The guiding mechanism 455 can be configured in several ways. For example, the guiding mechanism 455 can be cast in a single component, incorporating the cross-member 470. It can also be machined from a single piece of material. Some of the advantages of such embodiments that may be achieved are reduced costs of production, simplified installation, and structural integrity of the guiding mechanisms 455 and the cross-member 470. The guiding mechanism 455 and cross-member 470 can also be formed from several parts. For instance, the areas immediately surrounding the grooves 480 of the guiding mechanism 455 can be made from parts distinct from the rest of the guiding mechanism 455. Given that these sections of the guiding mechanism 455 are the areas which may sustain the heaviest wear due to the friction between the radial protrusions 475 located on each lower pivot or the bearing assembly operatively coupled to the radial protrusions 475, it is desirable to have these sections separate from the rest of the guiding mechanism 455 and the cross-member 470 in order to replace only the damaged sections when needed instead of replacing the whole guiding mechanism 455 or cross-member 470. It may also be useful to replace the sections immediately surrounding the grooves 480 of the guiding mechanism 455 to change the configuration of the grooves 480 for different uses of the side rail with the same patient support apparatus 10.

The shape of the guiding grooves 480 themselves can vary to accommodate various needs and various lying surfaces the side rail is to be used with. For example, the grooves can be linear, curved, angled or a combination thereof, as long as the guiding grooves 480 of a side rail are identical and have the same orientation. The embodiment illustrated in FIGS. 8-11, for example, has guiding grooves 480 which have a substantially longitudinally linear portion followed by a curved portion. When a rotational force is applied to the side rail, there is no lateral movement until the radial protrusions 475 engage with the curved portions of the guiding grooves 480. When the radial protrusions 475 reach the beginning of the curved portions of the guiding grooves 480, the top of the side rail body is located lower than the side of the deck support 20 or intermediate frame 90 so that once the radial protrusions 475 engage with the curved portions of the guiding grooves 480, the side rail body is free to translate laterally closer to the center of the patient support apparatus 10. Other embodiments where the radial protrusion 475 and bearing assembly are in different positions during the lateral translation movement are also provided. The preceding is merely one example of possible configurations of the guiding grooves 480. The guiding grooves 480 can have curved portions curving towards or away from the cross-member 470, or any combination of curved and linear portions. For example, a guiding groove 480 can have two curved portions curving towards the cross-member 470 separated by a linear portion such that a rotational force applied to the side rail body will result in a lateral movement translating in the side rail body being closer to the center of the patient support apparatus 10 when in a fully deployed position or fully stowed position, while the side rail body would be farther from the center of the patient support apparatus 10 when in transitional positions.

In a another embodiment of the invention, the guiding grooves 480 are located on the pivot shaft to operatively engage with one or more protrusions 475, coupled to a bearing assembly, extending from the inside of the pivot slot.

In one embodiment the guiding mechanism 455 and the cross-member 470, or the different components thereof, as the case may be, can be made of several materials. Characteristics such as weight-to-strength ratio, hardness, wear resistance, and corrosion resistance (corrosion from airborne corrosive agents, air, and cleaning solvents and bodily fluids usually found in a hospital/medical environment) should be given consideration when choosing the materials to be used in the manufacturing of the guiding mechanism 455 and the cross-member 470 or the different components thereof. For example, aluminum is lightweight and resistant to corrosion, making a good material for the cross-member 470. However, other parts such as the areas immediately surrounding the grooves 480 of the guiding mechanism 455 and the slots of the lower pivot can be made from other materials to accommodate the higher frictional abrasion on such parts making them more prone to wear. Materials with a high resistance to wear, such as steel, stainless steels or ferrite alloys for example, can be used for making these parts. Other parts of the side rail mechanism can be made from further different materials and are not limited in any way to the materials used for the guiding mechanism 455. The various parts of the guiding mechanism 455 and the cross-member 470 can comprise interlocking mechanisms provided between the multiple parts to ensure correct alignment of these multiple parts during assembly. As mentioned previously, for example, the guiding grooves 480 within a same guiding mechanism 455 may be substantially the same to provide a smooth motion. Slots, grooves, apertures or fittings, for example, may be used to interlock the various parts of the side rail together precisely.

With reference to FIGS. 9B and 10B, embodiments of the side rail are illustrated in transitional positions between a fully deployed position and a fully stowed position. The side rail body support is pivotally connected to two support arms 450 through a pair of upper pivots. The two support arms 450 are pivotally connected to the guiding mechanism 455 coupled to the cross-member 470 through a pair of lower pivots. A radial protrusion located on each lower pivot shaft is operatively coupled to a bearing assembly which is operatively engaged with a groove 480 of the guiding mechanism 455. The bearing assembly operatively coupled to the radial protrusion reduces the frictional coefficient during the operation of the side rail considerably diminishing the wear of the radial protrusion 475 and the edges of the groove 480. The radial protrusions are guided along the guiding grooves 480. The rotational movement around the lower pivots which occurs during operation of the side rail results in a transverse movement of the lower pivots and translates into a transverse movement of the side rail body support towards or away from the longitudinal centerline of the patient support apparatus 10. In the present embodiment, the distance between the side rail body support and the deck support 20 or intermediate frame 90 is at its maximum in this deployed position. Still referring to the present embodiment, the spacing between the support arms 450 and the guiding mechanism 455 of the cross-member 470 is diminished as the side rail body is lowered. The rate at which the spacing between the support arms 450 and the cross-member 470 is diminished and the lateral transitional movement are defined by the size and shape of the guiding grooves 480 of the guiding mechanism 455. Variations to the side rail can be made in order to get relative spacing between the support arms 450 and the cross-member 470 which varies at different stages of the rotational movement of the side rail body. A single or several lower pivot shafts may have a radial protrusion to operatively be coupled to a bearing assembly which is operatively engaged with a groove 480 of the guiding mechanism 455.

The operation of the side rail is as described above and illustrated in FIGS. 8-11. The distance between the lower portion of the side rail body support and the deck support 20 or intermediate frame 90 is at its minimum in this fully stowed position. FIG. 10B illustrates the absence of an angle between the support arms 450 and the lower edge of the side rail body support, and therefore the absence of pinch points.

In one embodiment, the pivot shafts of the lower pivots engaging the guiding mechanism 455 are screw-type shafts. In this embodiment, the guiding mechanism 455 has treads matching the radial extensions of the screw-type pivot shafts to operatively receive the said radial extensions creating a lateral translation movement of the pivot shafts through a rotation of the pivot shafts. The lateral translation movement is away or towards the guiding mechanism 455 depending on the orientation of the rotational movement applied to the shafts. Using this type of screw-type pivot shaft, one or more lower pivot shafts may to have radial extensions to be operatively coupled to a bearing assembly which can be operatively engaged with treads of the guiding mechanism 455.

In one embodiment the pivot journals or journal bearings can be used between the pivot shafts and their corresponding pivot slots. The pivot journals or journal bearings help reduce significantly the wearing of the pivot shafts and the corresponding pivot slots while also reducing high contact stresses and strain. Within the parameters of the embodiments of the present invention, this is especially useful when applied to the upper pivots because the upper pivots may sustain the heaviest strain during operation of the side rail mechanism due to the upper pivots' relational position from the mattress 155.

During operation of the side rail mechanism, according to an embodiment of the present invention, a force is applied to the side rail body. While operating the side rail mechanism, there may be a substantially lateral force component applied to the mechanism, which could result in binding at the pivot points. This might happen as a result of the application of a force that is not substantially perpendicular to the axes of the lower pivots. To address and minimize such a result, an embodiment may provide a first upper pivot slot being slightly oblong-shaped while the second upper pivot slot is circular. This feature may be particularly advantageous for one hand operation of the side rail where the force applied to the side rail may not be aligned with the travel path of the side rail.

Locking Mechanism

In one embodiment, the side rail may include a locking mechanism configured to allow the side rail apparatus to be locked in a specific position. The locking mechanism includes a locking arm pivotally mounted on the side rail body supported at a first end and having a locking tooth at a second end. The locking arm is biased downwardly by a spring for the locking tooth to engage with a tooth-receiving element mounted on the shaft of an upper pivot. The position in which the side rail body is locked is determined by the position of the tooth-receiving element mounted on the shaft of an upper pivot. The locking mechanism may include a one-hand lock release mechanism 700 to unlock the side rail from its locked position to permit the moving of the side rail body 425.

Damper Mechanism

In one embodiment the movable side rail apparatus incorporates a damper mechanism. FIGS. 8-11 illustrate various views of the damper 535 when the angle 515 between the support arm and the cross-member 470 is approximately 70, 30, 0, and −35 degrees respectively. As the side rail body lowers relative to the cross-member 470, the angle 515 diminishes. The cross-member 470 is fixed to either the deck support 20 (for the head-end side rail 415) or the intermediate frame 90 (for the foot-end side rail 420) and therefore may not move when the side rail body moves.

The damper mechanism comprises a spring 525, a link member 530, and the damper 535 operatively connected with the cross-member 470 of the side rail. One end of the spring 525 is coupled to the cross-member 470 and the other end is coupled to the link member 530. The link member 530 is coupled to the cross-member 470 with links 540 that move proportionally to the rotation of the support arms 450. One end of the damper 535 is coupled to the cross-member 470 and the other end is coupled to a link 540.

The damper mechanism slows the downward, lowering movement of the side rail body 425. The damper mechanism prevents the side rail body 425 from descending to at an undesirably fast rate due to the gravitational, or other applied force acting on the side rail body 425. The skilled worker will appreciate that the tension in the spring 525 changes with movement of the side rail body 425 and damper 535. For example, as the side rail body 425 descends, the link member 530 displaces longitudinally, thereby increasing tension in the spring 525.

Based on the shape of the support arm 450 and the angle 515 it forms with the cross-member 470, the cross-member angle 515 may vary with side rail position. In this embodiment, as can be seen in FIGS. 8A-C, when the side rail body is fully raised or deployed, the cross-member angle 515 is about 70 degrees and the damper 535 is extended. At this point, there is relatively low tension in the spring 525.

As the side rail body lowers to a partially deployed position (see FIGS. 9A-B) the cross-member angle 515 decreases to about 30 degrees, and the link member 530 is displaced horizontally. The damper 535 is partially extended at this point.

FIGS. 10A-B depict a side rail angle of about 0 degrees at which point the side rail body is in a partially stowed position. The link member 530 has displaced even further and the damper 535 is partially closed.

FIGS. 11A-B depict the side rail body in a fully stowed position. The side rail angle is about 35 degrees past the horizontal and the damper 535 is fully closed. Since the link member 530 is at its maximum displacement, the tension in the spring 525 is relatively high.

The magnitude of effect on the lowering movement is called the damping coefficient. For the adjustability of the damping coefficient, the stiffness of the damper may be adjusted, thereby impacting the damper's degree of damping. The illustrated damper mechanism can use elastomeric pads which may be identified by color coding corresponding to the desired damping coefficient. As the damper mechanism of the illustrated embodiments is installed in the side rail mechanism to dampen the downward motion of the side rail body (i.e., resisting the downward forces on the side rail), the range of desired damping coefficients is not large.

The damper mechanism can further act as a shock absorber by decreasing the amplitude and frequency of the mechanical oscillations (stretch and compression) of the spring 525. As such, the damper mechanism eliminates or progressively diminishes the vibrations or oscillations of the side rail body, thereby resulting in smoother movement from the fully deployed to the fully stowed positions.

The use of a damper mechanism with the side rail movement may achieve a smooth movement of the side rail body, which may improve the feel for the user and potentially eliminate noise and possible damage or injury caused when a side rail body is dropped from the raised position.

Relative Positioning of Side Rail

In various embodiments, the side rail or side rails 415, 420 are positioned on a first side of the patient support apparatus 10 and may operate in a mirror fashion to the side rail or side rails 415, 420 located on the other side of the patient support apparatus 10, such that the side rail on one side of the mattress 155 operates in the opposite rotational direction (clock-wise/counter clock-wise) to the corresponding side rail on the other side of the patient support apparatus 10, and where the longitudinal movement of the side rail bodies would be in the same direction. Alternatively, the patient support apparatus 10 may have other configurations such as one side rail on one side and two side rails on the other. When a patient support apparatus 10 comprises two side rails 415, 420 on a single side thereof, the relative rotational movement of these two side rails 415, 420 may be opposite in order to avoid impact therebetween, for example when only one of the two side rails 415, 420 is moved between a raised and lowered position.

Structural Barriers—Headboard and Footboard

According to one embodiment of the present invention, the headboard 160 and footboard 195 may be individually molded using a gas-assist injection molding process. Gas-assist injection molding is a known molding process that utilizes an inert gas (normally nitrogen) to create one or more hollow channels within an injection-molded plastic part that may not typically used to produce products of similar size and shape to headboard 160 and footboard 190. During the process, resin such as polypropylene is injected into the closed mold. It is understood that any other suitable material, such as ABS, nylon, or any other resin compatible with the process may be used. At the end of the filling stage, the gas such as nitrogen gas is injected into the still liquid core of the molding. The gas then follows the path of the least resistance and replaces the thick molten sections with gas-filled channels. Next, gas pressure packs the plastic against the mold cavity surface, compensating for volumetric shrinkage until the part solidifies. Finally, the gas is vented to the atmosphere or recycled. Advantages to using such a process over other molding processes are known to a worker skilled in the art.

The headboard 160 may be made of one piece. FIGS. 1-3, 25, and 26 depict an embodiment the headboard 160 of the present invention. The headboard 160 may be a curved removable headboard which is sturdy, light weight, and easy to access and manipulate by the user.

Typically, medical professionals may desire access to the head section 25 of a hospital bed to position equipment proximate to the patient's head. In urgent situations, such as when the patient requires immediate medical attention, immediate access to the head section 25 may be required. In both such situations, the headboard 160 must be moved away from the access area or completely removed from the bed. For a headboard that is removed from the bed, it may be desirable that such headboard be as light as possible, while still maintaining sufficient structural integrity. Once removed from the bed, the headboard 160 is typically placed within the near vicinity, such as by leaning against a support surface such as a wall proximate the bed.

The headboard 160 of the present invention may be a one-piece unit that is less costly to manufacture and more reliable than headboards having multiple parts and requiring assembly. With no additional parts to attach to the headboard, there may be fewer parts that are subject to mechanical failure.

The design of the headboard mold, and therefore the bed's headboard, are unique. The headboard 160 may have a generally rectangular shape. A generally tubular channel 170, which is hollow, borders the headboard 160 at both sides and the top, tapering inwards towards the bottom and terminating in two opposite ends that project below the generally rectangular portion 175 of the headboard 160. Proximate each end may be a generally oval post (similar to post 185 in FIG. 16) for removably mounting the headboard 160 into mounting sockets (not shown) proximate the first end 35 of the head section 25.

Optionally, to avoid damaging the headboard 160 when it is resting on the floor and against a wall, for example, a cap, cover, or plug 190 made of a non-slip material such as rubber, may be fitted around an end of each post. Additionally, the plug 190 may ensure a snug fit into the mounting sockets and minimize wear on the posts. The plug 190 may alternatively be attached to or molded into the headboard 160.

The generally rectangular portion 175 of the headboard 160 may comprise a flat thin layer of headboard skin, such as of molded resin, which encloses the tubular channel 170. In one embodiment of the present invention, the headboard skin has a thickness of about ⅛ inch. It will be appreciated that the thickness of the headboard skin and tubular channel 170 is proportional to the amount of material required and the weight of the headboard. The headboard 160 may be translucent or transparent, such as for easier monitoring of the patient or better visibility.

The headboard 160 may have a gradual concave shape such that when the posts are fitted into the mounting sockets, the center of the headboard skin is further from the head section 25 than are the posts. The concave shape may provide stability or structural strength to the headboard 160.

In operation, users may grasp the tubular channel 170 at both sides of the headboard 160 and lift upwards to remove the headboard 160. Optionally, one or more holes or recesses of various shapes and sizes may be located within the headboard skin to allow users to conveniently grasp the headboard 160 prior to removal or installation. Installation may be accomplished by aligning and inserting each post into the mounting sockets.

Plug on Headboard and Footboard

Figure 15:
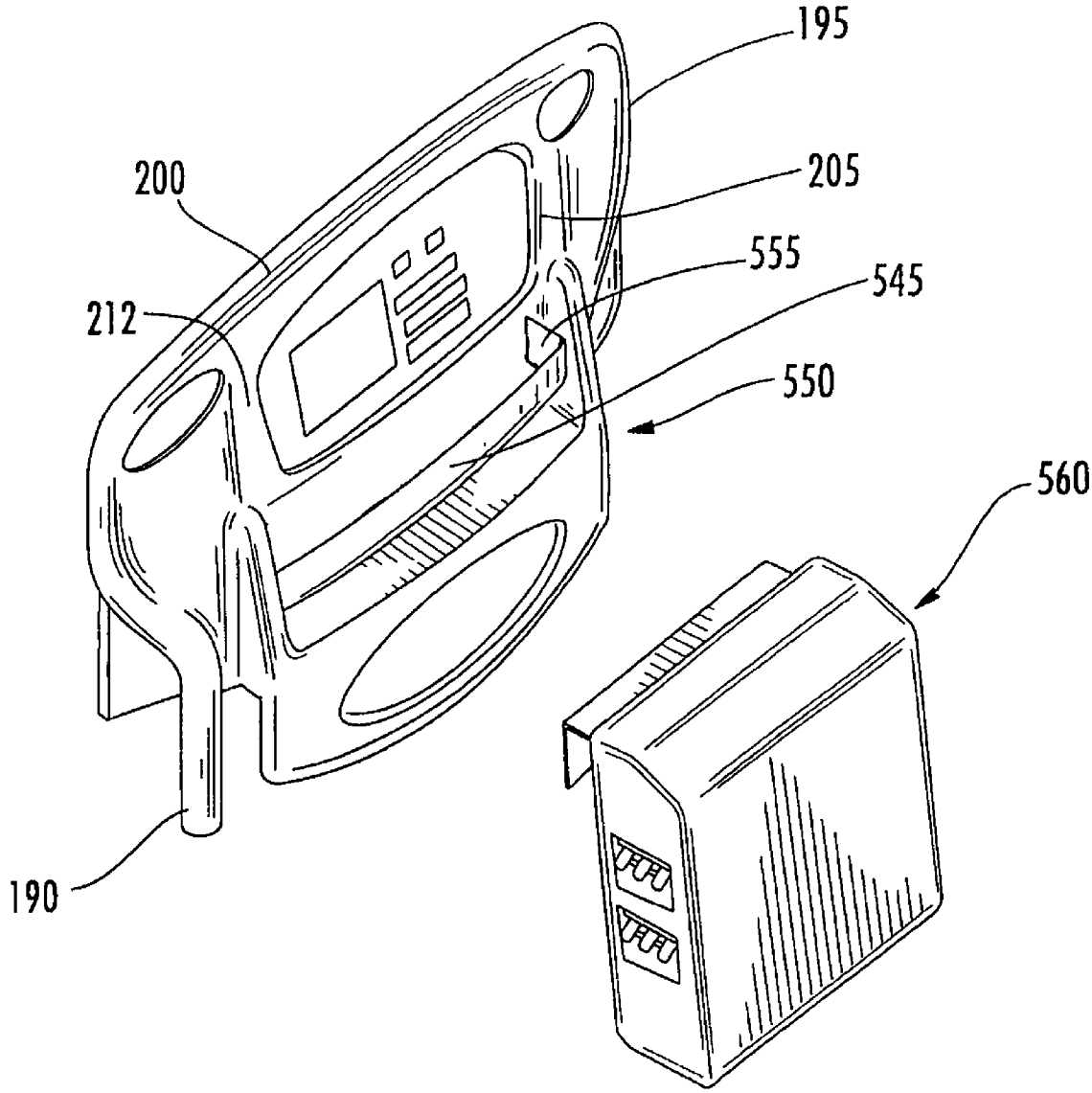
FIG. 15 depicts an embodiment of an accessory or equipment holder coupled to the footboard and equipment which removably attaches thereto.
Figure 16:
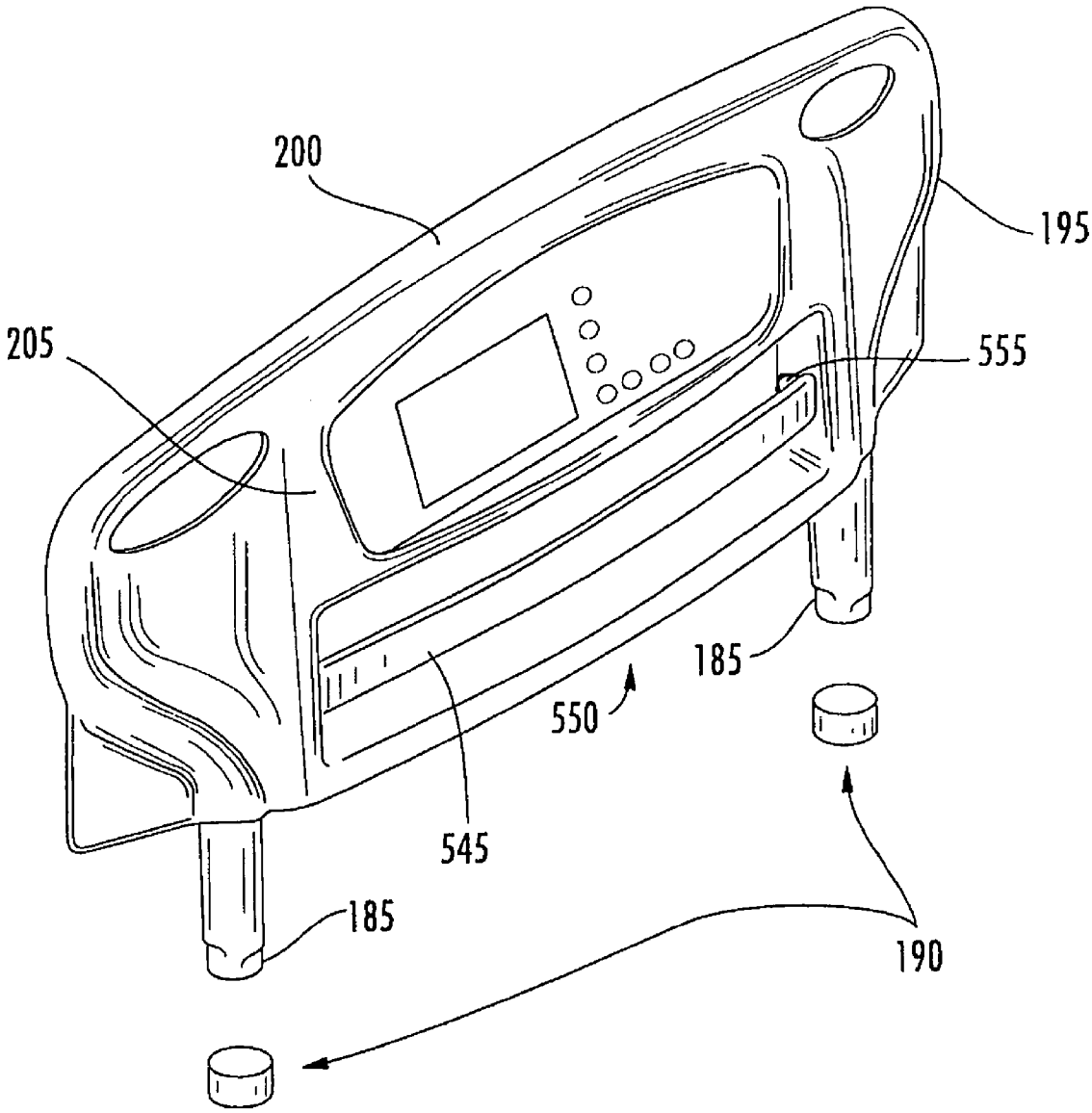
FIG. 16 depicts another embodiment of the accessory or equipment holder coupled to the footboard with the caps removed.

FIGS. 15-16 depict caps, covers, or plugs 190 that may be made of rubber, such as foam rubber or other suitable non-slip material, which are attached to the legs or posts 185 of the footboard 195. As described above, plugs 190 may also be attached to the legs or posts of the headboard 160. The purpose of the caps, covers, or plugs 190 is to increase the friction of the legs of the headboard 160 or footboard 195 and thereby prevent slipping. Thus a headboard 160 or footboard 195 with which the plugs have been incorporated may be safely leaned against a wall until the headboard 160 or footboard 195 is re-attached to the bed.

In order to fit plugs or caps 190 to the footboard legs 185, the leg ends may be dipped into a liquid which later hardens to form the plugs. The plug 190 may be smaller in size than the hole into which it is inserted in order to allow for ease of insertion and removal. Plugs 190 may be permanently left on the footboard 195 in order to reduce loss. FIGS. 4, 5, 15, 16, 25, 27, and 28 depict footboard 195 embodiments of the present invention. The footboard 195 may be formed using a similar gas-assist injection molding process as the headboard 160. The footboard 195 may have a generally rectangular shape. A generally tubular channel 200, which is hollow, borders the footboard 195 at both sides and the top, tapering inwards towards the bottom and terminating at two opposite ends, which may project below the generally rectangular portion 205 of the footboard 195.

Proximate each end of tubular channel 200 may be a generally oval post 185 for removably mounting the footboard 195 into mounting sockets (not shown) in the bed. Similar to the plug 190 used with each post of the headboard 160, a plug or cap 190 can be fitted into or around each footboard post 185.

The generally rectangular portion 205 of the footboard 195 may be made of a footboard skin, such as a thin layer of resin, which encloses the tubular channel 200. Optionally, one or more holes or recesses of various shapes and sizes may be located within the skin to allow users to conveniently grasp the footboard prior to removal or installation.

A controller 600 and a holder support 550 may be attached to the footboard 195 (FIG. 15). With a controller 600 attached to the footboard 195, a back panel (not shown) may be attached to the footboard 195 to secure and protect the controller's electronic components. The controller 600 has a housing 212 and a display 610 with which the user can interface, as described further herein.

The housing 212 may be of any shape or size. The board zone of the housing 212 may generally be shaped to accommodate the interface. In one embodiment depicted at FIGS. 27-29, a generally rectangular controller 600 and housing 212 may be located at the board zone in the upper middle half of the footboard 195. The housing 212 may optionally be positioned at an angle such that a user peering down at the housing 212 from a position above is afforded a substantially unobstructed perspective of the console. The controller 600 may be located in the housing 212 and adapted for connection such that it is movably connected to the bed by a coupling device, such as described in copending application Ser. No. 11/588,726, filed Oct. 27, 2006, entitled Ergonomic Control Apparatus for a Patent Support Apparatus, which is assigned to Stryker Canadian Management of Canada and which is incorporated by reference herein in its entirety.

Holder Support on Footboard

Below the console, generally in the lower middle half of the footboard 195, may be located the accessory or equipment support 550 comprising a horizontally disposed holder bar 545. The holder support 550 may be integrated to the footboard 195, or may be connected to the footboard 195 such as with bolts, screws, adhesive or other connection means. The holder bar 545 may be used such as to hang extra equipment 560, as demonstrated in FIG. 16. Equipment 560, such as pumps, may be temporarily positioned on the holder bar 545, as opposed to the top edge of the footboard 195, to avoid obstructing the view and access to the console.

An accessory or equipment support 550 that is integrated with the footboard 195 of a hospital bed may be provided. This support 550, depicted in FIGS. 15-16, may provide a means by which pumps or other hospital equipment 560 may be held from the footboard 195 in a secure manner, without interfering with the controls on footboards. The utility of such a holder is not solely confined to footboards of hospital beds, and may also be used on headboards or side rails, for example. Moreover, such a holder may be used to support or hold accessories other than pumps and equipment 560 such as, for example, patient charts, a pouch to place personal effects, etc.

In one embodiment, the support 550 may be manufactured from aluminum and may have a holding capacity of 200 lbs. For example, and not to be construed as limiting in any way, a torsional test to verify the connection of the bar 545 and support 550 to the footboard 195 may be conducted by hanging 200 pounds weight from the bar 545 at a distance of about five inches from the bar's longitudinal axis. The holder bar 545 may be shaped in a manner to match the aesthetic character of the footboard 195. The holder bar 545 may be connected to two support struts 555 (typically bolted), one on each end of the holder bar 545, for connection to the footboard 195 and such as to enable the desired torsional resistance and bending capacity of the holder bar 545, when the desired accessories or equipment are attached thereto (FIGS. 15 and 16). In one embodiment, the struts 555 may be connected to holder 550 in the shape or an "I". The holder bar 545 may be placed within the existing footprint of the bed to reduce the likelihood that the bar 545 will be used improperly.

The position of the holder bar 545 within a recess (not shown) of the footboard 195 may be configured to enable the placement of equipment 560 on the holder bar 545 and so that there is sufficient room provided below the holder bar 545 to enable adequate cleaning of the footboard 195 by hand. To facilitate effective cleaning of the footboard 195 in the region of the holder bar 545, pegs or caps may be placed on the footboard 195 for connection thereto. Many materials for the equipment support 550 may be used, such as alloys, steel, fiberglass, or other resin-based material, to meet the desired structural strength and cleanability requirements for the bed.

The height of the support 550 and/or holder bar 545 may be adjustable or fixed in a variety of locations. Typically the support 550 is positioned on the footboard 195 in a manner not to impede use of or access to the control panel.

Possible advantages to having an equipment support 550 on the footboard 195 of a hospital bed include providing an appropriate holder for equipment, providing a safe hanger which can support the load of equipment, providing complete access to foot controls, and reducing the likelihood that hanging equipment will be broken.

Positioning the holder bar 545 such that equipment 560 hangs below and away from the interface reduces the risk of damage to the console and footboard 195. Hanging equipment 560 from the holder bar 545 may also reduce the amount of motion transmitted to the bed, which may disturb the patient. Additional advantages of using the holder bar 545 to hang equipment 560 include reducing the risk of damaging equipment that might otherwise be hung on the top edge of the footboard 195, creating heightened risk of falling or sliding off the footboard 195.

Power and Control Systems

Powering Bed Electronics with or without a Battery

A means is provided for facilitating the operation of the electronics in the patient support apparatus 10 without a battery.

In one embodiment depicted in FIG. 25, power from a source external to the bed, such as a conventional AC source 230, may feed into separate circuits, one to recharge the battery 235 and another to provide power directly to the electronic systems. In this manner, when the apparatus is connected to power supply 230, the battery 235 may be recharged as needed and the electronic systems may operate concurrently with external power that bypasses the battery 235. The battery 235 may be located anywhere within the patient support apparatus 10, or the power supply apparatus 10 may be operated without the battery 235.

When the apparatus 10 is connected to an external power source 230, the electronic systems may be energized regardless of the usability of the internal battery power. The power feed configuration of the apparatus may preserve the life of the battery by avoiding problems that may arise when the battery 235 is recharging and variable power demands are placed on the recharging battery by the operation of the apparatus' electronic systems.

Activation of Brake Mechanism

A low force braking system comprises a foot actuated manual override or foot pedal or handle 310. It further provides one or more brake control panels 295, 165 located proximate the bed's head-end, or located other places, and a backup foot control mechanism. The brake control panels 295, 165 may activate the brake electrically, hydraulically, pneumatically, mechanically, or magnetically.

Figure 2:
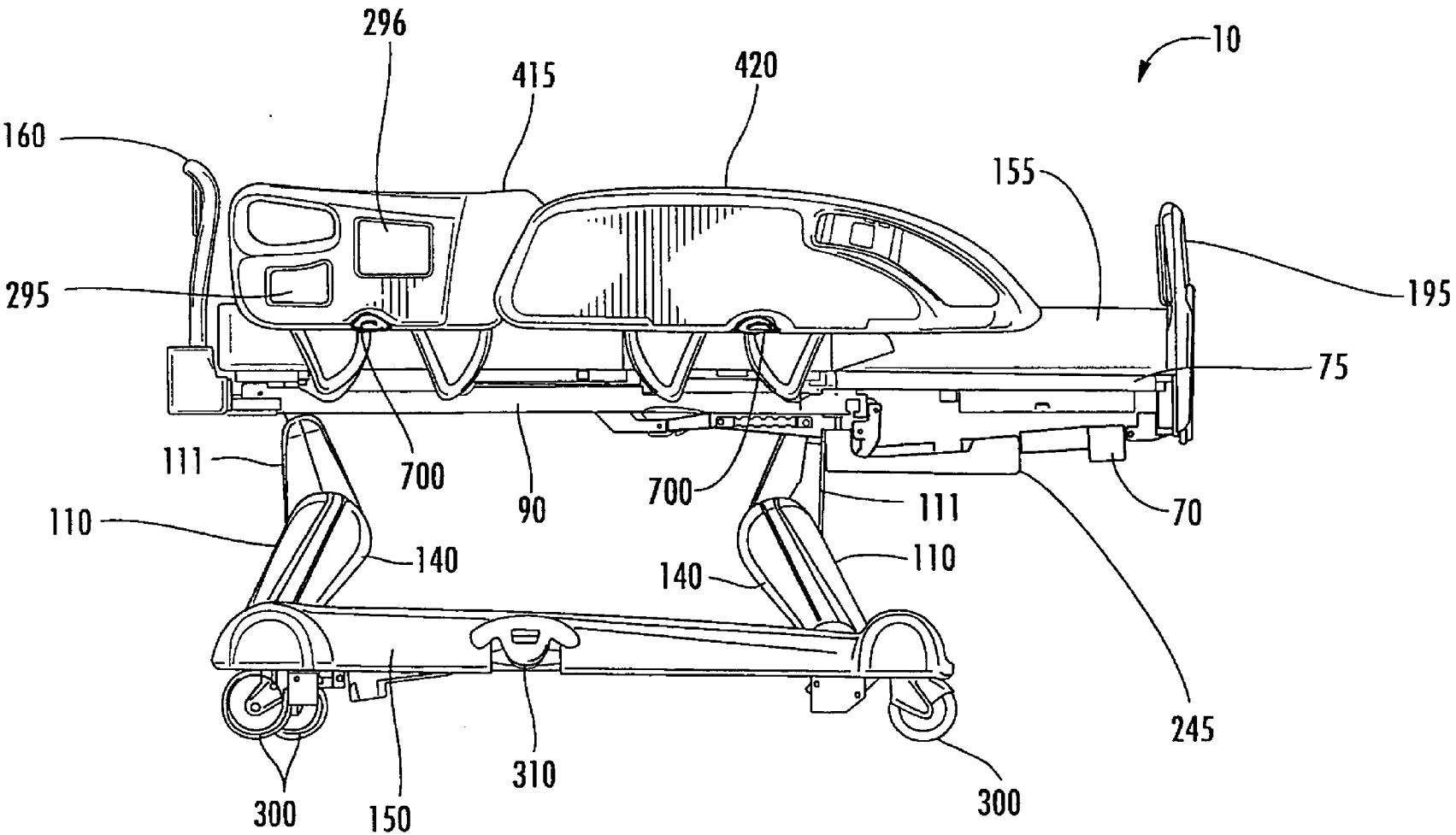
FIG. 2 is right side view of an embodiment of the patient support apparatus 10.
Figure 31:
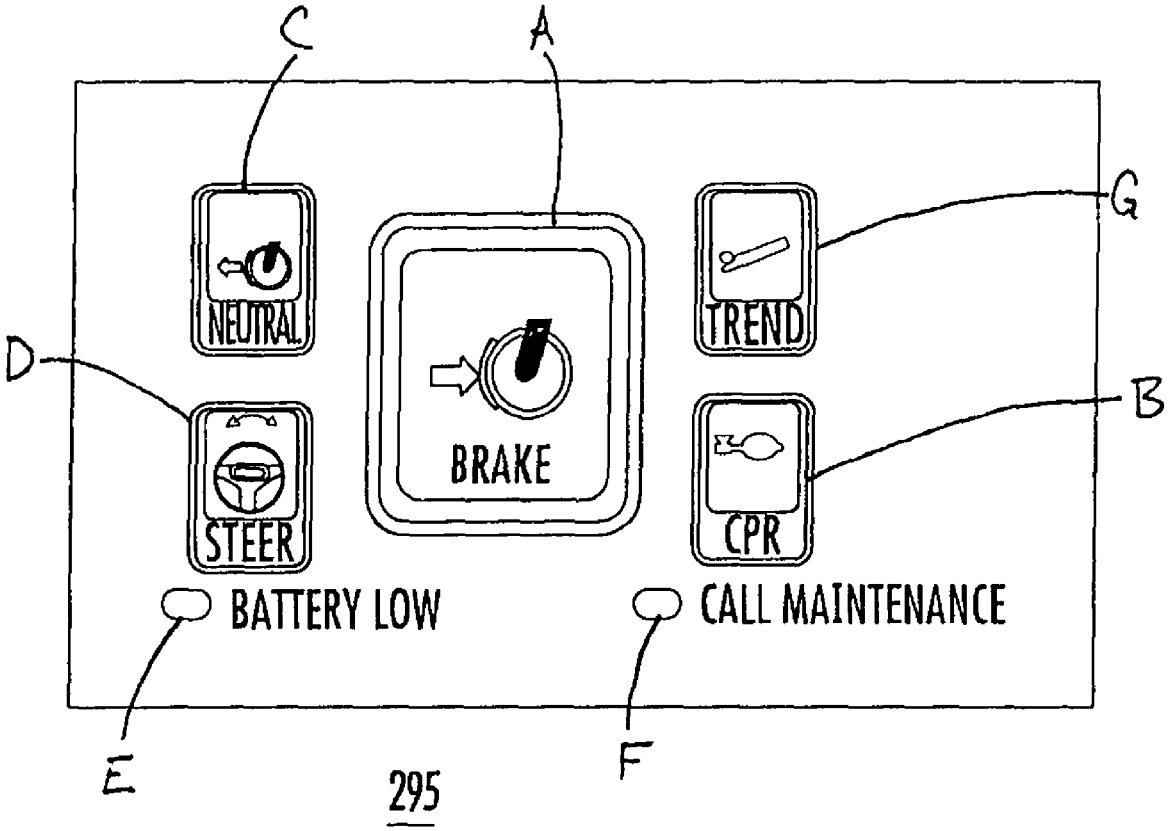
FIG. 31 depicts one embodiment of the functions of a brake control panel 295 located on the exterior of the head side rails proximate the control panel of FIG. 30A-B.

In one embodiment, the user can activate the brakes on one or more control panels 295 located on the exterior of the head-end side rails 415 within the vicinity of the headboard 160, as depicted in FIGS. 1, 2, and 31. Brakes may also be activated from other control panels 600, 260, 165. For example, some common brake functions on the foot control panel 600 are depicted in FIGS. 28-29. The brake controls may comprise three push buttons corresponding to brake, steer, and neutral. The buttons may be coupled to a motor or actuator 315 that activates or deactivates the braking system. The override system may be integrated into the braking mechanism and may be configured as a pedal.

The positioning of the brake controls on one or more control panels 295 allows the user to more easily access and activate the brake mechanism, without regard to the positioning of the side rail on the same side as the foot pedal 310. Thus, when the side rail is in the lowered position, or when the bed itself is in a low position, possibly restricting access to the foot pedal 310, the braking mechanism can still be controlled.

In one embodiment, the brake control is located proximate the push handles 330 and can be engaged or disengaged without removing the user's hands from the handles. Typically, there are two push handles 330 located in front of the headboard 160, which can actuate a motor to move the bed. The bed rolls in the direction guided by the user controlling each push handle 330. When force is not exerted on the handles, the motor may decelerate, and eventually come to a halt, such as within 4-10 seconds. Alternatively, or in addition to push handles 330, headboard 160 may be equipped with pressure sensors or buttons, load cells, heat sensors, or the like to send a drive signal through the controller # to the motor #, allowing a user to send drive and/or brake signals by pushing or pulling the headboard 160 or a signal-input portion thereof.

While the brake mechanism may be used to assist in bed deceleration, such use may be atypical, such as when the bed is operated at slow speeds. Furthermore, if a patient is in the bed, use of the brake during bed displacement may cause discomfort. The brake may typically be used to secure a stationary patient support apparatus 10, similar to the use of an automobile's hand brake.

Figure 3:
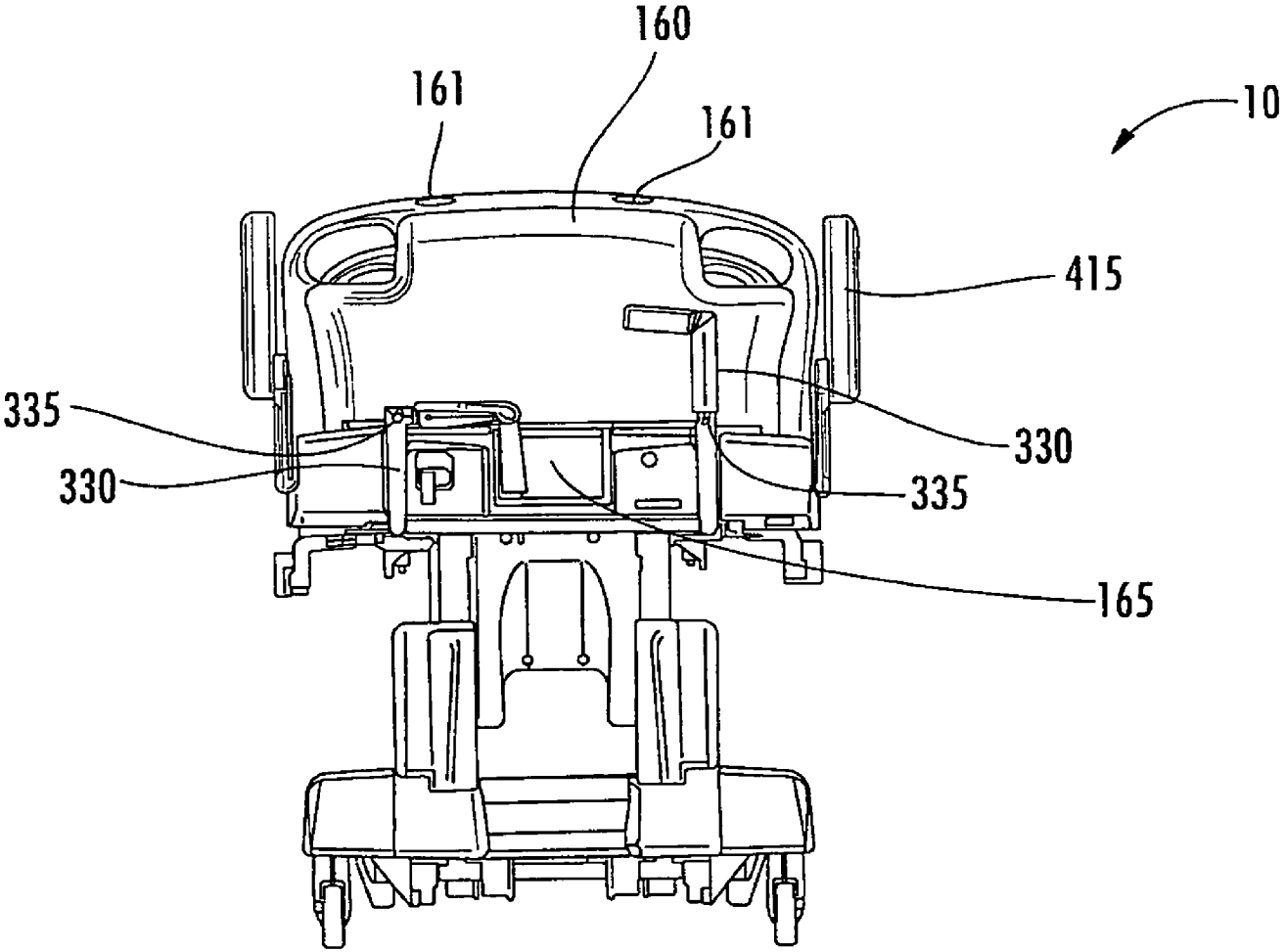
FIG. 3 is a front view of an embodiment of the patient support apparatus 10 in which the right push handle is in the working position and the left push handle is in the stored position.

As depicted in FIG. 3, when not being used to displace the bed, one or both push handles 330 may be placed in a stored position such as by removing them from the bed or by folding them inwards at one or more pivot points 335. Typically it is convenient to access or remove the headboard 160 when the push handles 330 are stored.

The brake itself may comprise a movable member that engages a wheel 300. The brake may be a cam that pushes on the wheel 300, an axle, or a brake disk or drum, for example. The brake system may be usable on heavy beds and may be adaptable to different braking systems.

The backup foot pedal 310 may provide alternate braking means, such as during a power failure. In one embodiment depicted in FIGS. 1-2, the foot pedal 310 is located on the right side of the bed proximate the middle of the bed. A status indicator 390 may be located close to the pedal to visually indicate whether the brake is disengaged (steer position), engaged (brake position), or neutral (off position).

Figure 17C:
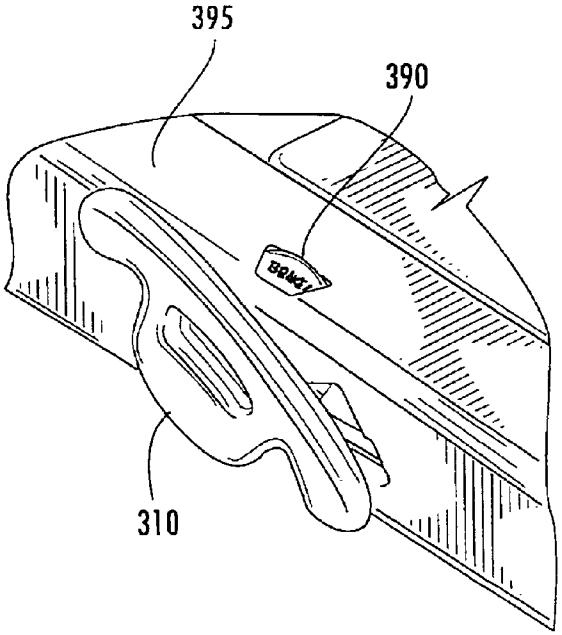
FIGS. 17A-C are perspective views of the brake manual override in three positions, depicted on the status indicator 390: steer (directional wheel), off (neutral) and brake.
Figure 17B:
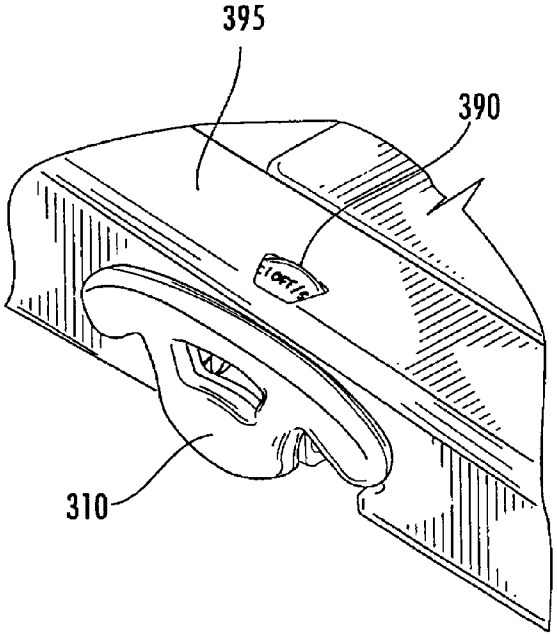
Figure 17A:
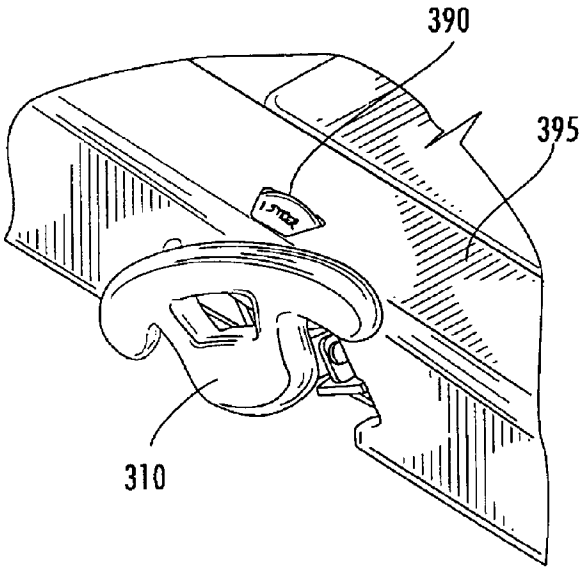
Figure 18:
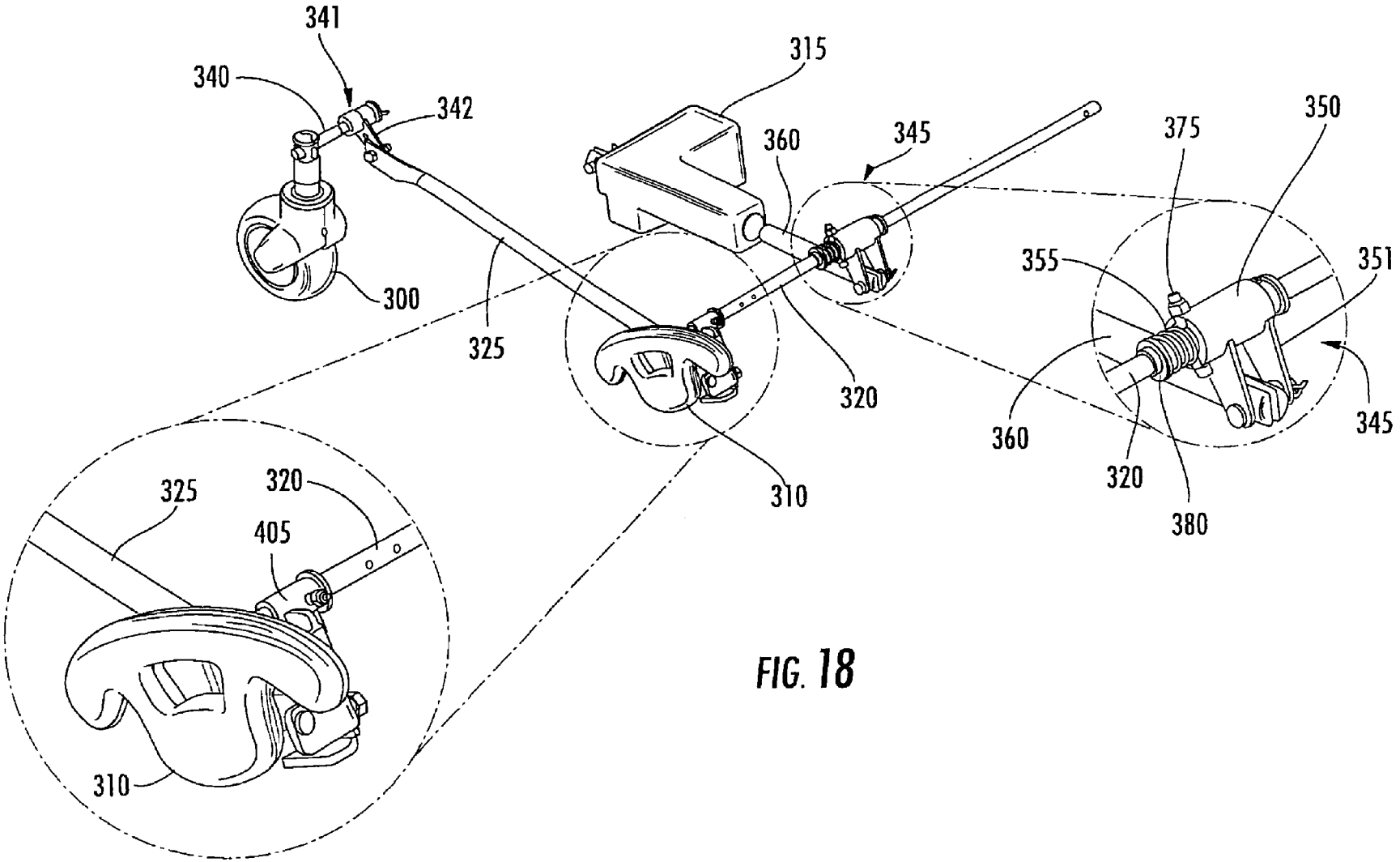
FIG. 18 is a perspective view depicting the activation of the brake mechanism, with enlarged detail of the brake manual override and actuator in the directional wheel position.
Figure 19:
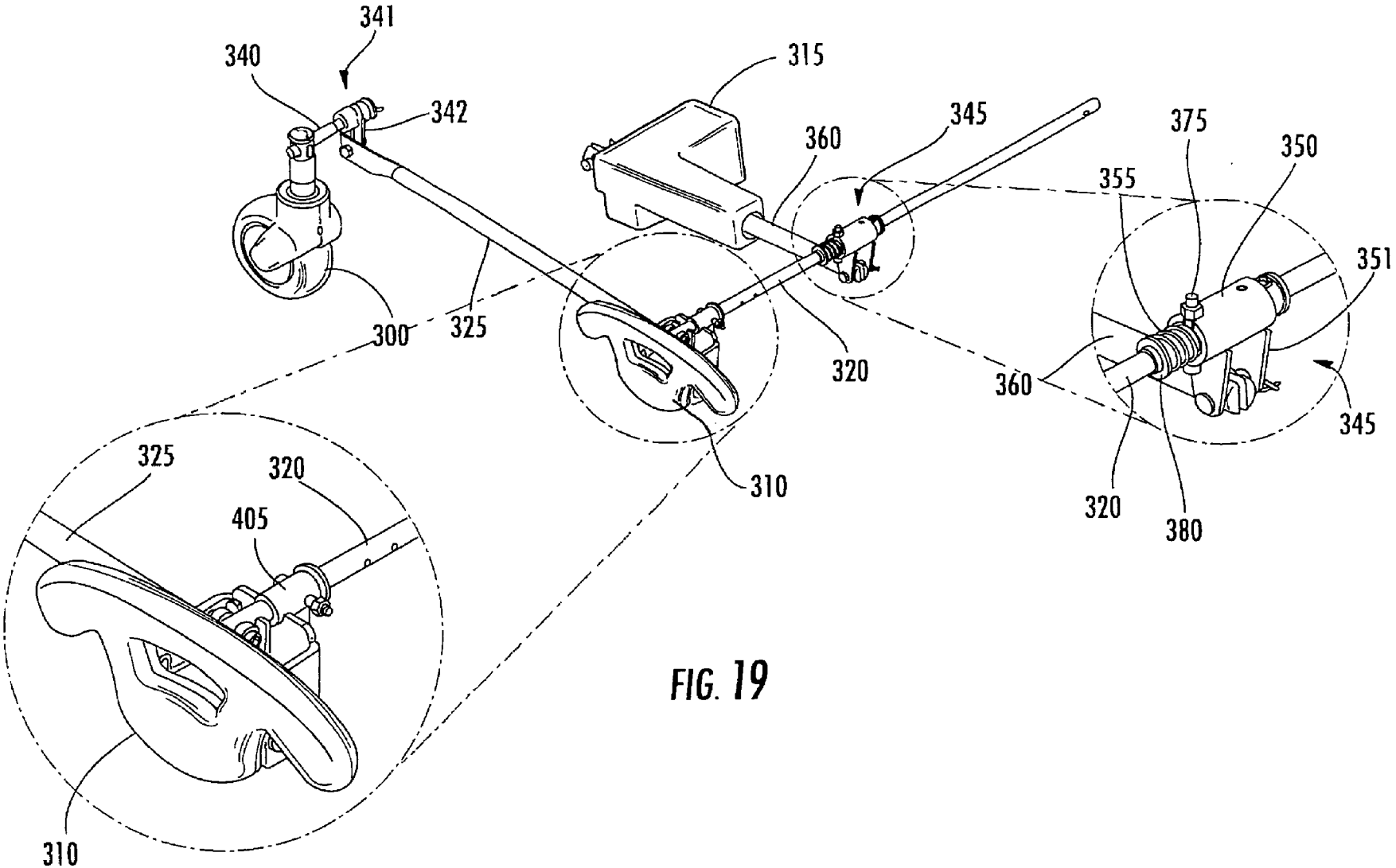
FIG. 19 is a perspective view depicting the activation of the brake mechanism, with enlarged detail of the brake manual override and actuator in the neutral position.
Figure 20:
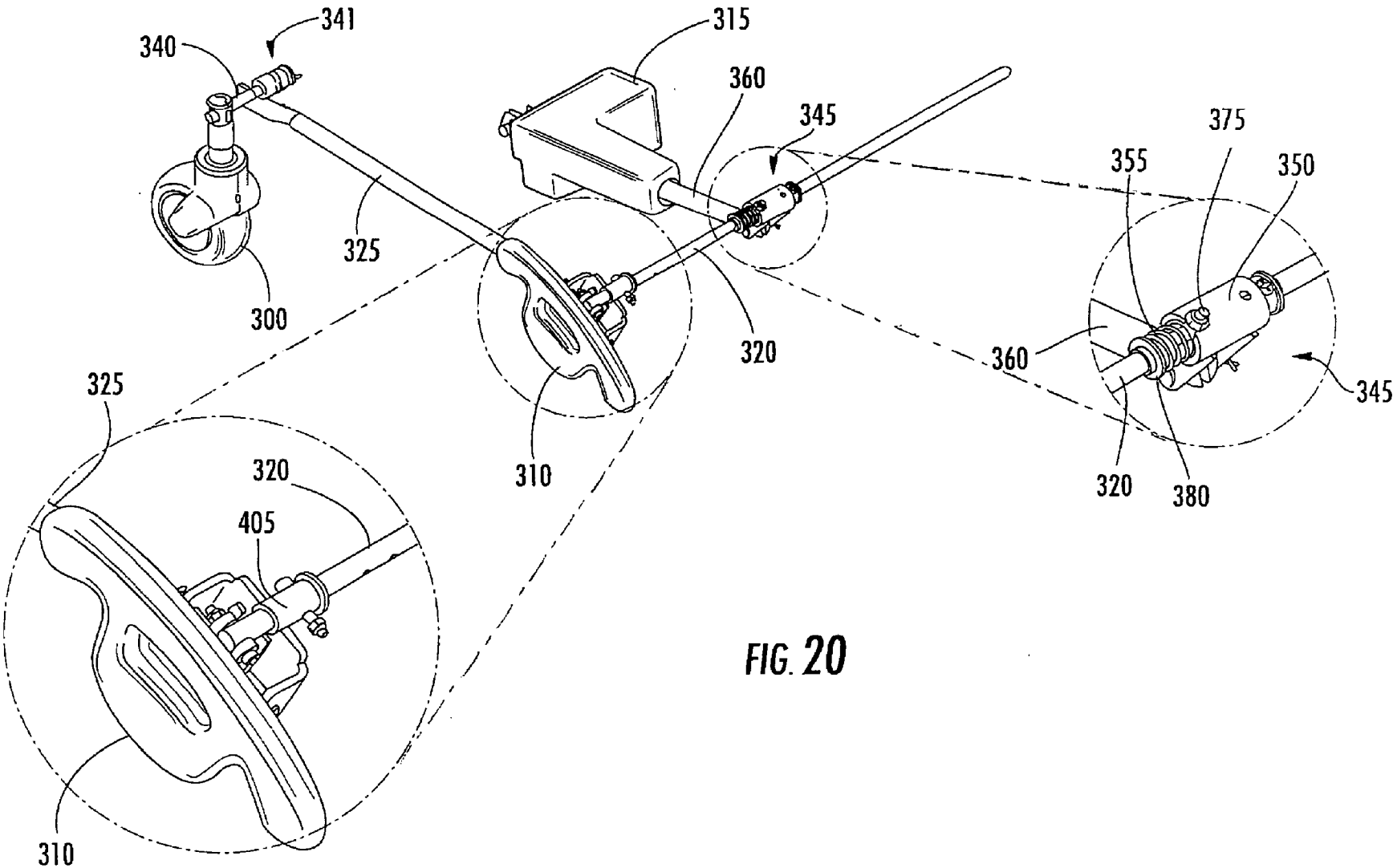
FIG. 20 is a perspective view depicting the activation of the brake mechanism, with enlarged detail of the brake manual override and actuator in the brake position.

As shown in FIGS. 17A-C, the pedal 310 may be of a shape that is convenient for foot manipulation by the user, such as with a hole sufficiently large in which to temporarily place at least part of the foot and with one or more laterally extending wings with which the foot may leverage the pedal. Manipulation of the pedal 310 is possible, but may be less desirable than foot operation.

The exemplary braking system depicted in FIGS. 18 to 23 will now be described in greater detail. The braking system is generally configured to immobilize the casters 300 from rotating such that the patient support apparatus 10 is substantially mobilized, and/or from pivoting such that a direction of the caster 300 is stabilized to facilitate, for example, steering of the patient support apparatus 10. In the latter case, pivotal braking may be limited, for example, to two of the four casters 300 such that an operator of the patient support apparatus 10 may select an orientation of the bed displacement by pivoting two of the casters 300, while using the pivotally locked casters 300 to facilitate this directional displacement.

The braking system is configured such that a motorized control of the system is imparted via a single motor or actuator 315. In particular, the actuator 315, controlled or operated from one or more control means such as brake handles, or user accountable devices, such as push buttons and the like (discussed further below with reference to the control system), are used to mechanically activate a locking mechanism on each of the casters 300. A person of skill in the art will understand that, although the present embodiment is described as including a single actuator 315 for all four casters 300, a similar braking system could be designed to include one such actuator for each caster 300, or again, one actuator for each two casters 300 (e.g. an actuator to control the head-end casters 300 and a second actuator to control the foot-end casters 300). Other combinations of actuators for any number of casters are also contemplated herein without departing from the general scope and nature of the present disclosure, as will be readily understood by the person skilled in the art.

The braking system generally comprises a central levering mechanism 345 operatively interconnecting a driven member 360 of actuator 315 to lateral levering mechanisms 345 on each side of the base frame 150 via a lateral or transversal shaft 320. The lateral levering mechanisms 345, one of which is illustratively coupled to a manual override actuation pedal 310, are themselves configured to actuate the brake mechanism 341 on each caster 300 via longitudinally extending brake actuator bars 325 configured such that a substantially linear displacement thereof pivots respective brake actuating levers 342 configured to operate the respective brake mechanisms 341 of each caster 300. Contemplated brake mechanisms 341 may include, for example, a locking cam or the like configured to selectively immobilize a given caster 300 from rotating and/or pivoting, depending on the type of caster used. It will be understood that other braking mechanisms may be considered herein without departing from the general scope and nature of the present disclosure. Commercially available braking mechanisms are available, such as from Tenet International GmbH. Furthermore, different braking mechanisms may be used for different casters 300, depending on the intended purpose and use of such brake mechanisms.

In particular, the central levering mechanism 345 comprises a sleeve member 350 that is slid toward the center of shaft 320 and coupled to the driven member 360 via flanges 351 extending radially outward therefrom. A bolt or pin 375 is further provided through the shaft 320 and biased within a notch 370 formed in through a periphery of the sleeve 350 by a spring mechanism 355, thereby operatively coupling the sleeve 350 to the shaft 320 when the pin 375 is so biased, such that a rotation of the sleeve 350 under a pivoting action applied to the flanges 350 by the driven member 360, induces a rotation of the shaft 320. As will be described below, when the override pedal 310 is deployed, the shaft 320 is shifted toward the right such that the pin 375 is released from the notch 370, thereby uncoupling the shaft 320 from the sleeve 350 and allowing for manual operation of the caster brake mechanisms 341.

The shaft 320 extends across the base frame 150 and through to the lateral levering mechanisms 345 such that a rotation of the shaft 320 imparts a substantially linear displacement of the bars 325. As recited above, displacement of the bars 325 generally translates into operation of each caster's brake mechanism 341 via respective brake actuating levers 342. A protective cover (not shown) may also be provided to hide and possibly protect the bars 325 and other elements of the braking system.

Figures 21A, 21B, 21C:
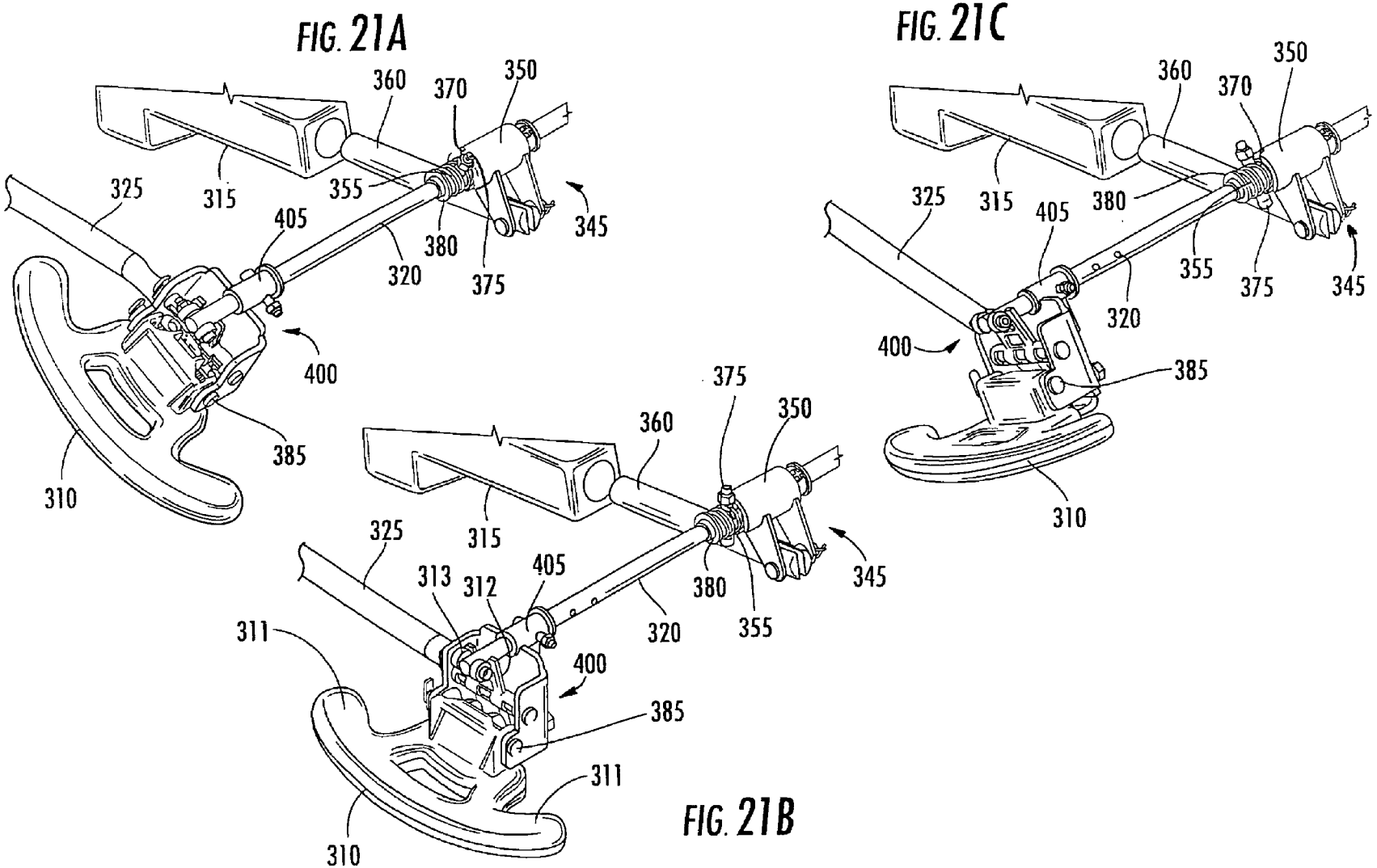
FIGS. 21A-C are perspective views of the emergency manual activation of the brake mechanism wherein the drive member remains in the directional wheel position, and the foot pedal is in the brake, neutral, and directional wheel positions, respectively.
Figures 22A, 22B, 22C:
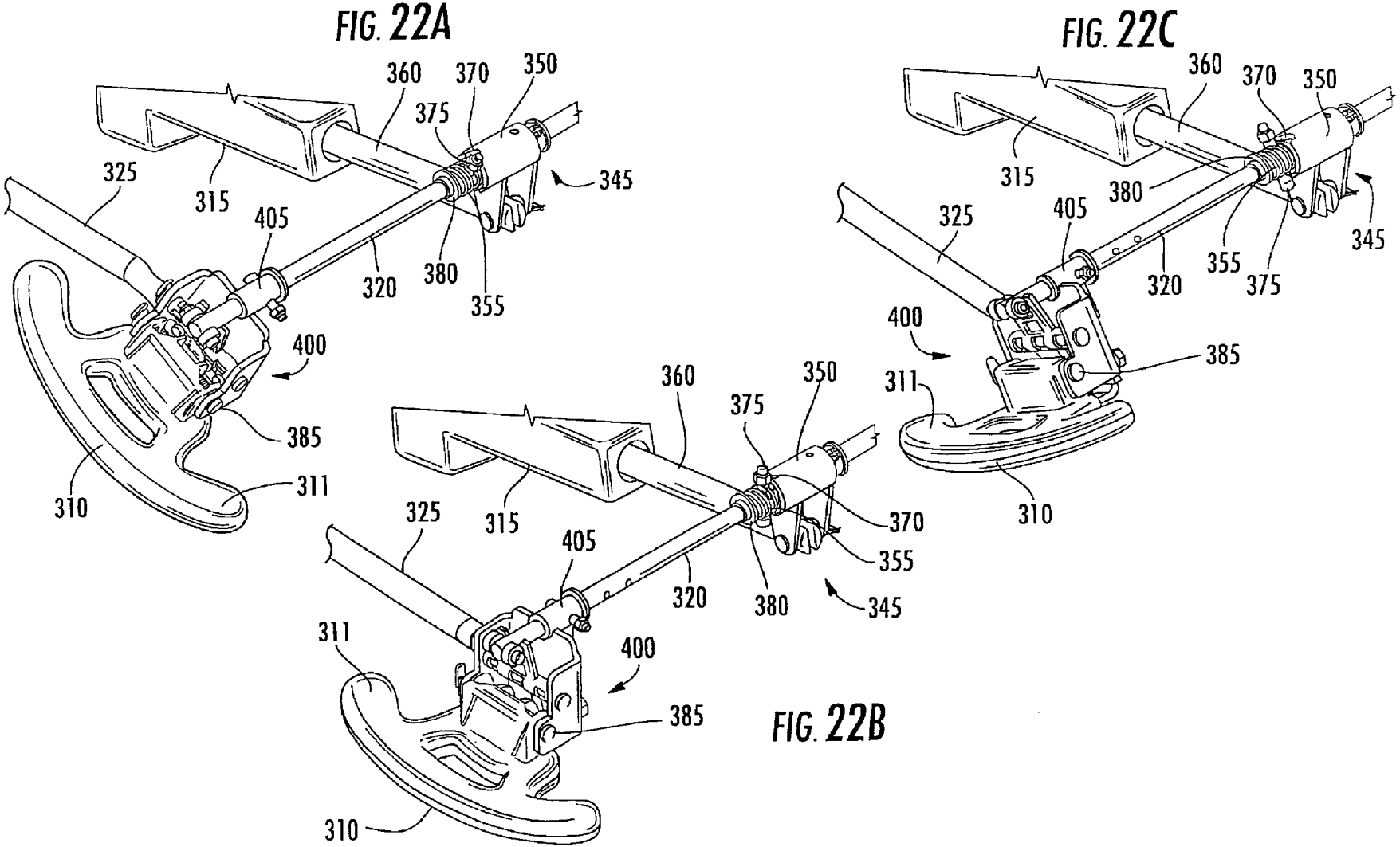
FIGS. 22A-C are perspective views of the emergency manual activation of the brake mechanism wherein the drive member remains in the neutral position, and the foot pedal is in the brake, neutral, and directional wheel positions, respectively.
Figures 23A, 23B, 23C:
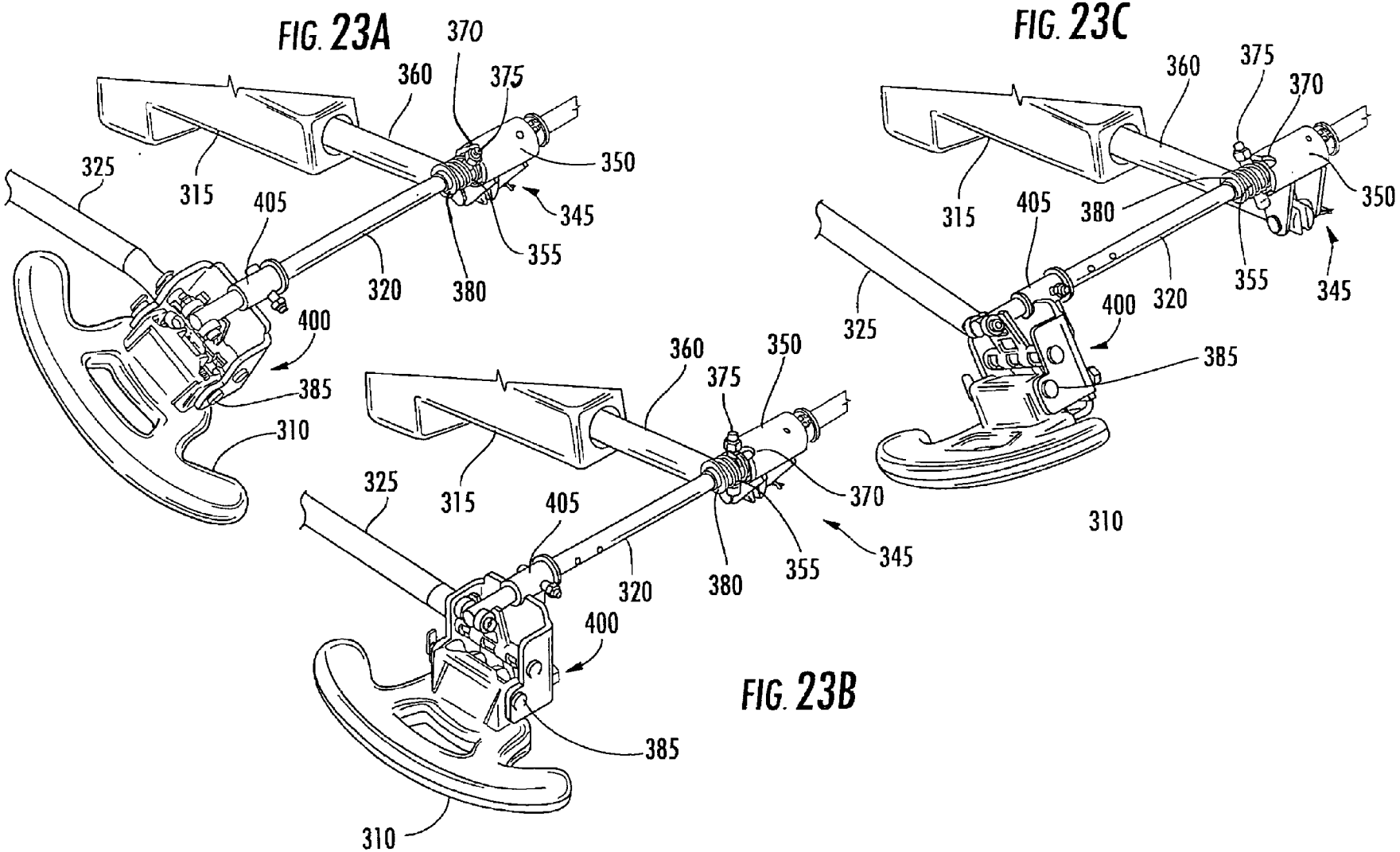
FIGS. 23A-C are perspective views of the emergency manual activation of the brake mechanism wherein the drive member remains in the brake position, and the foot pedal is in the brake, neutral, and directional wheel positions, respectively.

As introduced above, an override pedal 310 may be provided on the right-hand side of the patient support apparatus 10 and may be operatively coupled to the lateral levering mechanism 345 on that side. In general, the override mechanism is practical in situations where the actuator 315 is in a given position and power thereto or to the control system is unavailable, thus preventing the actuator 315 from changing from one mode to another. In one embodiment, the pedal 310 is spring-biased in an upright and stowed position (FIGS. 17-20) such that a downward pivoting force extends the pedal 310 to an operable position in which an operating surface 311 thereof is substantially parallel with the floor (FIGS. 21-23). Furthermore, the pedal 310 may be configured such that when it is stowed, a clearance of about five inches is maintained below the pedal 310 irrespective of the pedal's orientation. Although this clearance may be obstructed when the pedal 310 is engaged, the clearance is regained automatically as the pedal 310 is returned to its stowed position.

When such a force is applied to the pedal 310, a corresponding set of pivoting flanges 312 are configured to pivot and engage a bolt 313 transversally fastened through the end of the shaft 320 such that the shaft 320 is pulled toward the pedal side of the patient support apparatus 10, thereby releasing the pin 375 from notch 370 (FIG. 23) and disengaging the actuator 315 from operative control of the braking system. As a result, control of the braking system may then be provided via the deployed pedal 310 rather than the motorized actuator 315 and controls thereof. When the foot or hand of the operator releases the pedal 310, the pedal springtols the upright position and the pin 375 is again urged toward the notch 3 70 by the spring mechanism 355. Users can visually verify the status of the brake position with the status indicator 390, depicted in FIGS. 17A-C.

FIGS. 21-23 illustrate a manual override function with a motor release mechanism 400 that may be useful such as where the drive member 360 is in a given position and power to the motor 315 or control system is unavailable, thus preventing the drive member 360 from changing from the engaged or disengaged position. Similar to FIGS. 18-20, the protective brake shield 395 and status indicator 390 shown in FIG. 17 are removed in FIGS. 21-23 to demonstrate the mechanics of the mechanism.

The motor release mechanism 400 comprises an end sleeve 405 that is fixed around a portion of the shaft 320 near the foot pedal 310. At the opposite end proximate the drive member 360, the lever 320 is slidably disposed within a center sleeve 350 that comprises a notch 370 into which a lever pin 375 fits. The lever pin 375 is fixed to the shaft 320 adjacent the center sleeve 350. The spring mechanism's spring 355 is disposed adjacent the lever pin 375 between the center sleeve 350 and a fixed raised edge 380 on the shaft 320 in a manner to apply pressure against the lever pin 375.

When a lateral force is exerted on the shaft 320 in toward the center sleeve 350, the lever pin 375 is pushed into the notch 370, locking the shaft 320 in place. Moving to the shaft 320 thus moves the drive member 360. In most operative situations, emergency manual activation of the brake system is not desirable; therefore the shaft 320 and actuator 360 may typically be left locked in place.

As depicted, the foot pedal 310 is part of a motor release mechanism 400 and is capable of opening such as by pivoting about 90 degrees on a longitudinal rod 385 at the base of the foot pedal 310, wherein the rod is substantially perpendicular to the shaft 320. When manual override of the brake system is desired, the user may press down or step on the top of the foot pedal 310 to open it away from the motor release mechanism 400. The foot pedal 310 pivots open on the longitudinal rod 385 (FIG. 23), thereby stopping the application of lateral force against the end of the shaft 320 that had been keeping the lever pin 375 biased into the notch 370. As a result, the spring 355 exerts force against the side of the center sleeve 350, causing the shaft 320 to displace laterally in the opposite direction, towards the side of the bed. The length of such displacement is sufficient for the lever pin 375 to be freed from the center sleeve 350 notch 370. In one embodiment, once it is unencumbered by the center sleeve 350 and drive member 360, the foot pedal 310 and shaft 320 can be moved to the right (toward the foot-end) to engage the brake, to a neutral position (in the center) or to the left (toward the head-end) to allow directional steering, independent of the position of the drive member 360, according to the user's requirements. In such a situation, displacement of the patient support apparatus 10 would not be assisted by the displacement motor.

In order to reactivate the motor actuator 315, the user raises the foot pedal 310 to displace the shaft 320 toward the center sleeve 350, while biasing the lever pin 375 into the notch 370. This is accomplished by turning the foot pedal 310 in one or the other direction (i.e., toward the foot-end or head-end) until the lever pin 375 is biased back to the locked position within the notch 370.

An indication of the brake status (steer/drive, off/neutral, and brake) may be visually displayed on the status indicator 390 and/or on one or more control panel for the benefit of the user. The brake status indicator 390 may reduce the likelihood that the patient support apparatus 10 will be left unattended without the brakes being set. The status of the brakes can also be monitored on one or more control panels by means known in the art.

Automatic brake control may also be a safety feature when the system is in a motion lockout setting, further discussed herein. In a total lockout of motion setting, a lock setting or signal prohibits movement functions from being controlled at a control panel located on the side rails 415, 420, footboard 195, pendant 260, or head panel 160. The brake can be set during the lockout, but, may not be disengaged from a control panel input while a total lockout setting is selected.

Button Activation for CPR and Trendelenburg on an Alternate Energy Source

The speed of the Fowler movement may be increased by boosting the Fowler actuator 710 voltage, thereby increasing the actuator speed. This is illustrated schematically in FIG. 24 where, for example, the voltage to the motor or actuator 710 for bed movement is increased from 12V DC to 24V DC when the user selects a specific function on a control panel. The temporary increased voltage to the actuator accelerates movement of the bed to the desired position.

One embodiment encompasses button activation for CPR and Trendelenburg on an alternate energy-source, such as a battery 235, to transiently increase the voltage supplied to the motor, such that the motor speed is increased. The power needed to lower the head or Fowler section 25 may be low such that the relative load perceived by the motor may be less than the actual load due to gravity. In addition, the motor can support the low duty cycle of the accelerated motion without risk of failure during operation at increased speed.

One advantage to this system is that it provides a convenient means to quickly lower the Fowler section 25, while utilizing the motor-driven mechanism already in place for normal actuation tasks, thereby potentially obviating the need for alternate mechanisms that may take up space on the bed structure or that may be relatively complicated and/or cumbersome to activate.

Another advantage to this embodiment is its ease of activation and safety since accelerated movement of the Fowler section 25 may be quickly and reliably actuated during an emergency with the press of a button, and the accelerated movement is stoppable upon release of the button.

While the described embodiment relies on a motor-driven mechanism which is already in place for normal actuation purposes, the embodiment also may provide a reliable backup mechanism in which the position of the bed can be changed at a time and location in which normal movement may be impeded. Such a backup mechanism may be useful such as during a power outage or if a patient were to suffer cardiac arrest with the bed detached from its conventional power supply.

Movement to the CPR or Trendelenburg positions is possible without electrical power. For ease of operation, this embodiment is powered by a battery 235, however a user may override the power component in order to enable manual movement in the event that the battery loses power. In one embodiment, in order to activate movement to CPR or Trendelenburg positions without using electrical power, the corresponding button on one of the control panels may be pushed and maintained. As discussed further herein, a convenient location for this function may be on a control panel located on the exterior of the headboard 160. This location enables the caregiver immediate access to the patient while placing the patient in the desired position.

A visual indication, such as light indicators, may be viewable from several positions around the patient support in order to indicate low battery power or other system status indicators.

Optionally, and in addition to increasing the speed of the Fowler movement by boosting the Fowler actuator voltage, thereby increasing the actuator's 710 speed, the speeds of the seat section 60 movement and the foot section 75 movement may similarly be increased by boosting the seat section actuator 711 and foot section actuator 712 voltage. The increased speed of the seat section 60 and foot section 75, in addition to the increased Fowler 25 movement speed, to a substantially horizontal position or a CPR or a Trendelenburg position, allows a user to quickly and reliably actuate all three deck support sections 25, 60, 75 during an emergency with the press of a button, the movement being optionally stoppable upon release of the button.

Zoom Control Algorithm

An automatic control for acceleration and deceleration of the motorized auxiliary wheels 300 that are used to move the bed may be provided, thereby allowing for variable bed movement speeds. The automatic control function provides movement assistance to users such as hospital personnel moving the bed, thereby reducing the perceived weight of the bed with or without a patient thereon. The zoom control may adjust the speed of the auxiliary wheels 300 by comparing the drive signal of the auxiliary wheels 300 with the force applied on the push handles 330 by the user pushing the bed, and provides a level of feedback to the user relating to the natural deceleration of the bed such as due to frictional losses, for example. This results in the user having to use less manual force than is normally required to move the bed. Furthermore, when the user removes his or her hands from the push handles 330, the bed decelerates, such as in a manner that may bring the patient support apparatus 10 to a stop on a level surface in approximately 4-10 seconds.

Alternatively, headboard 160 and/or footboard 195 may be equipped with touch or pressure sensors, such as buttons, heat sensors, load cells, or the like. The sensors or buttons 161 (FIG. 3) send a drive signal to the drive motor in a manner similar to the functionality of the push handles 330 described above. The zoom control may adjust the speed of the auxiliary wheels 300 by comparing the drive signal of the auxiliary wheels 300 with the force applied on the buttons or sensors 161 by the user pushing the headboard 160, and provides a level of feedback to the user relating to the natural deceleration of the bed such as due to frictional losses, for example.

One advantage that the described system may provide is that relatively low force may be needed from a user to maneuver the patient support device 10 when the patient is lying on it. Another advantage is that bed movement may more intuitive for a user since the speed of the bed is controlled by the force applied by the user on the bed handles; the user need not push a button or a pedal to adjust the speed. of the bed. In some embodiments, the drive motor may be actuated by a user pushing or pulling on the headboard 160 or footboard 195. Another advantage is that battery life may be extended by allowing the bed to coast to a stop when the user removes his or her hands from the push handles 330.

Structural Informatics Systems

Sensor Technology

The resolution of the angular position-sensing of a patient may be improved by using dual axis (X-Y) accelerometers to sense the inclination angle with a higher degree of accuracy over a broader range of inclination. The accelerometers, such as gravitational accelerometers, may be orientated in a variety of mounted angles, independent of any frame. of reference.

As a result, a particular accelerometer may be positioned such that its effective resolution specifically targets the anticipated range of inclination for a given application.

To provide a more complete picture of the patient's position, a plurality of gravitational accelerometers may be located in various parts of the apparatus, such as at the head section 25, Knee Gatch or seat section 60, foot section 75, elevation system, and base frame 150. Output from the plurality of accelerometers may be compiled to provide a three-dimensional view of the patient's position. The angular inclination readings from the X-axis channel or the Y-axis channel of an accelerometer may be independently selected. Moreover, the sensed inclinations may be used to complement measurements from other sensors in the bed, such as load cells. Monolithic gravitational accelerometers may be employed to further reduce the inaccuracies associated with mechanical sensors.

In other embodiments, various types of sensors may be used such as angular solid state sensors or electronic angular sensors, wherein a change in angle of the sensor changes the impedance of that sensor.

In one embodiment, an analog system (such as a potentiometer), may output a pulse width modulation (PWM) signal with a favorable signal-to-noise (S/N) ratio. This PWM signal is sent to a microcontroller wherein the period and on-time of the signals. A ratio of these results is proportional to the sine of the angle. The cosine of this angle is to calculate the desired angle. A microcontroller can also be used with reference to a lookup table to determine the appropriate angle related to the collected data.

There are many exemplary uses for angle sensors. If predetermined patient positions are commanded by a user, a sensor may provide the corresponding values to the position of the lying surface and consequently of the patient who is lying thereon. A sensor may also provide a means to determine bed part interference. For example, if a particular bed part is articulated at a certain angle, another part may be unable to perform its commanded function due to interference. The detection of no change in an angle, when an actuator is being energized to change that angle, may indicate interference related to the actuator movement, or an actuator malfunction. A sensor therefore provides a means for fault detection.

Through the collection of angle changing data, the user may evaluate the patient's position over time. Optionally, a timer may indicate when to change a patient's position. Positional changes may occur automatically or may be initiated by a user.

The collection of angular data can also aid in the maintenance of the bed. For example, the bed may record the angle of a particular bed section and the period of time that that particular position was held, which may be useful such as when a particular position results in higher stresses on the lifting mechanisms and the bed's structure. Bed movement termination based on measurements from a sensor may also be effected, wherein once a particular bed position is reached, the controller prohibits further movement to prevent undesired stress levels on the bed's components. An angle measurement system may enable the adjustment of a patient's angular position by a small amount, such as 1 or 2 degrees, which can change any pressure points noticed by the patient with minimal patient movement.

In addition to detecting angular changes about a lateral axis of the bed, as described above, sensors may optionally be oriented within the bed frame or mattress 155 to determine rotation about a longitudinal axis of the bed. Such an angular sensor configuration may provide for rotational therapy of a patient, for example. Angular sensors may also be used to detect positions that are undesirable for a patient, and the sensors may further enable, termination of bed movement if an undesirable position is commanded by a user. The mattress 155 may also be configured with an angular sensor such as above for the Fowler or head section 25.

Calibration of the sensor may be performed such as whenever a sensor is changed, or may be conducted periodically, such as once a year, in order to verify the accuracy of the sensor. The calibration procedure may be bed specific and may be directly related to the number of angle sensors in the bed. For example, the calibration may be performed using four positional orientations: 1) Bed flat in low position, 2) Bed flat in Trendelenberg position, 3) Bed flat in reverse Trendelenberg position, and 4) Bed surface at highest location with foot at lowest, seat at highest, and Fowler or head at highest. The angle is calculated using the angle sensor and also the true angle is measured in order to determine the desired calibration of the sensor. Because at least one sensor is positioned on the elevation system, as sections of the elevation system rotate, the height of the bed surface may be calculated.

The angle sensors may be located in many positions, such as at the: 1) Fowler (head) section 25, 2) Knee Gatch (seat) section 60, 3) foot section, 4) intermediate frame 90 to measure the Trendelenberg angle, 5) on the elevation system at the head-end of the bed, 6) base of the bed, and 7) on the elevation system at the foot-end of the bed.

Angle sensors may also be placed in other bed locations, for example, the side rails 415, 420 or the footboard control panel 600. In the latter, a sensor determines if the angle of the control panel puts the control panel 600 outside of the footprint of the bed, which could result in damage. Such an event may trigger, for example, the non-disengagement of the braking system if the user attempts to select a neutral or steering setting. Sensors may also be coupled to an IV pole 255 coupled to the bed, such as on an accessory support 245, to determine the amount of fluid left in the IV bag, for example.

Load Cell Measuring Scheme to Reduce Patient Motion on the Scale Measurement

A patient weight measuring system in a bed may be provided to reliably measure the weight of a patient despite the patient's movements in the bed. The patient weight measuring system utilizes a system of sensors that provide readings to a data acquisition controller. The weight measurements are processed and displayed, such as on an interface to indicate the patient's weight. Because of the physical characteristics of the bed, stable readings of the patient's weight during patient movements are obtained by compensating for certain fluctuations in sensor readings that occur during patient movement. The system models the physical characteristics of the bed and employs a compensation means for compensating sensor reading fluctuations, for example by time frequency filtering of sensor readings or by means of other data processing algorithms. The compensation means processes and provides an accurate estimate of the patient's weight, such that the estimate does not substantially fluctuate during patient movement conditions. The processing system may utilize a time averaging algorithm that can average fluctuating load cell readings to meet a stable patient weight reading requirement. Such an embedded or remote processing system may be manually or automatically calibrated.

Scale and Bed Exit Information available at Nurse Station and through External Port There may further be provided a patient support apparatus monitoring system that comprises a scale and bed-exit system that may be based on a load cell measurement algorithm including the evaluation of the patient's center of gravity. The bed monitoring scheme may provide information on the patient's weight, patient's bed location, and other patient information to a user at a monitoring station. In particular, the position of the patient may be graphically displayed at a remote monitoring station wherein the position may be displayed such as in a color-coded position diagram. Based on the patient's bed position, the likelihood of a patient exiting the bed can be determined and an appropriate alarm may be initiated if bed exiting has occurred or is likely to occur. In addition, based on the ongoing evaluation of the patient's position, movement of the patient may be evaluated, thereby providing a means for issuing an alarm due to patient activity, for example when a patient in ICU is awakening.

Depending on the design or architecture of the bed monitoring system, embedded or remote processing capabilities may be employed through the bed communication interface system such as via an external port, whereby the bed system can communicate information to the monitoring station.

Diagnostic and Control System

A diagnostic and control system for a bed may be provided, wherein the bed comprises a plurality of electronic elements including, for example, load sensors, tilt or angular sensors, linear sensors, temperature sensors, electronic controls and keyboards, wiring actuators for adjusting bed angles and the like, in addition to other electronic elements. The diagnostic and control system may enable the specific control of each electronic element for desired operation thereof, and further may enable the monitoring of the operating conditions of electronic elements or additional bed conditions. The diagnostic and control system may further enable the evaluation and determination of the existence of one or more faults relating to the operation of the bed. For example, the existence of a fault can be conveyed to user in the form of an error message. The diagnostic and control system can subsequently evaluate the detected fault and can determine, for example, the cause thereof and a potential remedy. In this manner the diagnostic and control system can provide the evaluation of the detected fault and subsequently provide the operator or technician with a remedy for the detected fault, thereby reducing the downtime of a bed that comprises the diagnostic and control system.

For further examples of functions, controls, and other systems that may be incorporated into the bed of the present invention, reference is made to copending U.S. application entitled PATENT HANDLING DEVICE INCLUDING LOCAL STATUS INDICATION, ONE-TOUCH FOWLER ANGLE ADJUSTMENT, AND POWER-ON ALARM CONFIGURATION, Ser. No. 11/557,349, filed Nov. 7, 2006; PCT Pat. Application entitled DIAGNOSTIC AND CONTROL SYSTEM FOR A PATIENT SUPPORT, Publ. No. WO 2006/105269 A1, issued Oct. 5, 2006, which claims priority to U.S. provisional patent application Ser. No. 60/655,955, filed Mar. 29, 2005 and U.S. provisional patent application Ser. No. 60/734,083 filed Nov. 7, 2005; and PCT Pat. Application entitled LOCATION DETECTION SYSTEM FOR A PATIENT HANDLING DEVICE, Publ. No. WO 2006/105269 A1, which claims priority to U.S. provisional patent application Ser. No. 60/655,955, filed Mar. 29, 2005 and U.S. provisional patent application Ser. No. 60/734,083 filed Nov. 7, 2005; which are herein incorporated by reference in their entireties.

User-Bed Communication Interfaces

Head Control Location

Figure 26:
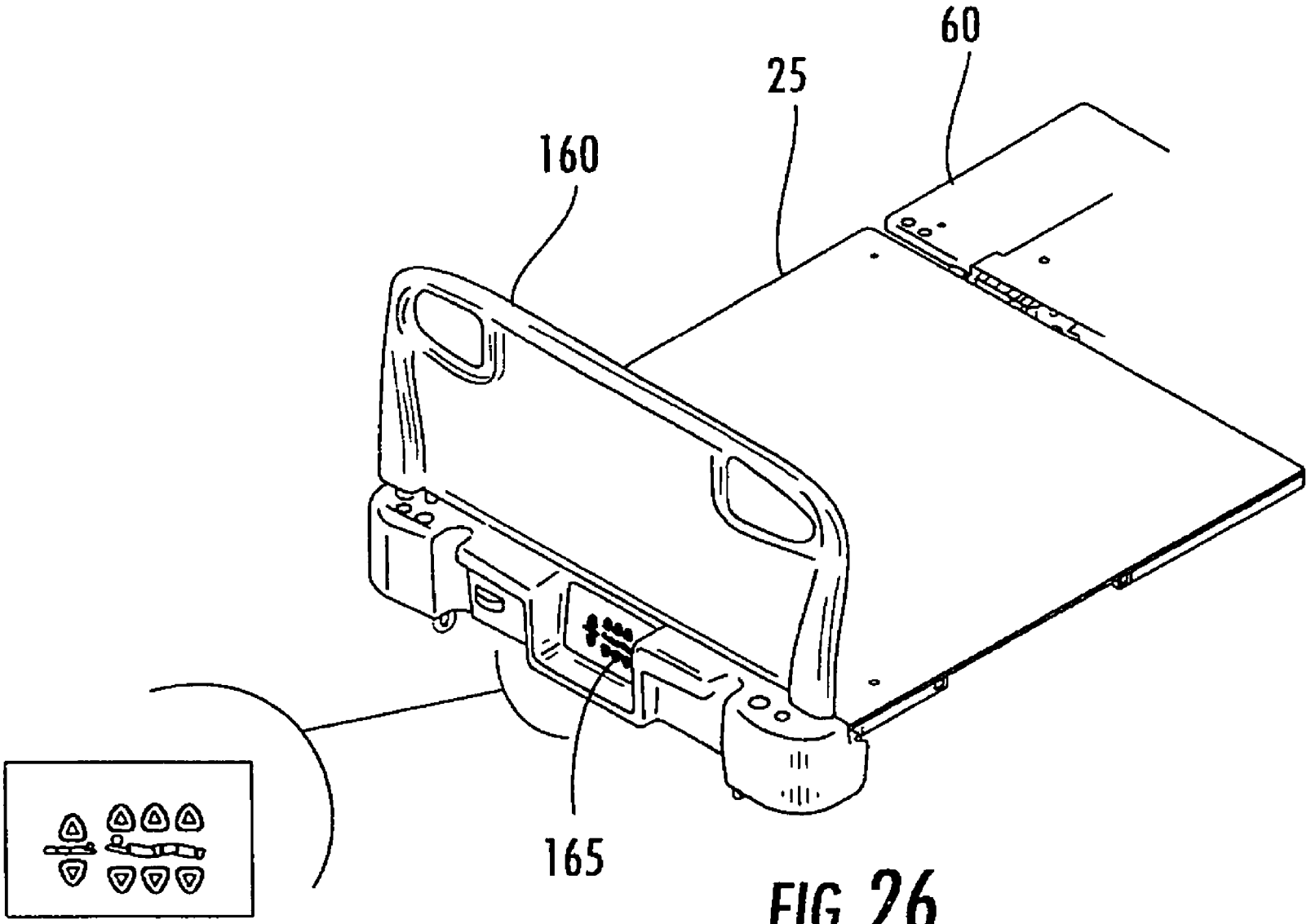
FIG. 26 is a perspective view of a control panel located on the exterior of the headboard with enlarged detail of one embodiment of control functions.

In one embodiment, a control interface 165 is located at the head-end of the patient support apparatus 10 (FIG. 26). The control interface 165 allows for various adjustments to be made to the patient support apparatus 10, such as adjustment of the relative position of the individual parts of the apparatus to position the patient on the bed, adjustment of the bed length, and adjustment of the vertical position of the apparatus. The head-end control interface 165 may be an auxiliary to the other control interfaces of the apparatus, such as to an interface located on or proximate the footboard 195.

One of the advantages of this interface 165 is that it provides for easy and rapid adjustment of the apparatus by a user during transport of a bed. This may be desirable when, for example, the patient is to be rapidly moved into a prone position to facilitate an emergency medical procedure such as CPR, or to alleviate the onset of a medical condition that occurs while the patient is in transit.

Installation of the auxiliary control interface 165 at the head-end of the apparatus allows the operator to adjust the position of the patient without having to physically move around the apparatus to access another control interface. This feature may be advantageous such as when the apparatus is in transit or when another control interface is not easily accessible.

Other controls that may be desirable to use when the head of the apparatus is accessible can also be incorporated into the head-end interface 165, for example, controls to peripheral devices. The head-end control panel 165 may be centered, as shown, but, it may also be positioned to one side.

Control Panel Functions

In one embodiment, the operation of any feature of the apparatus may be initiated on a first come, first serve basis for a given actuator. For example, the same actuator may not be simultaneously controlled from two locations. Upon initial activation at one control panel, all other controls for operating that actuator, with possible exception of manual override controls, are locked until release or termination of the activation of the actuator.

Figure 30A:
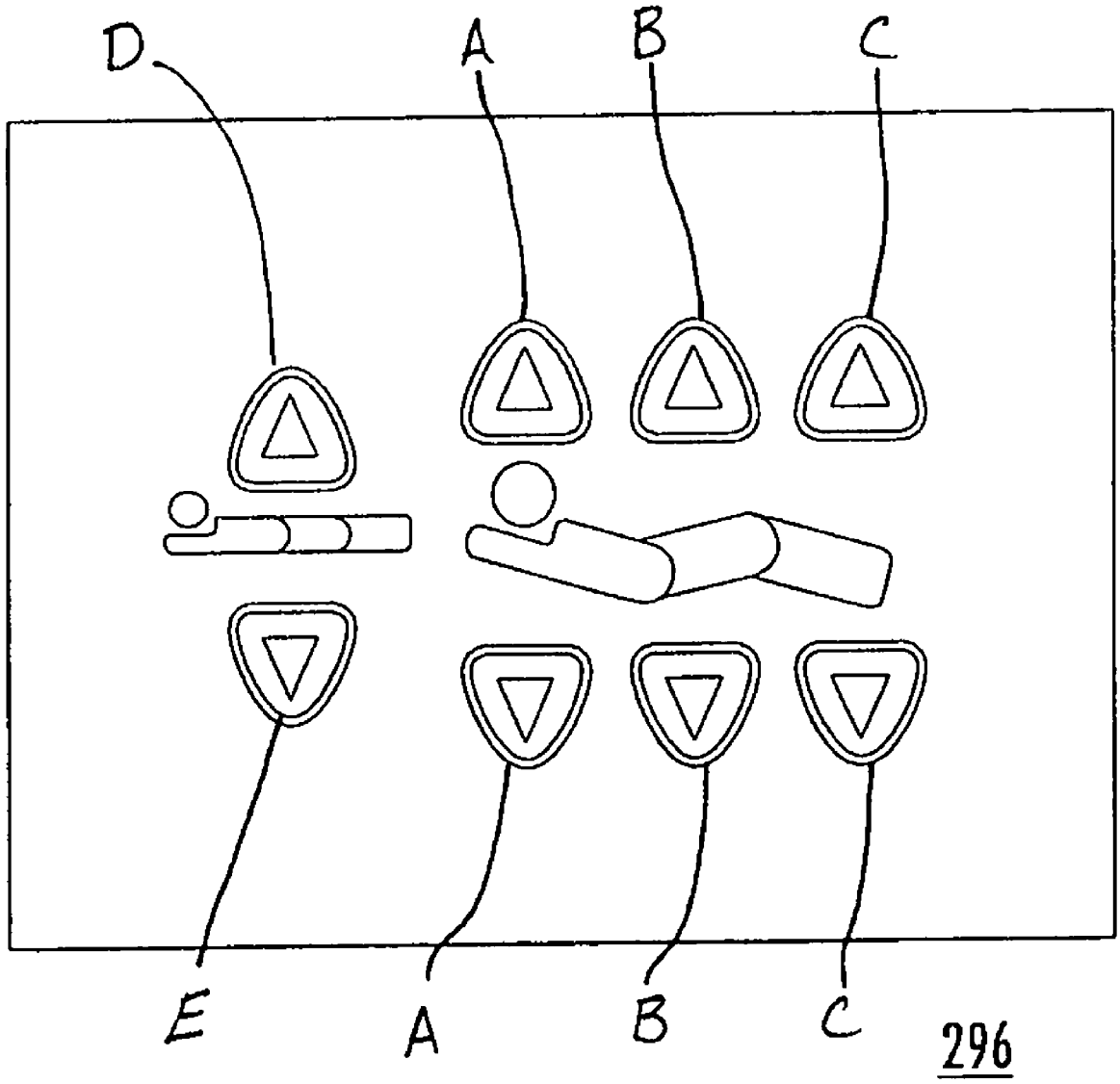
FIGS. 30A-B depict embodiments of the functions on a caregiver control panel 296, 296a located on the exterior of the head side rails.

Each location of the control panels may be used simultaneously to control different features of the bed. For example, FIGS. 26 and 30A depict control panels 165, 296 located proximate the headboard 160 wherein the following apparatus movement can be performed:

A Fowler up/down: Moves the head section 25 about pivot 30

B Knee Gatch up/down: Moves the seat section 60 about pivot 45

C Foot up/down: Moves the foot section about pivot 65

D Bed Height Control Up: Raises the height of the apparatus from the surface

E Bed Height Control Down: Lowers the height of the apparatus from the surface

The illustrated control panel may be duplicated on the exterior of the head side rails 415, 420, as illustrated in FIG. 1.

Figure 30B:
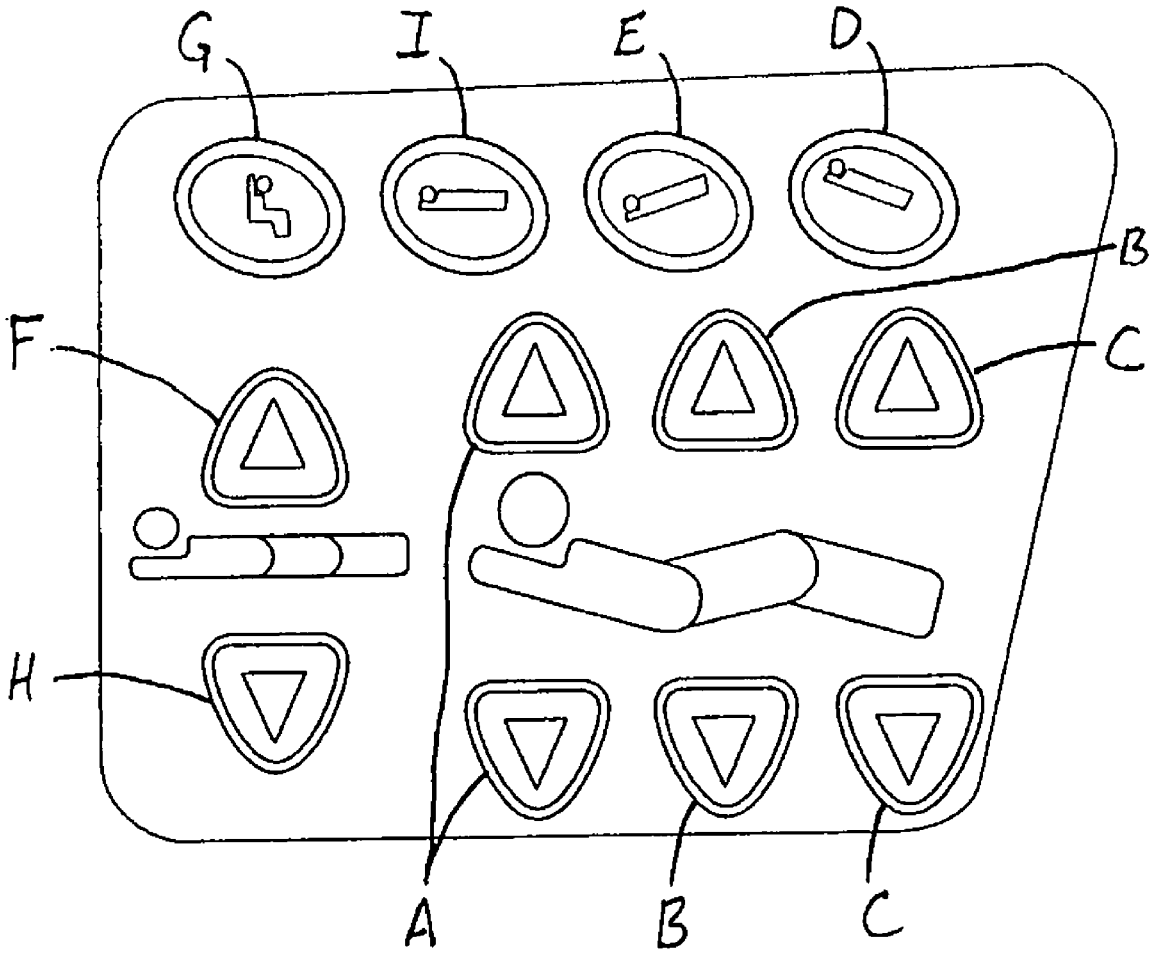

Another embodiment of a control panel located on the exterior of the head-end side rails 415 is illustrated at FIG. 30B, wherein the following apparatus movement may be performed:

A Fowler up/down: Moves the head section 25 about pivot 30

B Knee Gatch up/down: Moves the seat section 60 about pivot 45

C Foot up/down: Moves the foot section about pivot 65

D Reverse Trendelenburg: Raises the intermediate frame 90 at the first (head) end and lowers the intermediate frame 90 at the second (foot) end E Trendelenburg: Raises the intermediate frame 90 at the second (foot) end and lowers the intermediate frame 90 at the first (head) end F Bed Height Control Up: Raises the height of the apparatus from the surface G Chair Position: Places the apparatus in a chair position H Bed Height Control Down: Lowers the height of the apparatus from the surface I Flat Bed Position: Places the apparatus in a flat position.

Figure 30C:
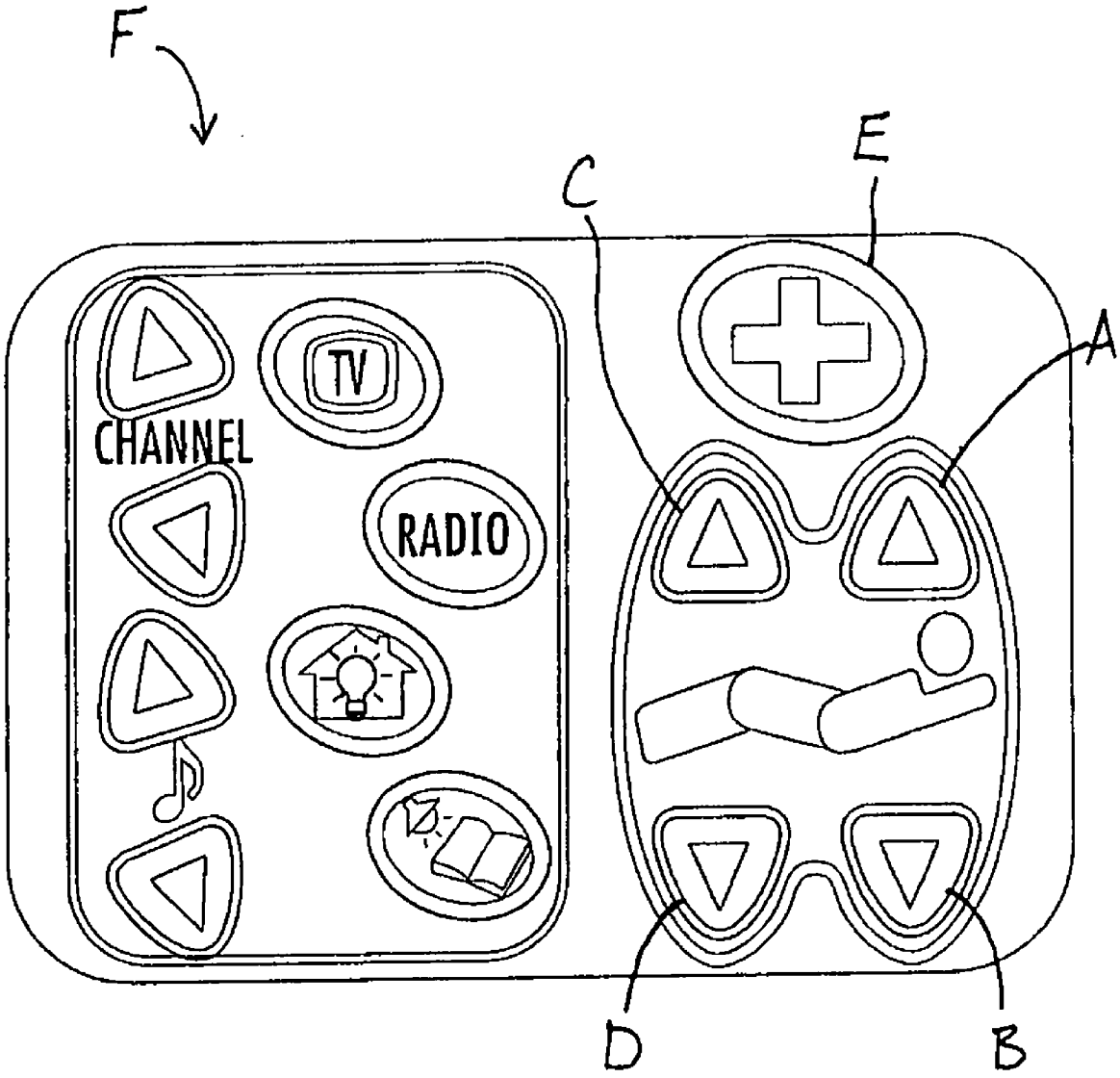
FIG. 30C depicts an embodiment of a pendant control interface.

One embodiment of a pendant control interface, depicted at FIG. 30C, comprises the following functions:

A Raise Fowler: Raises the head section 25 about pivot 30

B Lower Fowler: Lowers the head section 25 about pivot 30

C Raise Knee Gatch: Raises the seat section 60 about pivot 45

D Lower Knee Gatch: Lowers the seat section 60 about pivot 45

E Caregiver Call: Alerts a caregiver that assistance is required

F Interactive Control Panel: Provides access to television, radio, lighting, other As depicted in FIG. 31, another control panel 295, directed to the brake mechanism, can also be located on the exterior of the head-end side rails 415, comprising the following functions:

A Brake Activation: Disengages zoom actuator, places brake actuator in Brake position B CPR Activation: Places the apparatus in the CPR position C Neutral Activation: Disengages zoom actuator, places brake actuator in Neutral position D Steer Activation: Engages zoom actuator, places brake actuator in Steer position E Battery Low Indicator: Indicates low battery power F Call Maintenance Indicator: Indicates an error that cannot be fixed by the user G Trendelenburg Activation Indicator: Places the apparatus is in Trendelenburg For this control panel, components A, C and D may also be indicators of the brake status. In other embodiments, the position of the control panels can be anywhere on the apparatus.

Message Indicators

The apparatus may have numerous system message indicators optionally displayed on the control panels. For example, in reference to part G of FIG. 29, indicators include Total Lockout, Call Maintenance, Battery Low, Brake Not Set, and Side Rail Not Locked.

The Total Lockout lock setting prevents bed component activation at the control panels 260, 600. When the lock setting is activated, such as by pressing button F in FIG. 29, the corresponding lock icon illuminates. In one embodiment the brake can be engaged during a total lockout but cannot be disengaged at any time during a total lockout. The lock setting may not affect the functions of the caregiver call, the scale system or the bed exit detection system. In another embodiment, the control panels located on the footboard 195 and the headboard 160 are not affected when the user activates button F in FIG. 29. The different parameters for the lock setting may be saved if there is a power outage, and resume from their original state when the power is back to normal.

The Call Maintenance indicator is indicates the need for repairs or support in regards to the proper functioning of the bed system. This indicator is triggered by one or more monitoring sensors placed at various locations within the apparatus. The need to call maintenance can arise in situations such as where there are problems particularly associated with the electronics of the bed, including overheating of the motors/actuators, non-functioning tilt sensors, loss of network links, or "SAFE" errors.

The Battery Low indicator apprises the user of the level of power remaining in the one or more batteries. It may be used to indicate that the batteries are almost out of power and require re-charging soon.

Figure 33:
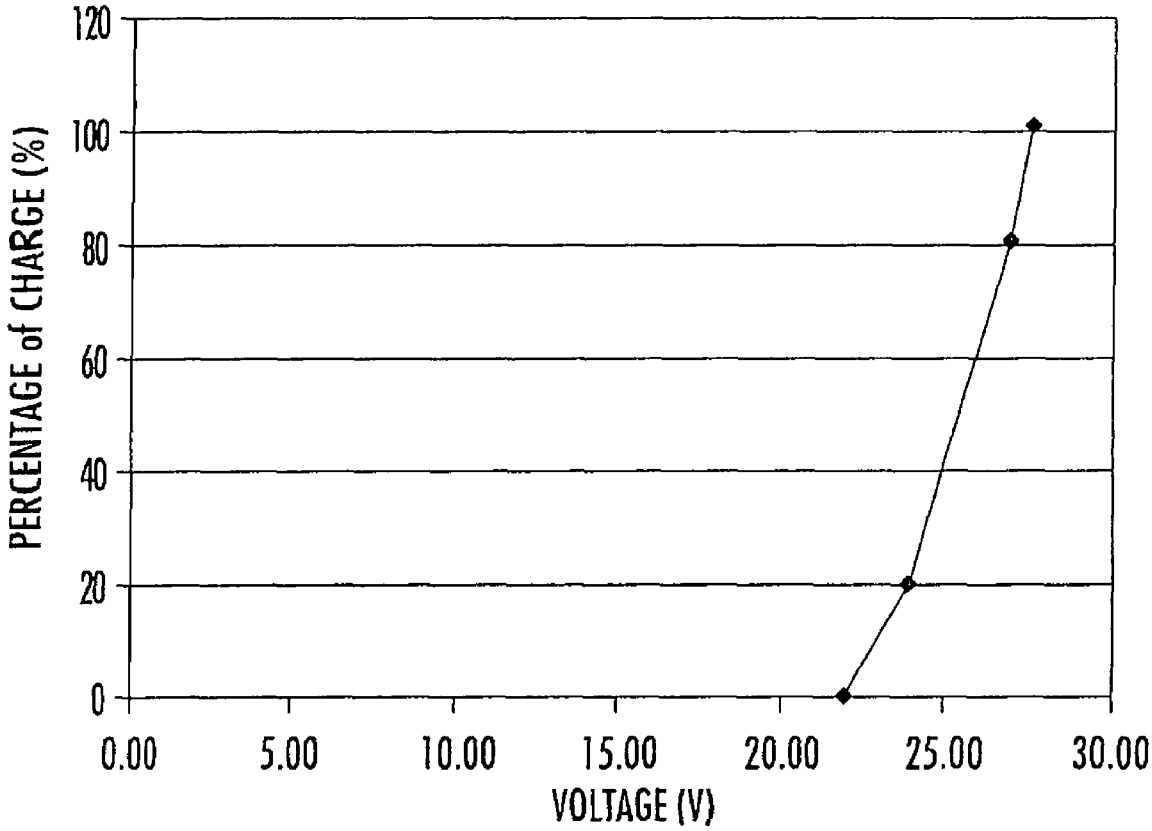
FIG. 33 is a graph which depicts the percentage of charge relative to the voltage provided by the batteries.
Figure 34:
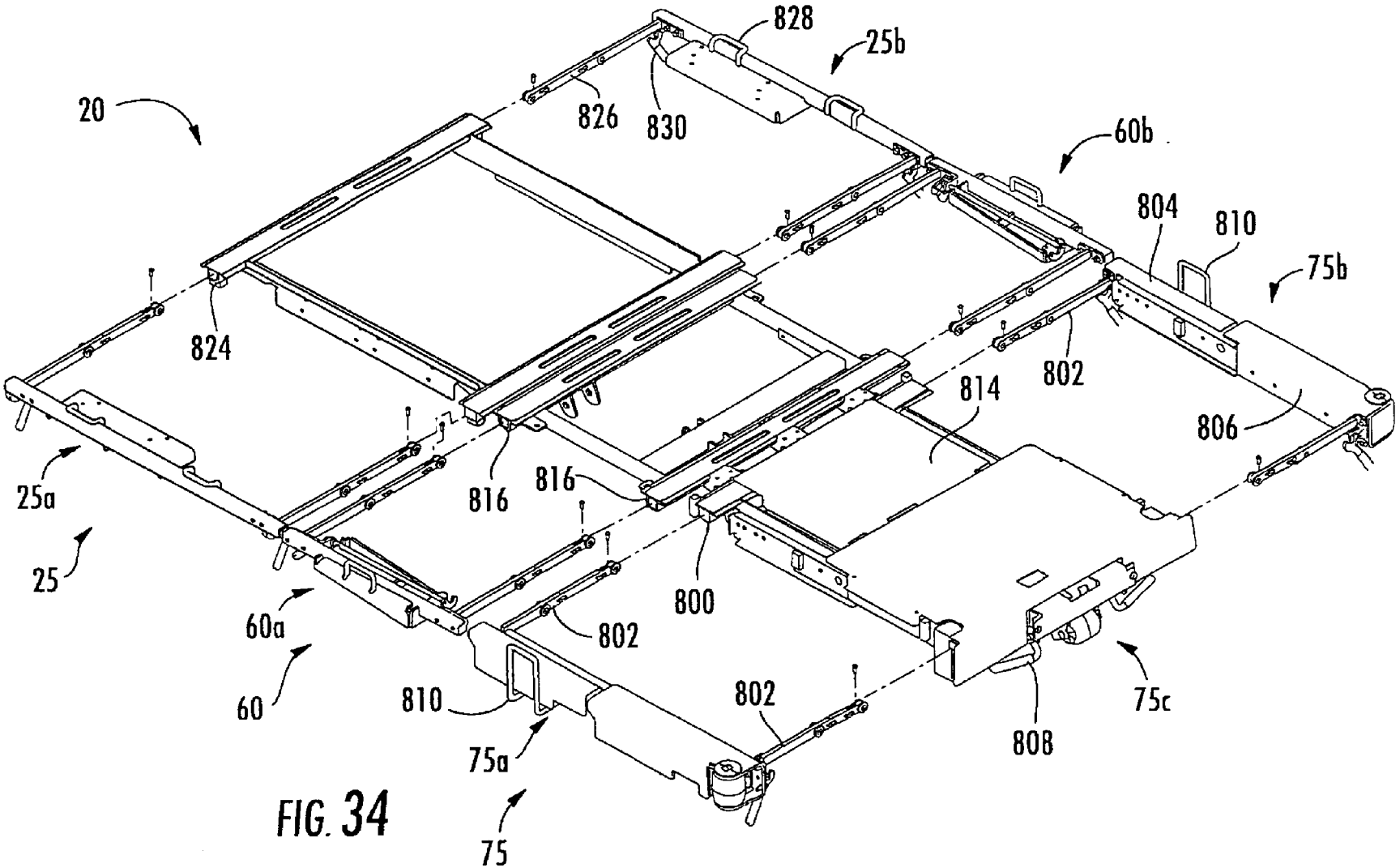
FIG. 34 is an exploded perspective view of an expandable deck support with seat and head platforms removed.

In one embodiment, there are two batteries. The time needed to charge both batteries completely may be approximately 8 hours. The approximate charge left on the batteries is determined by the amount of voltage that both of the batteries are able to provide to the system, according to the following table and graph depicted at FIG. 33:

| Voltage | Percentage |
|---|---|
| 27.60 | 100 |
| 27.00 | 80 |
| 24.00 | 20 |
| 22.10 | 0 |

From this graph, there are 3 linear graphs that are determined for which the amount of remaining charge on the batteries can be calculated. For example, if the batteries are currently providing a voltage of 27.2V, the following formula determines the percentage of charge left on the batteries:

$$\begin{aligned}\text{Percentage of charge left on the batteries} &= (80 + (((27.2 - 27)/(27.6 - 27)) \times (100 - 80)) \\ &= 80 + 6.66\% \\ &= 87\%\end{aligned}$$

Similarly, if a voltage of 25.0V is detected from the batteries, the amount of charge left on the batteries is calculated as:

$$\begin{aligned}\text{Percentage of charge left on the batteries} &= (20 + (((25.0 - 24)/(27.0 - 24.0)) \times (80 - 20)) \\ &= 20 + 20\% \\ &= 40\%\end{aligned}$$

Finally, if the voltage detected from the batteries is of the order of 23.0V, the percentage of charge left on the batteries is:

$$\begin{aligned}\text{Percentage of charge left on the batteries} &= (((23.0 - 22.10)/(24.0 - 22.1)) \times 20) \\ &= 9.47\% \\ &= 10\%\end{aligned}$$

The Brake Not Set indicator may used to apprise the user that the brakes are not engaged on the apparatus. Such an indication assists to avoid a user inadvertently leaving the apparatus without the brakes being set.

The Side Rails Not Locked indicator may be used to indicate if any side rails 415, 420 are not locked with the side rail locking mechanism. This indicator helps users prevent situations where patients are left unattended with their side rails 415, 420 not locked.

Apparatus Positions

In reference to the embodiment of FIG. 30B, different positions may be achieved with buttons G (Chair) and I (Flat).

In one embodiment, the desired angles for different positions can be:

| Deck support 20 Section | Flat | Standard Cardiac Chair | Enhanced Cardiac Chair |
|---|---|---|---|
| Fowler (Head) | 0 degree (State 0) | 64 degrees (State 1) | 80 degrees (State 2) |
| Foot | 0 degree (State 0) | 30 degrees (State 1) | 50 degrees (State 2) |
| Knee Gatch (Seat) | 0 degree | 13 degrees | 15 degrees |

When the user presses on button G (Chair), the sequence starts at the current height. If the bed is in the Trendelenburg or the Reverse Trendelenburg position, the intermediate frame end that is lower is raised to achieve 0 degree of Trendelenburg (horizontal). If the apparatus is to be raised so that the foot section reaches 50 degrees without the interference of the foot panel 195 with the surface, the apparatus is first raised to a height that ensures no interference with the floor surface. In this embodiment, when two elevation motors function, the other sections of the bed may not move.

There may be a "soft stop" of about 1 second between each chair position to make sure that the user wants to continue the sequence when button G (Chair) is still being pressed. When button G (Chair) is pressed, the state of each section of the bed is calculated. The priority for the state to be achieved is deemed superior to the state of the section which is in the lowest state. For example, if the head section 25 of the apparatus is in the state 0.5 (between 0 and 64 degrees) and the foot section is in the state 1.5 (between 30 and 50 degrees), the state to be achieved is 1. Any section of the apparatus may thus move to reach this state. In this example, the head or Fowler section 25 is raised. Consequently, each section of the support deck 20 may move in either direction with the same button press. In one embodiment, the state of the Knee Gatch section 60 is never used to determine the state to be achieved, but it is used to inform the system whether a given position has been completed.

If one of the three locks (Fowler, Knee Gatch, or Total) is activated, no motion in regards to the Enhanced Cardiac and Cardiac chair sequences may be allowed. This condition is independent of the position of the deck support 20. Consequently, the apparatus may not carry out any motion when buttons I (Flat) or G (Chair) are pressed.

When button I (Flat) is pressed, the state of each section of the apparatus is also calculated. The state to be achieved in this example is always lower than the state of the section which is the lowest. For example, if the Fowler section 25 is in the state 0.5 and the foot section is in the state 1.5, the state that needs to be reached is 1. Consequently the head section 25 is at 0 degree, Knee Gatch 60 is at 0 degree and the foot section is at 0 degree.

In the event that button I (Flat) is pressed when the apparatus is in the Trendelenburg or Reverse Trendelenburg positions, the apparatus will be set into motion such that all or part of the deck support 20 may move in order to achieve the flat position. In this example, the apparatus will settle itself at the height of the "point (axis) of rotation" of the apparatus, as illustrated by FIGS. 7A-C.

It is possible to move the Knee Gatch, head, and foot sections 60, 25, 75 at the same time. In one embodiment, the motion of the apparatus stops if the user presses button C (Foot Button Down) and the control system detects a possibility for contact of the foot section with the surface.

The commands that may be activated from the control panel of the headboard 160 and the footboard 195 are commands that are typically attributed to a caregiver such as a nurse. The commands activated from the pendant 260 are typically attributed to the patient. In one embodiment, the motions that are requested from the caregiver have priority over the motions requested by the patient. In the event that the caregiver inputs several simultaneous motions in the control panel and it is not possible to activate all the motors at the same time, the first requested motion may be carried out first. The system may not allow several motors to be put in motion at the same time. In another embodiment, other than the motors for the apparatus height adjustment, three motors can be put into motion simultaneously. The motors height adjustment work together and none of the other motors may work simultaneously with them. Also, the motors for the Fowler, Knee Gatch, and foot sections 25, 60, 75 may work together at the same time.

In one embodiment, two motions that are opposite to each other are requested by the user (for example, simultaneous raising and lowering the bed) on the same control panel, none of the requested motions are carried out. In such a case, the system stops all the motions. In one embodiment, the footboard control panel takes priority over the side rail and pendant control panels. If, for example, signals from the side rail control panel request to lower the apparatus while signals from the footboard control panel request to raise the apparatus, the system will raise the apparatus, regardless of whether the command for the apparatus to be lowered has been initiated before the footboard control panel command to raise is activated.

Figure 32:
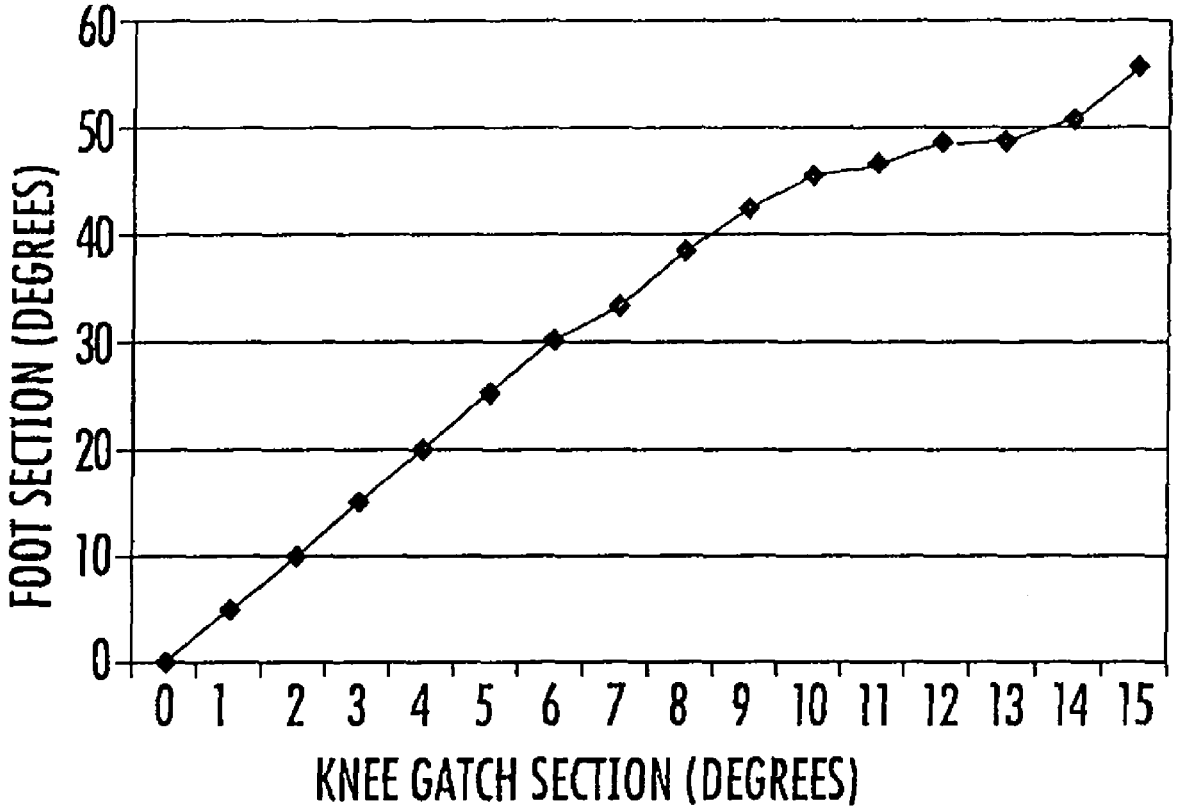
FIG. 32 is a graph which depicts the maximum angle of the foot section as a function of the angle of the Knee Gatch section 60.

There are maximum angles with which the I(nee Gatch section 60 can be articulated in relation to the angle of the foot section 75 and vice versa. In one embodiment, such angles are depicted in the graph at FIG. 32.

In one embodiment, if there is a mechanical constraint that prevents a requested motion from being completed, the constraint may first be removed to allow for the motion to occur. When the Knee Gatch section 60 is raised and lowered, for example, the foot section 75 angle changes mechanically. Therefore the foot section 75 is moved in such a way that it is able to maintain its angle of inclination.

The Trendelenburg position depicted in FIG. 7B is achieved when the Fowler (head) section 25 is set to the low position while the foot section is set to the high position. This particular position may be achieved such as by pressing button E (Trendelenburg) FIG. 30B until the desired position is obtained. In contrast to the Trendelenburg position, the Reverse Trendelenburg position depicted in FIG. 7C occurs where the Fowler (head) section 25 is set to the high position and the foot section is set to low. This is achieved by pressing button D (Reverse Trendelenburg) FIG. 30B. There is a maximum angle of inclination that can be achieved during the Trendelenburg and Reverse Trendelenburg positions. Typical angles of inclination for the Trendelenburg position and Reverse Trendelenburg position are 15 degrees.

With respect to the elevation system motors, the speed may be decreased such as because the mass is not necessarily uniformly spread on the bed, or because the two motors do not necessarily have the same characteristics. Consequently, the angle of Trendelenburg is calculated when the motion is initiated and the speed of the fastest motor may be adjusted so that the angle of inclination in the Trendelenburg mode is maintained during raising or lowering of the apparatus. In one embodiment, the amount of time needed for the apparatus to reach the highest position when it was initially at the lowest position is not more than 35 seconds.

During the Trendelenburg and Reverse Trendelenburg motions, there may be minimum allowable angles for the elevation system. In one embodiment, the elevation system for the head-end is not lowered to a height where the corresponding angle is less than 20 degrees during the Trendelenburg position. A similar restriction may exist for the elevation system during the Reverse Trendelenburg position. Consequently, if the apparatus is in the lowest position and the user wants to move to a Trendelenburg position, the elevation system for the head-end may first be raised even if, under normal conditions, the elevation system for the head is lowered during the positioning for Trendelenburg to avoid any interference. The elevation system for the head may sufficiently rise to avoid any possible interference, which at the limit may be 15 degrees of Trendelenburg.

Similarly, if the bed is at a height with a low angle of Trendelenburg and the user desires to lower the apparatus by pressing button H (Bed Height Control Down) FIG. 30B, the apparatus may be lowered by maintaining the same angle of Trendelenburg as explained above until the elevation system for the head reaches a minimum angle in the Trendelenburg position. At such an angle, the elevation system for the head will stop its motion and the elevation system for the foot will continue its decline if the user continues to press on button H. The same logic is applicable for the elevation system for the foot and the position is Reverse Trendelenburg.

In one embodiment, the angle between the Knee Gatch (seat) section 60 and the Fowler (head) section 25 are never less than 90 degrees. An angle smaller than 90 degrees may result in an uncomfortable position for the patient. If the user desires to raise the Knee Gatch section 60 and the 90 degree limit is reached, the system will automatically lower the Fowler section 25 to avoid such an acute angle. Similarly, if the user raises the Fowler section 25 and the 90 degree limit is reached, the system will automatically lower the Knee Gatch section 60.

During Reverse Trendelenburg motion, the angle of the head section 25 may be monitored to ensure that the sum of the two angles is not more than 90 degrees. For example, if the head support is at 80 degrees, and the user wants to set the bed to the Reverse Trendelenburg position, there is a danger that the patient may be ejected from the apparatus if the sum of the two angles is above 90 degrees.

Control Module

Figure 27:
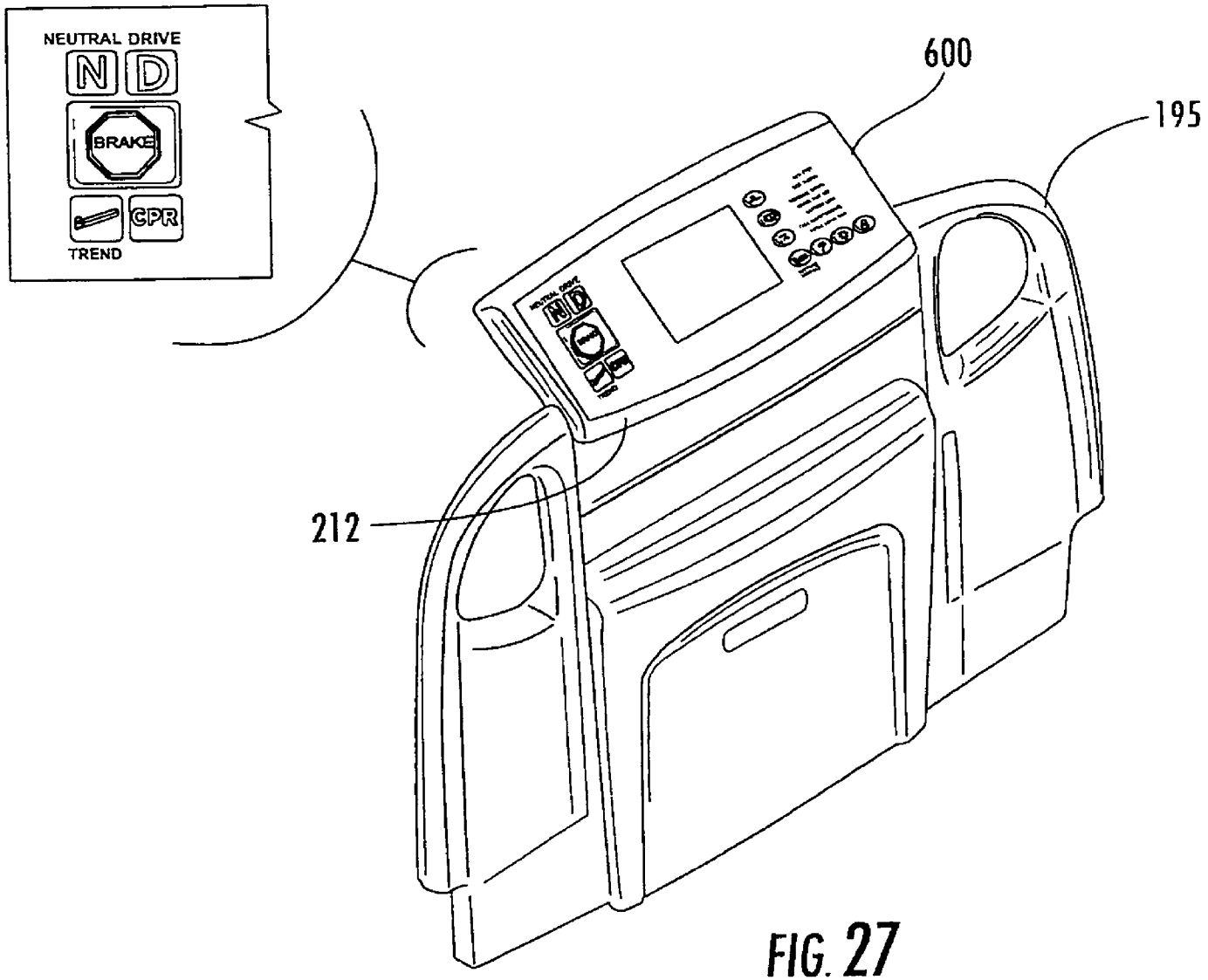
FIG. 27 is a perspective view of the control panel on the footboard in a use position, with enlarged detail of the activation button for the brake mechanism and other functions.
Figure 28B:
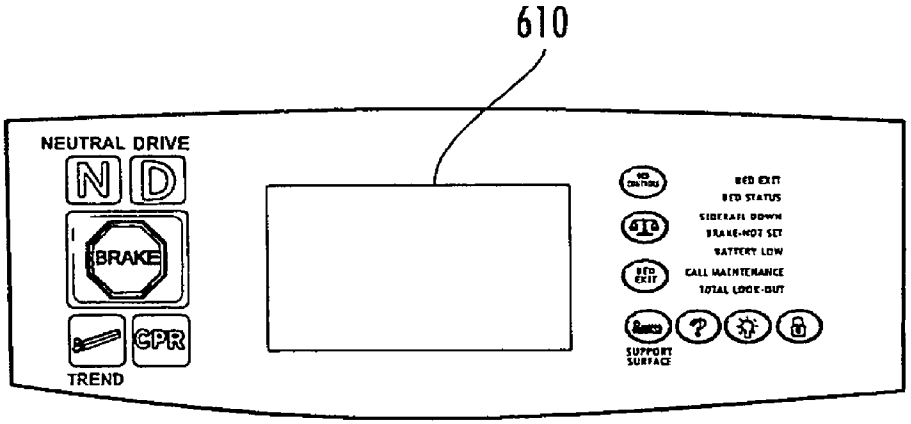
FIGS. 28A-B are a perspective view of the LCD screen and interface on the footboard control panel with enlarged detail of one embodiment.
Figure 28D:
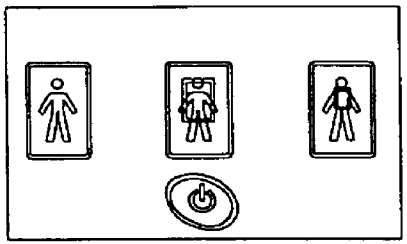
FIGS. 28C-F depict embodiments of various touch screen menus of FIGS. 28A-B.
Figure 28F:
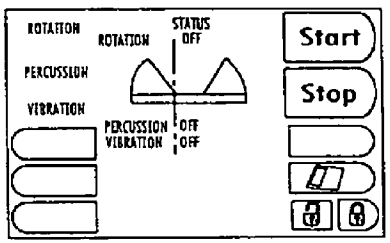
Figure 28C:
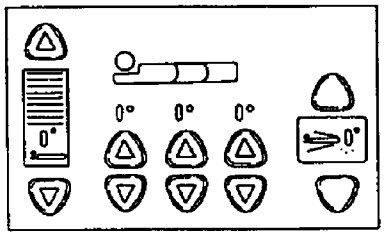
Figure 28E:
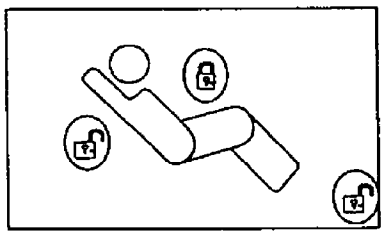
Figure 28A:
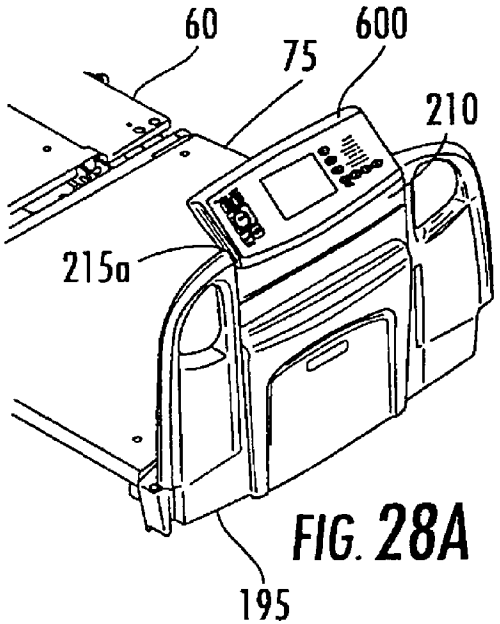
Figure 29:
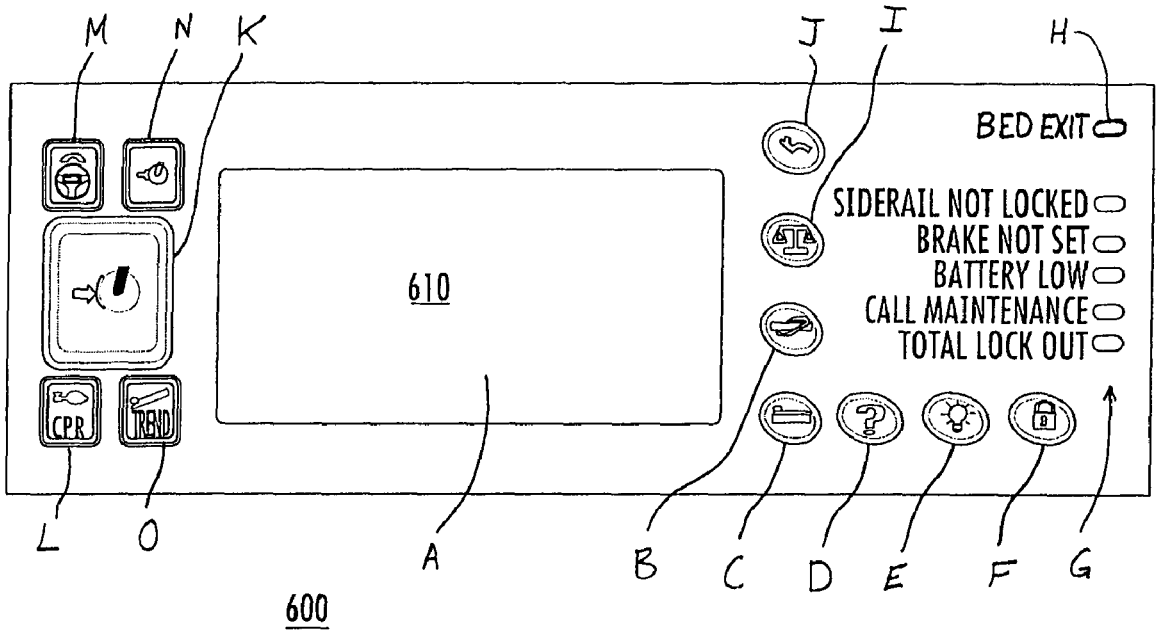
FIG. 29 depicts another embodiment of the LCD screen and interface on the footboard control panel.

In one embodiment as illustrated in FIGS. 27 and 28A, the control module 600 is located at the foot-end of the patient support apparatus 10, coupled to the footboard 195. The control module 600 is operatively and pivotally connected to the footboard 195 and the control module 600 can pivot on at least one axis with an angle from 0 to 360 degrees. In the embodiment illustrated in FIG. 28A, a pivotal axis is shown to be substantially horizontally perpendicular to the longitudinal axis of the patient support apparatus 10. In the stored position, as shown in FIGS. 1 and 5, the back-side of the control module 600 is facing the exterior of the patient support apparatus 10, and the user interface of the control module 600 is hidden and facing the back panel of the embedded cavity 210.

This configuration of the control apparatus may prevent inadvertent or accidental entries or modifications through the control module 600 and may provide protection to the control apparatus when in the stored position. Furthermore, this configuration renders the cleaning of the patient support apparatus 10 easier and helps a user to keep the user interface cleaner. Conversely, when the control apparatus is in an operational position, as depicted in FIGS. 27 and 28A, the user interface is exposed, allowing a user to operate the control module 600. The control module 600 may have a latch or handle for manipulation of the control apparatus from a stored position as shown in FIGS. 1 and 5, to an operational position as shown in FIGS. 27 and 28A, and vice-versa. The illustrated embodiments may be. modified in a manner in which the control apparatus would be located at either the head-end or foot-end of the patient support apparatus 10, wherein a control module 600 may be embedded in either the headboard 160 or footboard 195 or both, which are associated with the patient support apparatus 10.

Figure 4A:
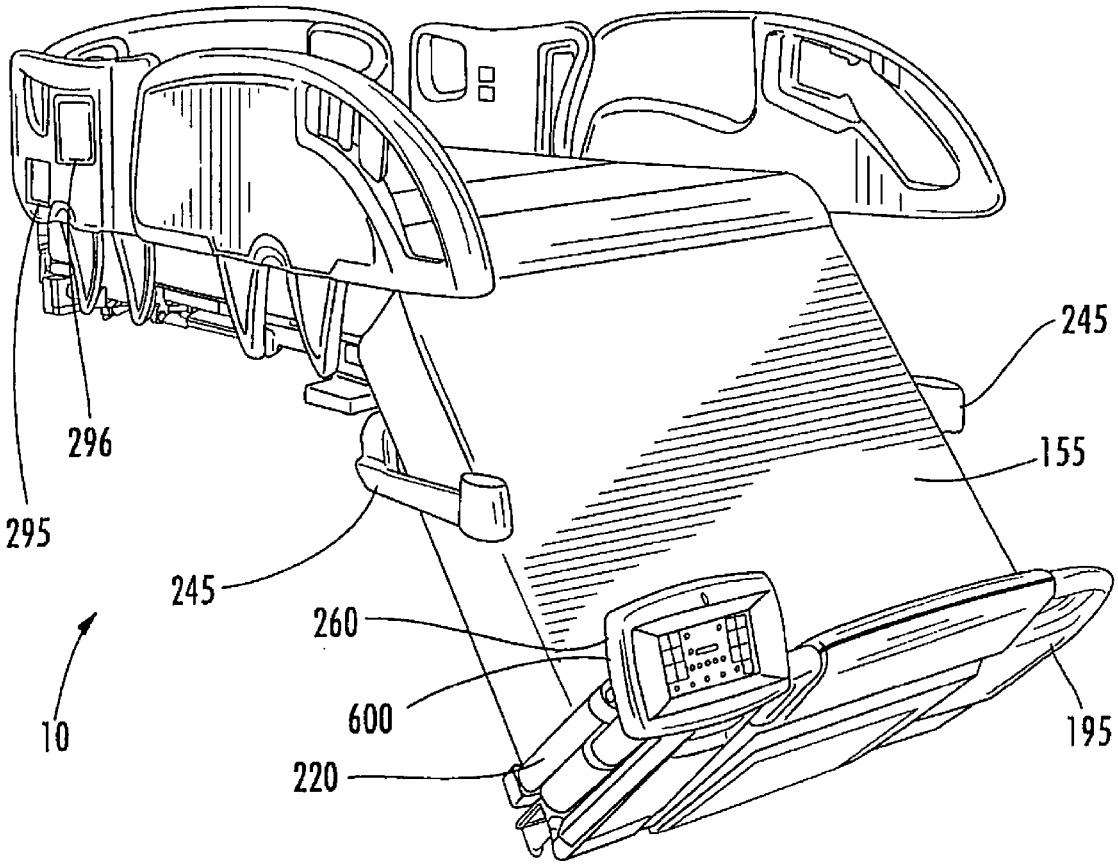
FIGS. 4A-B are end perspective views of embodiments of the patient support apparatus 10 wherein the foot section 75 is articulated, showing different positions of the controller pendant.
Figure 4B:
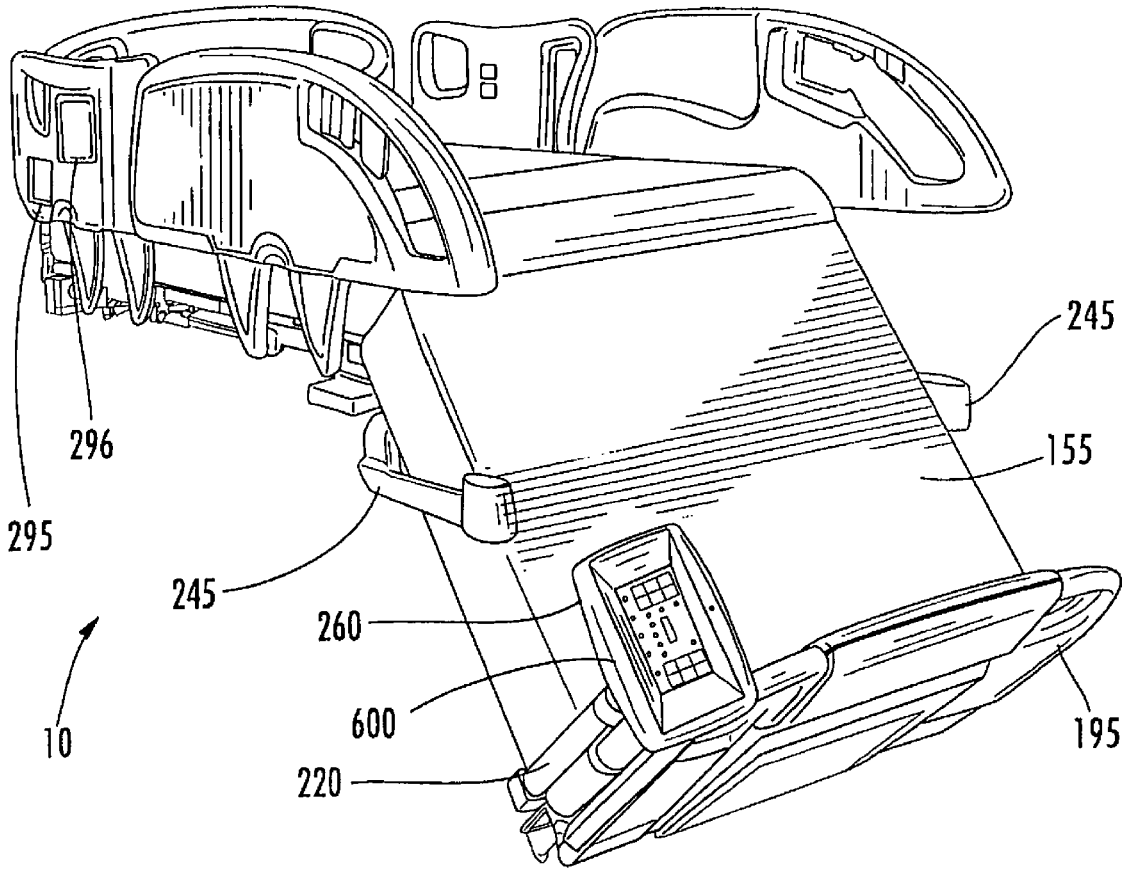

In another embodiment, the control module 600 can be operatively connected to the deck support 20 or the intermediate frame 90 and positioned at any desired location along the length of the patient support apparatus 10. In this embodiment, the control module 600 may be movably coupled to a coupling device 215, which is fastened to the deck support 20 or intermediate frame 90. In these embodiments, the coupling device 215 can be configured as an extension arm which can provide a desired level of movement of the control module 600 relative to the deck support 20 or the intermediate frame 90. For example, the control module 600 can be coupled to the deck support 20 at the foot-end of the patient support apparatus 10 as illustrated in FIGS. 4A-B.

Housing

The housing 212 of the control apparatus is configured to physically house the control module 600 (FIGS. 15 and 16). The shape and construction of the housing 212 is not restricted to a particular design but may be dependent on the attachment location, such as the footboard 195, headboard 160, deck support 20, intermediate frame 90, etc.). The configuration of the housing 212 may also be based upon the type of coupling device used for operatively connecting the housing to the patient support apparatus 10. In addition the housing 212 can be specifically designed for a desired level of impact resistance or strength, for example. As such, variations in the shape and construction of the housing 212 which provide the desired functionality described herein may be design choices for functionality, position, and aesthetics.

The housing 212 may have affixed thereto electronic cards, buttons, or other controls that the control of the features of the patient support apparatus 10. The supports for these electronic cards, buttons, or other cards may be made of transparent or translucent material to diffuse the light uniformly on the whole surface underneath the user interface. The transparent or translucent supports may be affixed from the outside of the module 600 or housing 212. The electronic components may be accessible without opening the main control module 600.

In one embodiment of the invention, the user interface can be mounted on a metal plate (not shown) through magnetic force. The control module 600 can be equipped with a magnetised surface (not shown) to receive the metal-plate interface. The housing 212 of the control apparatus may overlap all of the adjoining edges between these components to eliminate cleaning and contamination problems caused at the physical joints between the various sub-components. Magnetised mounting means may not require adhesives to assemble all the components of the control module 600. They can further provide the possibility for the patient or the operator to quickly change the options of the control module 600 without replacing the interface, allowing the interface to remain sealed and easy to clean.

Coupling Device

Figure 4C:
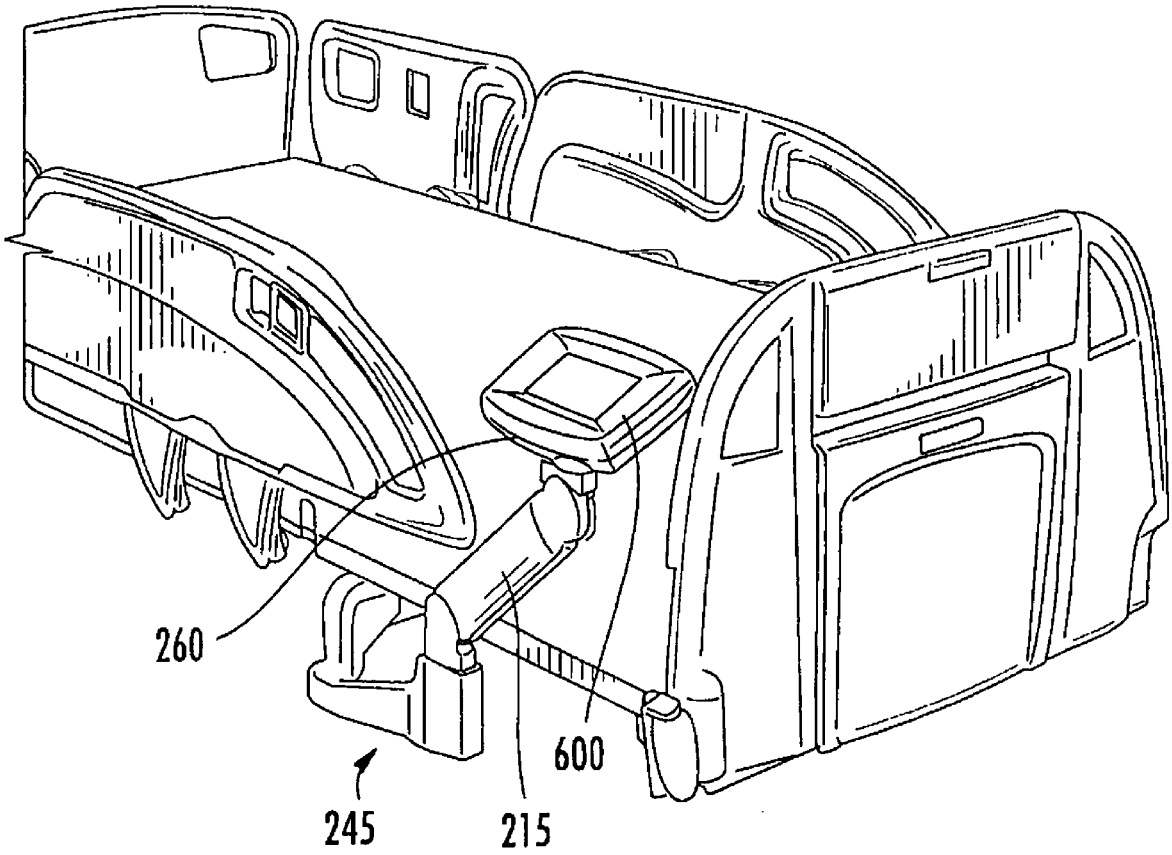
FIG. 4C is a perspective view of an embodiment wherein the control module 600 is connected to the bed frame through an articulated support arm 245.

The coupling device 215, 215*a* of the control apparatus provides a connection between the housing 212 and the patient support apparatus 10 (FIGS. 4C and 28A). The coupling device 215, 215*a* can be configured in a plurality of different configurations in order to provide movement of the housing 212 in one or more different planes.

The coupling device 215, 215*a* can be for example, without any limitations, a socket-type connection which may enable three dimensional movement, a rotational pivot, railings, or several operatively coupled rotational pivots. The coupling device 215, 215*a* can also be configured as one or more coupled link arms or flexible tubing. The coupling device 215, 215*a* can further comprise a combination of some of these elements among themselves or with an articulated support arm 245 or a fixed support arm 220, for example, as illustrated in FIG. 4C.

In one embodiment, the control apparatus comprises a stopping mechanism positioned at intermediary angles between 0 and 360 degrees. This stopping may be mechanical, electrical, hydraulic, or magnetic. In one embodiment, a mechanical stopping mechanism is a ratchet-type system. Alternately a frictional force may be used to bring the control module 600 to a static stop position. For example, this stopping mechanism can be configured using dampening grease, friction discs and springs, or a Stabilus Hydro-Lift®-type cylinder. The Hydro-Lift®-type cylinder uses a gas spring to allow variable positioning of the element to which it is attached, for example, the housing 212. The articulated support arm 245 or fixed support arm 220 can be adjusted by applying a defined manual force and subsequently locked in the new resting position. An advantage of integrating a Hydro-Lift®-type cylinder into the coupling device 215, 215*a* is that this cylinder does not require an actuation mechanism for adjustment.

In one embodiment, the control module 600 can also comprise a motor and sensor that allows the module 600 to maintain a predetermined angle or position relative to the floor surface regardless of the angle of the intermediate frame 90, deck support 20, footboard 195 or headboard 160 relative to the floor. The operator can adjust it manually and then the control module 600 can register the desired position in order to keep it constant until the next change. The operator can also adjust the angle of the motorised control module 600 by using various controls on the user interface.

In another embodiment, the control module 600 can pivot on 3 rotational axes, allowing three-dimensional movement. The control module 600 is connected to the patient support apparatus 10 though the coupling device 215, 215 a. The wire linking the control module 600 to the bed can pass though the coupling device 215, 215*a* thereby not limiting the movement of the control module 600.

In one embodiment, the control module 600 can be linked via the housing 212 to the patient support apparatus 10 by an articulated support arm 245 (FIG. 4C) or fixed extension arm 220 (FIGS. 4A-B). The control module 600 of FIG. 4C is also referred to as a pendant 260. Such an arm 220 can be coupled to the intermediate frame 90 (FIG. 4C) or the foot section 75 (FIGS. 4A-B) to ensure that the arm 220 does not move if the mattress 155 is moved, for example through movement of the deck support 20. The arm can also be connected to the deck support 20, for example at the head, seat, or foot sections 25, 60, 75.

In one embodiment, the support arm 220 may be removable from the patient support apparatus 10, thereby allowing for versatility in the positioning of the control module 600 connected to the support arm via the housing 212. The receptors enabling this ability of the support arm may comprise adapters for the mechanical, electrical, and electronic hook-ups for the control apparatus. These receptors can move to accommodate the needs of the user, for example. In one embodiment, the support arm 450 may be coupled to the base frame 150 of the patient support apparatus 10.

In another embodiment, the control module 600 is capable of sliding on straight or curved rails (not shown). Non-parallel rails may provide various control angles depending on the relative position on the rails. A rail mechanism between the housing 212 and the footboard 195 of the patient support apparatus 10 may be provided. The rail mechanism comprises a pair of rails disposed on each side of the embedded cavity 210 of FIG. 28A. Each rail may comprise a single groove pattern to receive and guide one or more protrusions extending outwardly from each side of the housing 212 of the control module 600. The groove pattern on one side may mirror the groove pattern on the other side and the protrusions may be located on corresponding locations on each side of the housing 212 of the control module 600. In one embodiment, bearings may be used between the protrusions and their corresponding groove patterns. Bearings may help reduce the frictional forces and thereby reduce wear of the protrusions and their corresponding groove patterns while also reducing high contact stresses and facilitating movements from one position to another.

In one embodiment, the coupling device 215, 215*a* may have features allowing control module 600 to monitor and adjust the movement of the housing 212 relative to the movement of the patient support apparatus 10, in order to maintain a predetermined accessibility and visibility to the control module 600 by a healthcare provider. To achieve this, the coupling device 215, 215*a* may have a motorised component (not shown) operatively connected to the housing 212 and the control module 600 may comprise a positioning sensor.

For additional variations of coupling devices, reference is made to copending application Ser. No. 11/588,726, filed Oct. 27, 2006, entitled Ergonomic Control Apparatus for a Patient Support Apparatus, which is assigned to Stryker Canadian Management of Canada and which is incorporated by reference herein in its entirety.

LCD Assembly

An LCD assembly may be mounted to the footboard 195 or to a pendant 260 for controlling and/or monitoring any electronically controlled and/or monitored function of the patient support apparatus 10. FIGS. 28-29 illustrate footboard examples and FIGS. 4A-C illustrate pendant examples.

The LCD assembly may include a console interface or LCD panel with a touch screen, at least one processor, software, and programmable or flash memory. In addition to providing the necessary algorithms to control and/or monitor the functions of the apparatus, the software provides a graphical user interface (GUI) to organize the functions of the apparatus. The GUI may display a set of symbols such as "icons" and buttons in any arrangement for a particular function, for example, bed motion. If another function is desired, the GUI may display another set of icons and buttons for that particular function.

In the embodiment of FIGS. 28-29, the LCD panel is mounted facing the attendant side of the footboard such that an attendant can operate the LCD assembly using the integrated touch screen. Alternatively, as described above, the LCD panel can pivot from an operational position to a stored position wherein the functions are inaccessible.

This embodiment may allow a plurality of functions can be consolidated in a single location. The GUI may be configured such that the operation of each function is readily understood for an attendant who may be unfamiliar with all of the functions of the apparatus. Examples of functions that may be operated or monitored from the LCD panel are apparatus motion, mattress air pressure, patient motion, patient biometrics, scale, bed security, alerts, exit and event log/history, help screens, diagnostics, room lights, doors/windows, motion sensors, etc.

One advantage of this embodiment is that its functionality can be changed or adjusted by updating the software stored in the flash or programmable memory. For example, the software may be customized to the particular requirements of the user. With any change in function of the apparatus, the GUI of the LCD assembly can be altered and adapted to accommodate such changes.

Another advantage of this embodiment is that it may be adapted for use in a computer network. In a hospital, for example, a number of hospital beds may be remotely monitored from a central location such as a nursing station. The software in a number of hospital beds can also be remotely updated or altered using a computer network. The ability to remotely operate the LCD assembly is especially advantageous where a patient has been quarantined and it is desirable to minimize contamination to the patient, hospital staff, or equipment.

The footboard controller of FIG. 29 illustrates the following components and indicators:

A Touch Screen Display
B Bed Exit Detection Interface
C Mattress Interface
D Information Interface
E Modification of Intensity of Backlighting
F Lock Out System Interface
G System Message Indicator
H Indicator for detection of BED EXIT ON/OFF
I Weighing Scale Interface
J Motion Interface
K Brake Activation Indicator
L CPR Activation
M Steer Activation Indicator
N Neutral Activation Indicator
0 Trendelenburg Activation Bed-Network Communication Systems Multipoint Control Architectures An embedded communication network in a bed having a multiple control point architecture is also provided. The network may be based on Controlled Area Network (CAN). Several processors are connected to the network, each processor being capable of controlling various functions. Each function can be controlled by one processor or by several processors connected to the network. The types of functions to be controlled in this manner are button-reading functions, motion decision functions, scale system functions, and functions related to the bed exit system. In this type of configuration, multiple functions can be computed simultaneously from different processors of the control points in the network. Where the same function is computed from two different control points, a priority algorithm decides which function will be performed.

One feature of the network is the multiple control points associated with specified functions allowing simultaneous computing of functions and the priority or conflict resolution mechanism. This may improve the motion security of the bed, diminish the impact of the processors' computing limitations, improve response time, and reduce the length of the cables in the network. Such multiple control point architecture is also compatible with any bed having a pre-existing CAN-based embedded communication network.

Network Connection

A network connection may be integrated into a plurality of hospital beds to provide an information or data link between each bed and the computing network of the care facility. This data link provides a means for the transfer of information between the bed and the care facility, thereby enabling patient information to be transferred to the bed, and bed diagnostic information to be transferred to the computing network. Data transfer may be provided by a wired or wireless data link.

The information that can be transferred from the computing network to the bed can include patient data such as test results, personal histories, or other patient related information. Furthermore, bed diagnostic information, current location, and patient information evaluated by the bed, for example, can be transferred from the bed to the computing network. The transfer of information via the data link provides a means for remote access to the information determined and collected by the bed and remote monitoring of both the bed and the patient. In addition, the data link enables the remote updating of bed software and operational parameters when desired.

The data link enables the centralization of patient and bed monitoring, which assists in providing enhanced and more efficient patient care, bed servicing and maintenance, and efficient bed allocation based on patient requirements, for example upcoming procedures and bed requirements for these procedures, thereby reducing patient transfers if an appropriate bed is originally allocated.

Changes and modifications in the specifically described embodiments may be carried out without departing from the principles of the present invention, which is intended to be limited only by the scope of the appended claims, as interpreted according to the principles of patent law.

What is claimed is:

1. A patient bed comprising:

a base frame;

a support frame system supported relative to said base frame and having a perimeter, and comprising a deck support having a top surface area and at least two chosen from a head section, a seat section, and a foot section, wherein at least one of said sections is movable relative to another of said sections of said deck support;

a control module having a housing, a motor, and a sensor;

an articulating support arm, said support arm pivotally coupled to said support frame system, said support arm being positionable at a plurality of locations around the perimeter of said support frame system, and said support arm adapted to support said control module;

a coupling device at a distal end of said support arm, wherein said coupling device is adapted to couple to said control module at said housing to permit three dimensional movement of said control module; and wherein said motor and said sensor of said control module are configured to allow said control module to maintain a predetermined angle or position relative to a floor surface regardless of the angle of said deck support and any of said at least two chosen from said head section, said seat section, and said foot section relative to the floor surface.

2. The patient bed of claim 1, wherein said support arm is adapted to remain substantially stationary during movement of any of said sections of said deck support.

3. The patient bed of claim 1, wherein at least one of said sections of said deck support comprises at least one movable side pullout extension adapted to selectively widen or narrow the top surface area of the deck support, said at least one side pullout extension being movable between a retracted position and at least one extended position.

4. The patient bed according to claim 3, wherein said head section is pivotally connected to said seat section and said foot section is pivotally connected to said seat section opposite said head section.

5. The patient bed according to claim 3, wherein said foot section comprises a movable end pullout extension, said end pullout extension adapted to selectively lengthen or shorten the top surface area of the deck support, said end pullout extension being movable between a retracted position and at least one extended position.

6. The patient bed according to claim 3, wherein at least one chosen from said head section, said seat section, or said foot section comprises one or two side pullout extensions, each of said side pullout extensions located at an one of two opposite sides of a respective section, said side pullout extensions adapted to extend a distance out from a respective side of the respective section and to retract at least partially into the respective section.

7. The patient bed according to claim 3, wherein at least one of said head section, said seat section, or said foot section further comprises a latch adapted to releasably lock said at least one movable side pullout extension in the retracted position.

8. The patient bed according to claim 3, wherein said foot section further comprises a latch adapted to releasably lock said end pullout extension in the retracted position.

9. The patient bed according to claim 1, wherein said coupling device further comprises a pair of coupled link arms.

10. The patient bed of claim 1, wherein said support arm is adapted to support an IV pole.

11. The patient bed of claim 1, wherein said coupling device is adapted to accommodate a wire linking said control module to the bed.

12. A patient bed comprising:

a base frame;

a support frame system supported relative to said base frame and having a perimeter;

a control module having a housing, a motor, and a sensor;

an articulating support arm, said support arm adapted to mount to said support frame system, said support arm being positionable at a plurality of locations around the perimeter of said support frame system, and said support arm adapted to support said control module;

a coupling device at a distal end of said support arm, said coupling device being coupled to said control module at said housing;

a stopping mechanism at said coupling device, said stopping mechanism configured to permit variable positioning of the object, whereby said support arm is configured to be adjusted from a first of a plurality of positions by applying a manual force, and is configured to be subsequently stopped in a second of said plurality of positions by said stopping mechanism after removal of the application of the manual force;

wherein said support frame system comprises a deck support having a top surface area and at least two chosen from a head section, a seat section, and a foot section, wherein at least one of said sections is movable relative to another of said sections, and wherein said articulating support arm remains substantially stationary during movement of any of said sections; and wherein said motor and said sensor of said control module are configured to allow said control module to maintain a predetermined angle or position relative to the floor surface regardless of the angle of said deck support and any of said at least two chosen from said head section, said seat section, and said foot section relative to the floor surface.

* * * * *